US009681717B2

(12) United States Patent
Meersschaert et al.

(10) Patent No.: US 9,681,717 B2
(45) Date of Patent: Jun. 20, 2017

(54) FOLDABLE LUGGAGE

(71) Applicant: Samsonite IP Holdings S.a.r.l., Luxembourg (LU)

(72) Inventors: Reinhard Meersschaert, Merelbeke (BE); Dirk Santy, Koekelare (BE)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 319 days.

(21) Appl. No.: 14/358,533

(22) PCT Filed: Nov. 15, 2012

(86) PCT No.: PCT/EP2012/072687

§ 371 (c)(1),
(2) Date: May 15, 2014

(87) PCT Pub. No.: WO2013/072399

PCT Pub. Date: May 23, 2013

(65) Prior Publication Data

US 2014/0311848 A1 Oct. 23, 2014

Related U.S. Application Data

(60) Provisional application No. 61/560,215, filed on Nov. 15, 2011.

(51) Int. Cl.
*A45C 5/14* (2006.01)
*A45C 7/00* (2006.01)

(52) U.S. Cl.
CPC ..... *A45C 7/0018* (2013.01); *A45C 5/14* (2013.01); *A45C 5/146* (2013.01); *A45C 7/0036* (2013.01)

(58) Field of Classification Search
CPC ..... A45C 5/14; A45C 7/0018; A45C 7/0036; A45C 5/146
See application file for complete search history.

(56) References Cited

U.S. PATENT DOCUMENTS 39,414 A * 8/1863 Mersereau ..... B60B 33/00 16/40
244,447 A * 7/1881 Gould ..... B60B 33/00 16/40

(Continued)

FOREIGN PATENT DOCUMENTS

CA 2296904 A1 7/2000
CN 2479784 Y 3/2002

(Continued)

OTHER PUBLICATIONS

PCT International Search Report dated Jun. 16, 2013 for International Application No. PCT/EP2012/072687, 7 pages.

*Primary Examiner* — Tri Mai
(74) *Attorney, Agent, or Firm* — Dorsey & Whitney LLP

(57) ABSTRACT

A wheel housing (340) for a luggage case may include first and second pieces (342, 344) pivotally joined together. At least one of the first and second pieces (342, 344) supports an axle (346) that supports a wheel (348). The first piece (342) includes a surface that conforms to a first surface portion of the luggage case (100, 300), and the second piece (344) includes a surface that conforms to a second surface portion of the luggage case (100, 300). The wheel housing (340) may advantageously be coupled to a luggage case (100, 300). The first piece of (342) the wheel housing (340) may be operatively coupled to a first support portion of the luggage case (100, 300), and the second piece (344) of the wheel housing (340) may be coupled to a second support portion of the luggage case (100, 300). The first and second support portions of the luggage case (100, 300) may be defined by a single sheet of material in some examples.

13 Claims, 23 Drawing Sheets

(56) References Cited

U.S. PATENT DOCUMENTS

| | | | | |
|---|---|---|---|---|
| 2,699,848 | A | 1/1955 | Kaplan | |
| 4,753,329 | A | 6/1988 | Choy | |
| 5,115,895 | A * | 5/1992 | Myers | A45C 5/14 190/123 |
| 5,197,580 | A | 3/1993 | Berman et al. | |
| 5,277,449 | A | 1/1994 | Schmidt | |
| 5,303,805 | A | 4/1994 | Hauser | |
| 5,343,578 | A | 9/1994 | Kettenhofen | |
| 5,358,082 | A | 10/1994 | Armstrong, IV | |
| 5,365,635 | A | 11/1994 | Jang | |
| 5,749,446 | A | 5/1998 | Hsieh | |
| 5,782,325 | A * | 7/1998 | O'Shea | A45C 5/14 16/113.1 |
| 6,047,798 | A | 4/2000 | Lin | |
| 6,408,997 | B1 | 6/2002 | Chen | |
| 6,478,315 | B1 | 11/2002 | Manesis | |
| 6,502,677 | B1 * | 1/2003 | Tiramani | A45C 5/03 16/114.1 |
| 6,994,132 | B2 | 2/2006 | Antrobus | |
| 7,614,628 | B2 | 11/2009 | O'Connor | |
| 7,849,984 | B2 * | 12/2010 | Whalen | A45C 7/0077 190/107 |
| 8,413,775 | B2 * | 4/2013 | Tong | A45C 5/14 190/107 |
| 2003/0034636 | A1 | 2/2003 | Ng | |
| 2003/0038009 | A1 * | 2/2003 | Chang | A45C 5/02 190/127 |
| 2003/0221924 | A1 | 12/2003 | Tong | |
| 2004/0065518 | A1 | 4/2004 | Hoberman | |
| 2007/0086845 | A1 | 4/2007 | Merzon | |
| 2008/0135364 | A1 | 6/2008 | Chang et al. | |
| 2009/0057307 | A1 * | 3/2009 | Jung | A45C 5/14 220/6 |
| 2009/0183961 | A1 | 7/2009 | Whalen et al. | |
| 2010/0282556 | A1 | 11/2010 | Tseng et al. | |
| 2011/0083933 | A1 * | 4/2011 | Engel | A45C 7/0077 190/18 A |
| 2011/0162931 | A1 | 7/2011 | Collins et al. | |
| 2012/0012430 | A1 | 1/2012 | Tong | |
| 2012/0133261 | A1 | 5/2012 | Yuan et al. | |
| 2013/0075214 | A1 * | 3/2013 | Chi Yueh Chen | A45C 7/0054 190/18 A |

FOREIGN PATENT DOCUMENTS

| | | | |
|---|---|---|---|
| CN | 2520723 | Y | 11/2002 |
| CN | 2602647 | Y | 2/2004 |
| CN | 2737187 | Y | 11/2005 |
| CN | 201256690 | Y | 6/2009 |
| CN | 101683204 | A | 3/2010 |
| CN | 201718657 | U | 1/2011 |
| EP | 1589848 | | 11/2005 |
| EP | 1846300 | | 10/2007 |
| FR | 1010156 | A | 6/1952 |
| FR | 93743 | E | 5/1969 |
| GB | 2462099 | | 1/2010 |
| WO | 9214638 | A1 | 9/1992 |
| WO | 92/19124 | A1 | 11/1992 |
| WO | 0069305 | A1 | 11/2000 |
| WO | 2004068992 | A2 | 8/2004 |
| WO | 2006/083633 | A2 | 8/2006 |
| WO | 2010141207 | A1 | 12/2010 |
| WO | 2013072399 | A2 | 5/2013 |

* cited by examiner

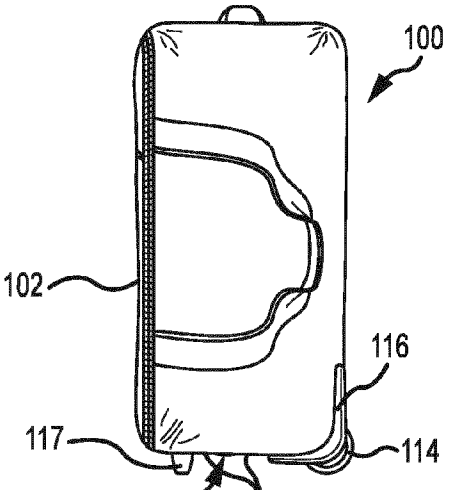
FIGURE 2A
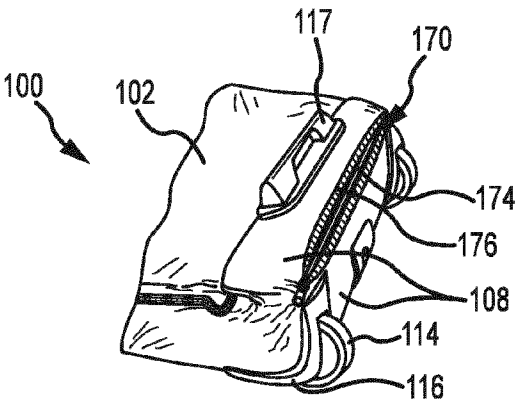
FIGURE 2B
FIGURE 3A
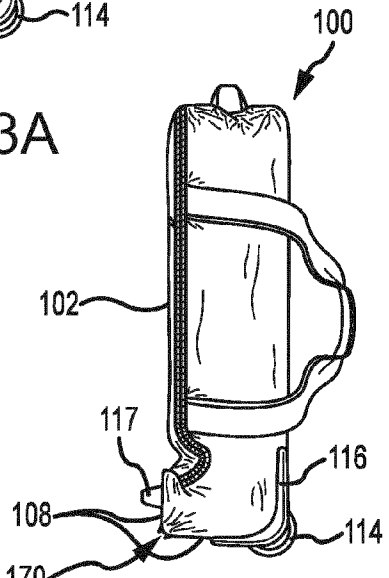
FIGURE 3B

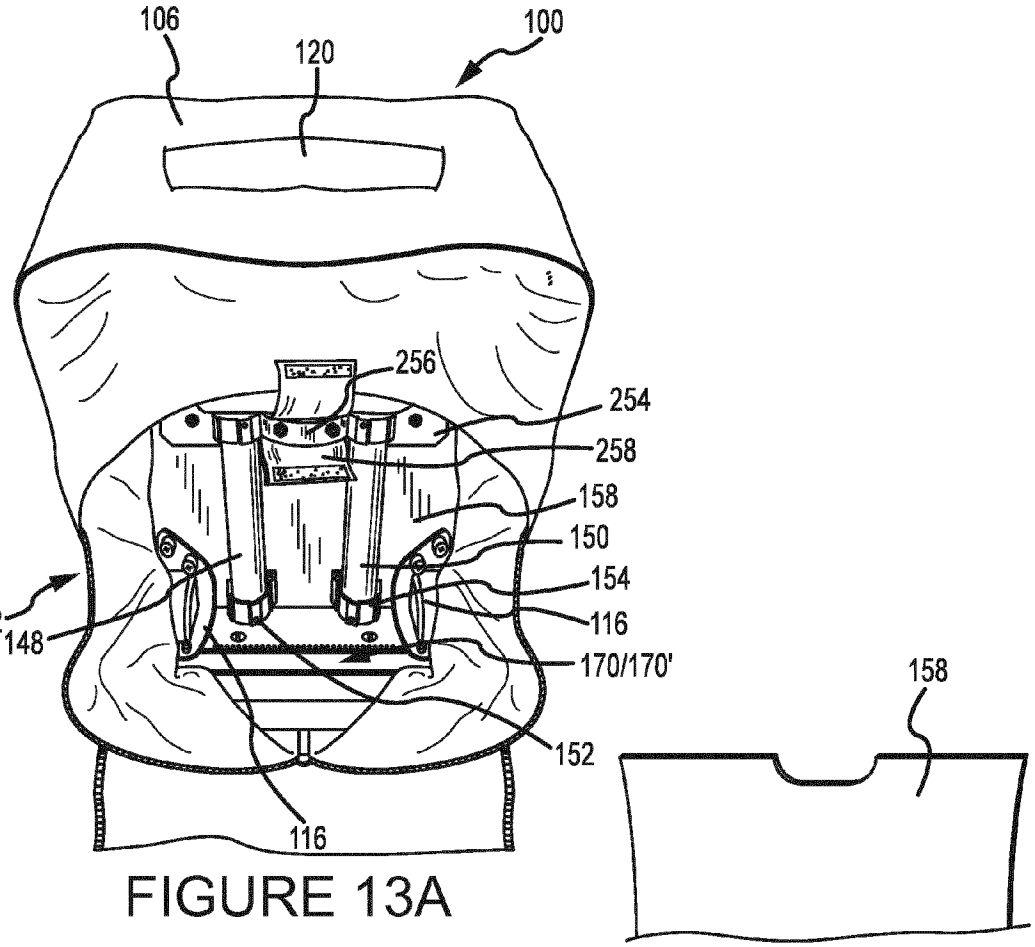
FIGURE 13A
FIGURE 13B
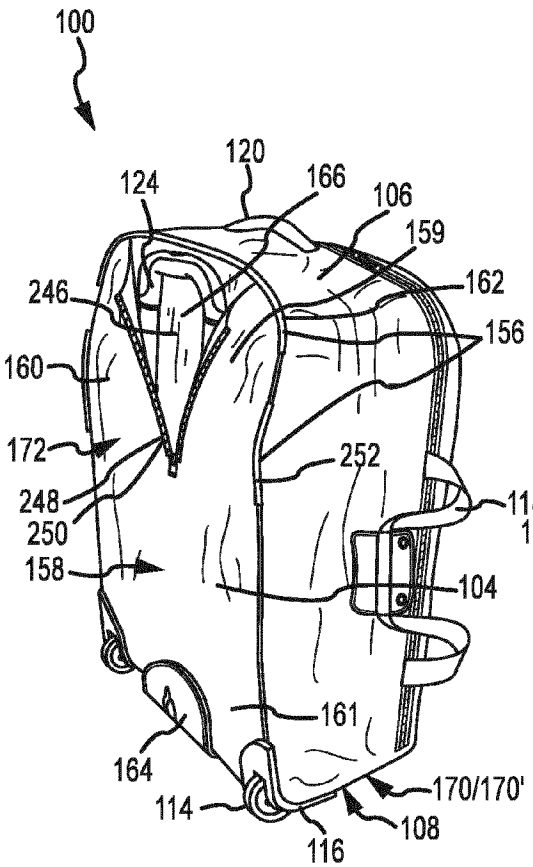
FIGURE 12

FOLDABLE LUGGAGE

CROSS-REFERENCE TO RELATED APPLICATIONS

This application is the national stage application of International Patent Application No. PCT/EP2012/072687 filed on Nov. 15, 2012 and entitled "Foldable Luggage," which claims the benefit of and priority to U.S. provisional patent application No. 61/560,215, filed on Nov. 15, 2011, and entitled "Foldable Luggage," which are hereby incorporated by reference in their entireties for all purposes.

TECHNOLOGICAL FIELD

The technological field generally relates to luggage, and more particularly to foldable luggage.

BACKGROUND

When in use, luggage cases may need to be relatively rigid and durable in order to withstand harsh conditions during the transport and handling of the luggage. When not in use, however, luggage cases may need to be stored. In some cases, a user may wish to minimize the space that a luggage case occupies when stored so that he or she can store other things in a storage location. In order to make luggage cases somewhat smaller when not in use, some luggage cases include one or more zipper expansion/contraction mechanisms that allow the sidewalls of the luggage case to expand when a zipper is unzipped and contract when the zipper is zipped. Typically, the expansion/contraction mechanism includes a flexible portion of fabric (such as nylon) that is cinched by the zipper when in a zipped, closed arrangement, and is allowed to be pulled tight when in an unzipped, open arrangement. The expansion portion of fabric, however, is not rigid, and thus may not provide sufficient support for the contents of the luggage case during, for example, transport and handling of the luggage case. Such expansion/contraction mechanisms also typically allow expansion/contraction along the depth of a luggage case, and does not typically allow the luggage case to expand/contract along the height of the luggage case.

In order to allow luggage cases to expand/contract along both the depth and height of the luggage case, some cases include one or more removable boards that may be selectively inserted as the inner side walls of a luggage case. These removable boards, however, may be lost when they are not inserted into the side walls of the luggage case. It may also be inconvenient for a user to manually remove the boards from the luggage case each time the luggage case is put into a storage location, particularly if the removable boards are secured using screws or other types of fasteners.

Also, some luggage folding mechanisms are located in the center portion of a luggage case (e.g., away from the wheels, which may be made of hard plastic in order to withstand the aforesaid harsh conditions during transport and handling of the luggage case). As such, these folding mechanisms may not allow the luggage case to be folded completely flat because the luggage case cannot be folded or bent along certain points.

Documents that show some approaches to folding or foldable luggage include U.S. Pat. No. 6,047,798, WO 00/69305, US 2008/135364, US 2003/034636, EP 1,846,300, U.S. Pat. No. 5,197,580, WO 2010/141207, U.S. Pat. No. 6,408,997, CN 2737187Y, U.S. Pat. No. 5,749,446, EP 1,589,848, US 2010/0282556, U.S. Pat. No. 4,753,329, CA 2,296,904, U.S. Pat. No. 5,343,578, and U.S. Pat. No. 2,699,848. These proposals, however, may be improved upon.

SUMMARY

Described herein are various foldable luggage pieces and features thereof.

In particular, as described herein, one embodiment of a wheel housing for a luggage case may include first and second pieces pivotally joined together. At least one of the first and second pieces may support an axle that may support a wheel. The first piece may include a surface that conforms to a first surface portion of the luggage case, and the second piece may include a surface that conforms to a second surface portion of the luggage case.

In some examples, the first piece includes a shell with a disk portion configured to receive and cover a portion of the wheel, and the second piece includes a sheath with a protruding portion operable to pivot around the disk portion of the shell. The first and second pieces may each include an elongated portion, and preferably each elongated portion includes at least one boss for operative securement of the respective first and second pieces to the luggage case. The axle may be axially aligned with a wheel housing pivot axis about which the first and second pieces move relative to one another. The wheel housing may also include a locking mechanism operable to lock the first and second pieces in a first position relative to one another, and preferably the first position is an open position. The locking mechanism may include a detent on the second piece and a blocking member on the first piece.

A luggage case may include a wheel housing as described herein. The wheel housing may define a luggage case pivot axis along which a rear side and a bottom side of the luggage case move relative to one another to collapse the luggage case. The luggage case pivot axis may be axially aligned with a wheel housing pivot axis about which the first and second pieces move relative to one another. The first piece of the wheel housing may be operatively coupled to a first support portion of the luggage case, with the second piece of the wheel housing operatively coupled to a second support portion of the luggage case, and the first and second support portions may be defined by a single sheet of material that also defines a hinge positioned between the first and second support portions. The single sheet of material may be scored within at least a portion of the single sheet of material that defines the hinge. The first piece of the wheel housing may be operatively coupled to a first support portion of the luggage case, the second piece of the wheel housing may be operatively coupled to a second support portion of the luggage case. The first and second support portions may be distinct one from the other, with the luggage case further including a hinge coupled between the first and second support portions. The first and second support portions respectively may include first and second panels, and the hinge may extend along at least a portion of respective planes defined by both the first and second panels. The first piece of the wheel housing may be operatively coupled to a first support portion of the luggage case, the second piece of the wheel housing may be operatively coupled to a second support portion of the luggage case, the first support portion may be a rear side of the luggage case, and the second support portion may be a bottom side of the luggage case.

The luggage case may also include a brace with a plurality of articulating connector members. At least one of the plurality of articulating connector members may include a first arm defining a single pivotal joint and a second arm defining a double articulating joint, with the second arm spaced away from the first and second pieces of the wheel housing. The single pivotal joint may pivot coaxially with the axle supporting the wheel.

A foldable luggage case may include a front side, a rear side, a right side, a left side, an upper side, and a bottom side. The bottom side may include a first folding system operable to fold the luggage case along its depth, and the rear side may include a second folding system operable to fold the luggage case along its height. In some examples, the first folding system includes a first foldable wheel housing coupling the rear side, the bottom side, and the left side of the foldable luggage case, and a second foldable wheel housing coupling the rear side, the bottom side, and the right side of the foldable luggage case. The first folding system may be operable to fold the luggage case along its depth about a corner seam between the rear side and the bottom side of the luggage case as defined by the first and second foldable wheel housings.

Another example of a foldable luggage case may include a front side, a rear side, a right side, a left side, an upper side, and a bottom side. The rear side may include a second folding system operable to fold the luggage case along its height. The luggage case may also include a telescoping tow handle retractable along the height of the luggage case, the telescoping tow handle including a grip portion. The rear side of the foldable luggage case may be operable to fold along a fold line advantageously defined at least in part by the grip portion of the telescoping tow handle when the telescoping tow handle is retractably received in the luggage case.

In another embodiment a folding system may include a first panel with an inner surface and an outer surface, a second panel with an inner surface and an outer surface, a hinge coupling the inner surface of the first panel to the inner surface of the second panel, and a securing mechanism selectively coupling the outer surface of the second panel to the outer surface of the first panel. The folding system may be implemented on a bottom side of a luggage case, and the hinge may include a flexible polypropylene strap. The hinge may have a first section, including a first receiving portion, a first supporting portion, and a first interlocking portion. The hinge may also have a second section, including a second receiving portion, a second supporting portion, and a second interlocking portion. The hinge may also have a bridge between the first section and the second section, and the first and second receiving portions may be configured to engage the first and second panels, respectively. The selective coupling of the securing mechanism may selectively cause the inner surface of the first panel to be in a substantially coplanar orientation with respect to the inner surface of the second panel. The selective coupling of the securing mechanism may selectively cause the inner surface of the first panel to be in a substantially perpendicular orientation with respect to the inner surface of the second panel.

In another embodiment, a foldable luggage case includes a front side, a rear side, a right side, a left side, an upper side, and a bottom side. The bottom side may include a first folding system operable to fold the luggage case along its depth, and the rear side may include a second folding system operable to fold the foldable luggage case along its height. The rear side of the foldable luggage case may include an upper portion and a lower portion, with the upper portion of the rear side including flexible fabric, and the lower portion of the rear side including a rigid panel. A multi-stage telescoping handle may be coupled to the rigid panel.

The rear side of the foldable luggage may further include piping coupled between the rear side and portions of the upper, right and left sides of the foldable luggage case. The rear side of the foldable luggage case may have an upper portion and a lower portion, the upper portion of the rear side including a rigid panel, and the lower portion of the rear side including a rigid panel. The rear side of the luggage case may further include piping coupled to the rigid board, both the piping and the rigid board positioned rearward of a multi-stage telescoping handle. The front side of the foldable luggage case may have a front flap, with the front flap is configured to wrap around the rear side of the foldable luggage case when in a folded configuration. The luggage case may further include a first foldable wheel housing at the intersection of the rear side, the bottom side, and the left side of the foldable luggage case, and a second foldable wheel housing at the intersection of the rear side, the bottom side, and the right side of the foldable luggage case. The first folding system may be located in the corner intersection between the rear side and the bottom side of the luggage case.

In another embodiment, a foldable wheel housing may include a shell and a sheath pivotally coupled to the shell. The shell may include a hollow disk portion configured to receive and cover a portion of a wheel and a linear portion configured to couple the shell to a first surface. The sheath may include a protruding portion shaped to pivot around the hollow disk portion of the shell and a linear portion configured to couple the sheath to a second surface. An axle may pivotally couple the shell, the sheath, and a wheel together. The protruding portion of the sheath may include a plurality of arms and an arcuate connector coupled between the plurality of arms. A cross-section of the hollow disk portion may be U-shaped, and/or a cross-section of the protruding portion may be U-shaped. The cross-section of the protruding portion may be wider than the cross-section of the hollow disk portion. The first surface may be on a rear side of a luggage case, and the second surface may be on a bottom side of a luggage case. The shell and the sheath may be coupled to the rear and bottom sides of the luggage case through two or more receiving elements and fasteners.

In still another embodiment of a luggage case, the luggage case may include a first panel, a second panel foldably coupled to the second panel through two or more foldable wheel housings, and a flexible hinge coupled between the first and second panels.

In still another embodiment, a foldable luggage case may include a front side, a rear side, a right side, a left side, an upper side, and a bottom side, with the bottom side including a first folding system operable to fold the luggage case along its depth, and the rear side including a second folding system operable to fold the foldable luggage case along its height.

In another embodiment of a wheel housing, a shell may include a disk portion configured to receive and cover a portion of a wheel, and a linear portion configured to couple the shell to a first surface. The wheel housing may also include a sheath pivotally coupled to the shell, with the sheath including a protruding portion shaped to pivot around the disk portion of the shell, and a linear portion configured to couple the sheath to a second surface.

This summary is given to aid in understanding the nature of the folding luggage, and one of ordinary skill in the art will understand that each of the various aspects and features of the folding luggage described herein may advantageously be used separately in some instances, or in combination with other aspects and features of the foldable luggage in other instances.

BRIEF DESCRIPTION OF THE DRAWINGS

Various aspects of the foldable luggage will now be described by way of example only with reference to the following figures in which:

FIG. 2A shows a bottom perspective view of a portion of the luggage case shown in FIG. 1A, with the bottom side of the luggage not folded.

FIG. 2B shows a bottom perspective view of a portion of the foldable luggage case shown in FIG. 1A, with the bottom side of the luggage folded.

FIG. 3A is a side elevation view of the luggage case shown in FIG. 1A, with the bottom of the luggage not folded.

FIG. 3B is a side elevation view of the luggage case shown in FIG. 1A, with the bottom of the luggage folded.

FIG. 12 shows a rear perspective view of the luggage case shown in FIG. 1A, with the telescoping handle at a middle position.

FIG. 13A shows a front view of the luggage case of FIG. 1A, with a front cover of the luggage case open and an interior lining partially pulled away.

FIG. 13B shows a front view of a rigid or semi-rigid panel.

DETAILED DESCRIPTION

Described herein are foldable luggage cases. A foldable luggage case may include a first folding system that allows the luggage case to be folded along the depth of the luggage case, a second folding system that allows the luggage case to be folded along the height of the luggage case, and/or one or more foldable wheel housings that allow, for example, the first folding system to be placed in the corner of the bottom of the luggage case. In general, foldable luggage cases may include one or more of a first folding system, a second folding system, foldable wheel housings, and/or other folding mechanisms in addition to or in place of the foregoing, such as those described in more detail below. Such foldable luggage cases may be reduced in size while not in use in order to be stored compactly, while still providing a robust framework while in use in order to sufficiently support the contents of the luggage case.

Figure 1B:
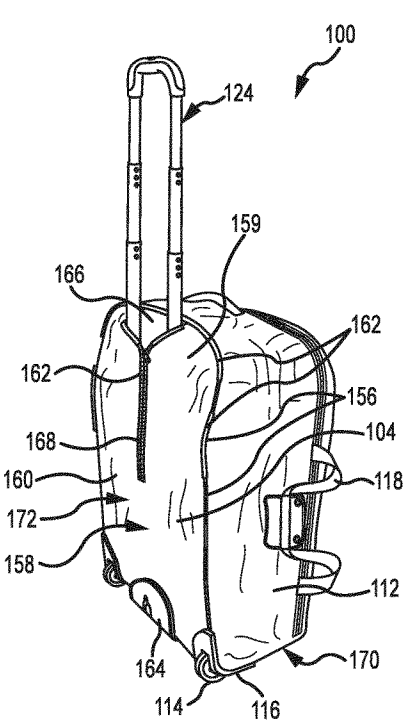
FIG. 1B shows a rear perspective view of the luggage case shown in FIG. 1A.
Figure 1A:
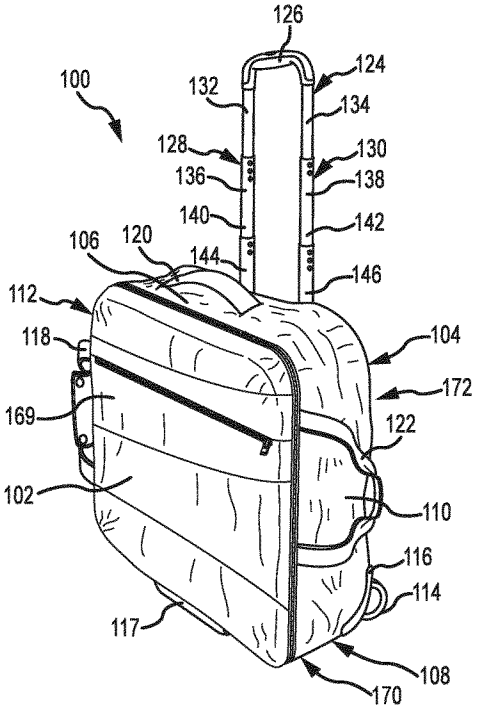
FIG. 1A shows a front perspective view of a foldable luggage case.

FIG. 1A shows a front perspective view of a foldable luggage case 100. With reference to FIG. 1A, the luggage case may include a front side 102, a rear side 104, an upper side 106, a bottom side 108, a right side 110, and a left side 112 that define an enclosed space. The enclosed space may be divided into one or more main compartments. As described in more detail below, each side may include a single section, or multiple sections.

In the embodiment shown in FIG. 1A, the front side 102 and portions of the upper, bottom, right, and left sides 106, 108, 110, 112 of the luggage case 100 may define at least a portion of a lid or a front flap 113. The rear side 104, and portions of the upper, bottom, right, and left sides 106, 108, 110, 112 of the luggage may define at least a portion of a base. The lid and the base may be coupled by a hinge (not visible in FIG. 1A) on the one side of the luggage case 100, and together the lid and the base may define a main compartment of the luggage case 100. The hinge may allow the lid and the base to be pivoted relative to each other while remaining coupled via the hinge(s). The lid of the luggage case 100 shown in FIG. 1A may be pivoted relative to the base such that the main compartment is opened, thus allowing a user to access the enclosed space. Generally, the hinge may be on any of the sides of the luggage case 100, such as the left, right, or bottom side 108, 110, 112 for example. In the embodiment shown in FIG. 1A, the hinge may be on the bottom side 108 of the luggage case 100.

In some embodiments (not shown), a middle frame may be provided between the lid and the base of the luggage case 100. The middle frame may provide two main compartments (e.g., a front and a rear compartment) as opposed to a single main compartment.

The luggage case 100 may include one or more wheels 114 coupled to the luggage 100. The wheels 114 may be wheels that allow for the rolling movement of each wheel along a single direction, spinner wheels, and so on. Each wheel 114 may be coupled to the luggage case 100 via a wheel housing 116, multiple embodiments of which are shown in the figures and described below. In some embodiments, one or more feet 117 or other supports may be coupled to the luggage 100 to facilitate positioning and maintaining the luggage 100 in an upright position on a support surface, similar to the position of the luggage 100 shown in FIG. 1A. Some luggage cases, however, may not include any wheels.

The luggage case 100 may further include one or more handles 118, 120, 122, 124. At least one of the handles may be a telescoping handle 124 that may be selectively moved between one or more retracted positions and one or more extended positions. In an extended position, the telescoping handle 124 may be used to facilitate using the wheels 114 to push or pull the luggage case 100 along a support surface, and may also be a part of a second folding system 172 of a luggage case 100. In FIG. 1A, the telescoping handle 124 is shown coupled to the rear side 104 of the luggage case 100. As described in more detail below, the rear side 104 of the luggage case 100 in FIG. 1A may be at least partially structured with one or more rigid or semi-rigid panels 158, such as a polypropylene board. Coupling a telescoping handle to the rear side 104 may provide sufficient support to guide a luggage case 100 with wheels 114 using the telescoping handle 124.

The telescoping handle 124 may be any type of telescoping handle. The telescoping handle 124 may include a grip portion 126 configured to be grasped by a user's hand, and one or more legs. Each leg may include one or more extending tubes, and one or more receiving tubes. With reference to FIG. 1A, in one embodiment, the telescoping handle 124 includes a grip portion 126, a first leg 128, and a second leg 130, although in other embodiments, the telescoping handle 124 may not include a second leg 130, or may alternatively include a third leg, etc. The first and second legs 128, 130 shown in FIG. 1A may each include one or more extending tubes 132, 134, 140, 142, and one or more receiving tubes 136, 138, 144, 146. The extending and receiving tubes 132, 134, 136, 138, 140, 142, 144, 146 may be configured to increase and decrease the total effective length of the telescoping handle 124, and may lock into several different retracted and/or extended positions. In some embodiments, the extending tubes 132, 134, 140, 142 may have a smaller diameter than the receiving tubes 136, 138, 144, 146 thus allowing the extending tubes 132, 134, 140, 142 to be retracted inside the receiving tubes 136, 138, 144, 146 when the telescoping handle 124 is in a retracted position (although in other embodiments, the receiving tubes 136, 138, 144, 146 may have a smaller diameter than the extending tubes 132, 134, 140, 142). The extending and receiving tubes 132, 134, 136, 138, 140, 142, 144, 146 of the legs 128, 130 may have a generally circular cross-section, but may also have an oval cross-section, a square cross-section, or any other shape of cross-section. The cross-section of the extending and receiving tubes 132, 134, 136, 138, 140, 142, 144, 146 may also include one or more notches. The extending tubes 132, 134, 140, 142 may lock into different positions in response to, for example, one or more pins being selectively biased into openings in the receiving tubes 136, 138, 144, 146, or vice versa.

The telescoping handle 124 may be a multi-stage telescoping handle 124, which may include a series of extending and receiving tubes. For example, in the first (or top) stage, first stage extending tubes 132, 134 may be coupled to the grip portion 126, and may be selectively received into or extended from first stage receiving tubes 136, 138. The first stage receiving tubes 136, 138 may, in turn, be the extending tubes of the second stage 140, 142. The first stage receiving tubes 136, 138, which are also the second stage extending tubes 140, 142 may thus be received in the second stage receiving tubes 144, 146 (with, in some cases, the first stage extending tubes 132, 134 received within the second stage receiving tubes 144, 146). The second stage receiving tubes 144, 146 may in turn be the third stage extending tubes, and may be received in the third stage receiving tubes, and so forth. In general, any number of stages may be used.

Generally, the telescoping handle 124 shown in FIG. 1A may be coupled to the rear and or bottom sides 104, 108 of the luggage case 100 in any of a number of different ways, one specific example of which is described below in connection with FIGS. 13A and 13B. The receiving tubes of the last (or bottom) stage 148, 150 may be coupled to a panel in the lower portion 161 of the rear side 104 of the luggage case 100 by one or more brackets 152, 154, by glue, by welding, or in any other way. Also, other stages of the telescoping handle 124 may be coupled to the luggage case 100 in any of a number of different ways. For example, receiving tubes of one or more stages may be coupled to a panel or a portion of fabric 246 in the middle or upper portion 159 of the rear side 104 of the luggage case 100 by straps that include hook and loop fastener regions. A hook and loop fastener strap may, for example, be sewn or otherwise attached to a panel or portion of fabric 246 of the rear side 104 of the luggage case 100, and be configured to wrap around one or more receiving tubes and back around on itself. In other embodiments, retaining clips or clamps may be attached to the panel or portion of fabric 246 of the rear side 104 of the luggage 100 and may be configured to selectively clamp around one or more receiving tubes. Other coupling mechanisms may also be used to couple one or more stages of the receiving tubes to the luggage case 100.

The luggage 100 may further include one or more carry handles. In FIG. 1A, three carry handles 118, 120, 122, are shown: one coupled to the upper side 106 of the luggage 100, one coupled to the right side 110 of the luggage 100, and one coupled to the left side 112 of the luggage 100. The handles 118, 122 coupled to the left and right sides 110, 112 of the luggage 100 shown in FIG. 1A may be a strap-type handle suitable for carrying the luggage case 100 like a duffle bag. The carry handles 118, 120, 122 may be use to lift or carry the luggage 100. Of course, more or less than two carry handles may be coupled to the luggage 100, and the handles may be coupled to any portion of the luggage 100. Some luggage cases may include only one or more telescoping handles, only one or more carry handles, or some combination of both.

FIG. 1B shows a rear perspective view of the luggage case 100 shown in FIG. 1A. The rear side 104 of the luggage 100 may include one or more sections of piping 156, one or more rigid or semi-rigid panels 158 (not visible), a telescoping handle 124 (as described above), a jacket 160 (which may include a selectively secured opening 162), a kick plate 164, one or more wheel housings 116, fabric, and so forth. One or more sections of piping 156 may extend around at least some of the rear side 104, and may serve to couple the rear side 104 to the upper, left, and right sides 106, 110, 112 of the luggage case 100. The piping 156 may be covered with fabric, rubber, plastic, or any other material. Some portions of the piping 156 may include piping reinforcement 157, such as rubber. Also, there may be gaps or joints between one or more portions of the piping 156. For example, there may be a gap where no piping exists at a joint where the foldable luggage case 100 folds. In some embodiments, however, piping reinforcement 157 may exist, even at the piping gap where there is no piping, along a joint where the foldable luggage case 100 folds. The piping reinforcement 157, at least at this joint, may be flexible so as to allow the foldable luggage case 100 to fold at the joint. The piping 156 may provide a semi-rigid framework for the rear side 104 of the luggage 100, as described below.

The rear side 104 may also include one or more rigid or semi-rigid panels (not visible). For example, the rear side 104 may include a rigid panel 158 in the lower portion of the rear side 104. The rigid or semi-rigid panel 158 may be formed from polypropylene (either as a solid sheet or in an extruded configuration) or any other type of plastic, metal, rubber, wood, etc. The rear side 104 may also, in some embodiments, include a rigid or a semi-rigid panel in the upper portion 159 of the rear side 104. In other embodiments, the upper portion 159 of the rear side 104 may include fabric, such as nylon, in place of a rigid or semi-rigid panel. In some embodiments, the rear side 104 of the luggage case 100 may include one or more middle portions in addition to the upper and lower portions. In general, the rear side 104 may include any number of vertical portions, and the number of vertical portions may in some embodiments determine the number of folds possible on the rear side 104 of the luggage case 100.

A jacket 160 may be coupled to or form a part of the rear side 104 of the luggage case 100. The telescoping handle 124 may be positioned between the jacket 160 and one or more rigid/semi-rigid panels or portions of fabric of the rear side 104. The jacket 160 may include a handle opening 166 so that the telescoping handle 124 can be raised to one or more extended positions. The jacket 160 may also include a selectively secured opening 162. The selectively secured opening 162 may, for example, include a zipper installed on a slit 168 in the jacket 160, with the slit 168 and the zipper extending approximately half-way down the height of the luggage case 100, as shown in FIG. 1B. As explained in more detail below, unsecuring the selectively secured opening 162 may allow the rear side 104 of the luggage 100 to be folded when the telescoping handle 124 is lowered to a retracted position. When the selectively secured opening 162 is secured (e.g., the zipper in FIG. 1B is zipped up) and the telescoping handle 124 is in an extended position, however, the rear side 104 of the luggage 100 may provide support for the contents of the luggage case 100. The jacket 160 may be made of, for example, a flexible fabric such as nylon, or any other type of fabric, plastic, and so forth.

A kick plate 164 may be coupled to corner intersection between the bottom side 108 and the rear side 104 of the luggage case 100. The kick plate 164 may include a first linear portion 260 that extends along the bottom side 108 of the luggage case 100 and a second linear portion 262 that extends along the rear side 104 of the luggage case 100. The kick plate 164 may include a connection mechanism 264 that may allow a strap 268 with another connection mechanism 266 to be coupled to the kick plate 164. The connection mechanism 264 may include a slotted channel 264 configured to receive a disk-type connector 266 on the strap 268.

Returning to FIG. 1A, the luggage case 100 may in some embodiments include a front pocket 169. Some embodiments of a luggage case 100 may also include various other features, such as a name tag identification element, side pockets, rear pockets, bumper guards, interior dividers and pockets, additional compartments, and so forth.

Generally the luggage case 100, including the front side 102, rear side 104, middle compartment, and so forth, may be made of fabric (e.g., nylon), plastic, metal, or any other suitable material, including a combination of different materials. The luggage case 100 may include a rigid bottom side 108, which may include a first folding system 170. The luggage case 100 may also include a rear side 104 that is at least partially rigid, which may include a second folding system 172. The front, left, right, and upper sides 102, 106, 110, 112 of the luggage case 100 may be relatively soft and flexible.

At least some of the sides may include panels or boards. The boards may be covered by outer side fabric, such as nylon. Also, the interior of the enclosed spaced defined by the sides may include an interior lining, as described below. The rear side 104 may include fabric such as nylon and at least one rigid polypropylene panel 158 extending part way up the rear side 104. The bottom side 108 may include an extruded polypropylene panel. The extruded polypropylene panel may be formed in two sections (e.g., made of two separate panels 178, 180), and the two sections or panels 178, 180 may be coupled by a hinge 182, 182', 182". A securing mechanism 174 may be joined to the panel to allow the sections or panels 178, 180 to be selectively secured to each other to prevent relative movement between them. The front, left, and right sides 102, 110, 112 of the luggage case 100 shown in FIG. 1A may include flexible fabric, such as nylon.

Figure 1D:
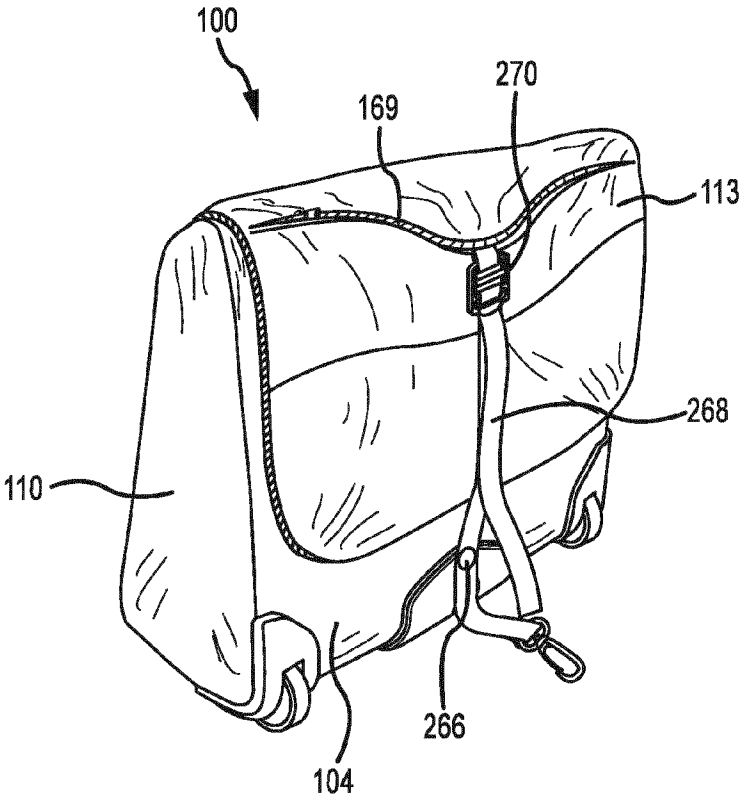
FIG. 1D shows a rear perspective view of the luggage case of FIG. 1C in a double-folded configuration.
Figure 1C:
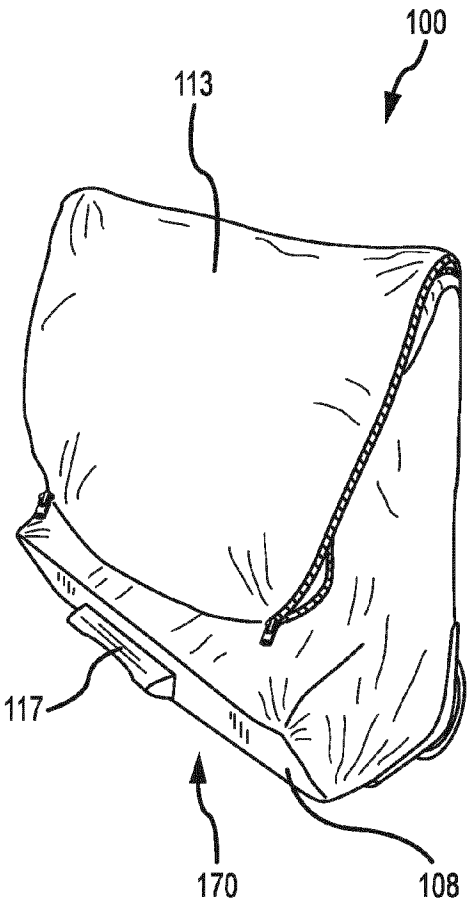
FIG. 1C shows a front perspective view of the luggage case shown in FIG. 1A in a folded configuration.

FIGS. 1C and 1D show a front perspective view and a rear perspective view, respectively, of the luggage case 100 shown in FIG. 1A, except that the luggage case 100 shown in FIGS. 1C and 1D is positioned in a folded configuration. With reference to FIG. 1C, the luggage case 100 may include a first folding system 170 and also a second folding system 172. As such, the luggage case 100 may be configured to be folded along two axes of the luggage case 100. For example, the luggage case 100 may be folded along the horizontal or depth axis (i.e. the bottom side 108 of the luggage case 100) via the first folding system 170, and may also be folded along the vertical or height axis (i.e. the rear side 104 of the luggage case 100) via the second folding system 172. In some cases, the luggage case 100 may be folded along the horizontal or depth axis via the first folding system 170 in that the bottom side 108 of the luggage case 100 is pivoted relative to the rear side 104 of the luggage case 100 (i.e., the case 100 is folded along the axis of the wheels 114 at the intersection between the rear side 104 and the bottom side 108 of the luggage case 100).

The luggage case 100 may be folded along the horizontal and the vertical axes in order to, in some embodiments, advantageously and significantly reduce the volume of space occupied by the luggage case 100 when not in use. This may allow users to store the luggage case 100 in a smaller area, or to store other items in a storage space that otherwise may be occupied by an unfoldable luggage case 100.

Figure 23:
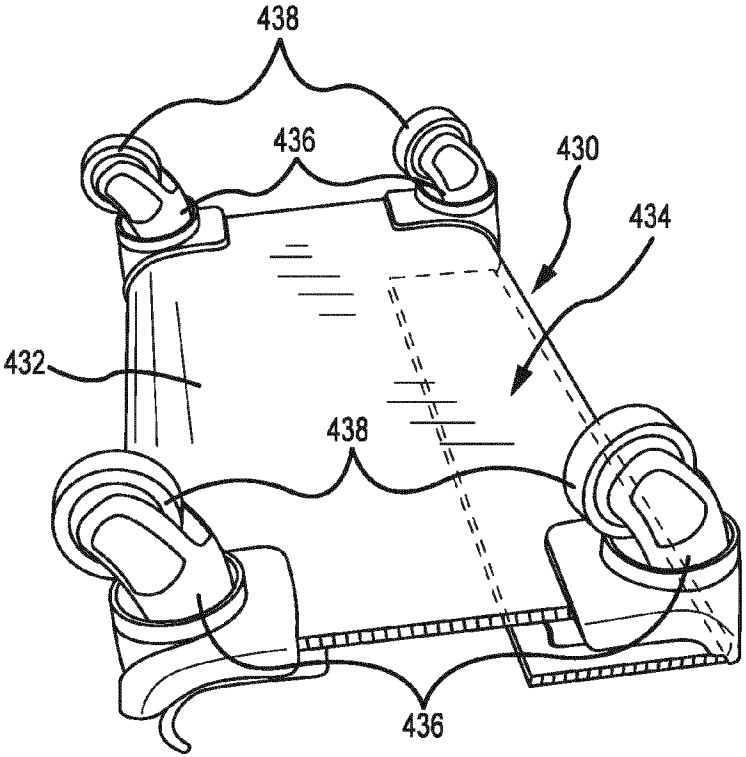
FIG. 23 shows a bottom perspective view of some of the structural components of a luggage case with a first folding system, with the first folding system folded.

Although the luggage case shown in FIGS. 1A through 1D is an upright-type luggage case, other types of luggage cases may also be used, including wheeled duffels, non-wheeled duffels, spinners, and so forth. FIGS. 22 and 23, for example, show some portions of spinner-type luggage cases. Any of the features of the luggage case illustrated in FIGS. 1A through 32B and/or described herein may be used alone, or in combination with any of the other features. For example, the folding system described herein in connection with the bottom side of the luggage case shown in FIGS. 1A through 1D may be used on any side or sides (and/or on any corner intersection) of a luggage case, including luggage cases without a telescoping handle and/or without the folding system described herein in connection with the rear side of the luggage case shown in FIGS. 1A through 1D and/or without the foldable wheel housing described below, and so forth. Alternatively, the foldable wheel housing and first folding system (both described below) may be used on a luggage case that does not include a telescoping handle and/or that does not have a second folding system. Alternatively, the second folding system described herein may be used in a luggage case without a first folding system. Some luggage cases, however, may include a first folding system, foldable wheel housings, a second folding system, and other features. Also, the features described herein are not limited to luggage cases, and may generally be applied to any type of container.

With reference to FIGS. 2A through 11, the operation of the first folding system 170 will now be described. While the first folding system 170 is shown and described as implemented on the bottom side 108 of the luggage case 100, the folding system 170 may be implemented on any of the sides of a luggage case 100, including at intersections between sides of a luggage case 100 (e.g., the intersection between the rear side 104 and the bottom side 108). Further, any of the folding systems described herein may be implemented on other cases, containers, boxes, and so forth.

Turning to FIGS. 2A and 3A, the bottom side 108 of the luggage case 100 may be positioned into an unfolded configuration. In this unfolded configuration, a securing mechanism 174 may be used to lock the first folding system 170. When locked by the securing mechanism 174, the first folding system 170 is disabled, thus preventing the use of the first folding system 170 to move the bottom side 108 into a folded configuration.

Turning to FIGS. 2B and 3B, the bottom side 108 of the luggage case 100 may be positioned into a folded configuration. The securing mechanism 174 may be unlocked or unsecured, thereby enabling the first folding system 170 and allowing the use of the first folding system 170 to move the bottom side 108 into the folding configuration.

The first folding system 170 of the luggage 100 shown in FIGS. 2A through 3B may provide a rigid or stiff bottom of the luggage 100 that may help support the contents of the luggage case 100 and the luggage case 100 itself when the luggage case 100 is in use. For example, the rigid bottom provided by the first folding system 170 may make the strength and durability of the bottom side 108 of the luggage case 100 similar to a luggage case with a bottom side made from a single sheet of rigid polypropylene, for example. Also, the rigid or stiff bottom may allow a user to position the luggage 100 in an upright position (such as that shown in FIG. 1A) without the contents of the luggage 100 bulging out of, or even penetrating or damaging, the bottom side 108 of the luggage 100. The rigid or stiff bottom may also facilitate distributing the weight of the luggage case 100 shown in FIGS. 1A through 2B on the one or more feet 117 and the wheels 114 without having an unstable or wobbly distribution of weight that may result if, for example, the bottom side 108 of the luggage 100 was made from soft, flexible fabric.

In addition to providing a relatively rigid or stiff bottom side 108 in luggage cases 100 incorporating the first folding system 170, the first folding system 170 may also allow the luggage case 100 to be at least partially folded when, for example, not in use, in order to take up less space than would be the case if the luggage case 100 was not folded. Folding the luggage 100 may also advantageously allow a distributor or supplier of luggage cases to use smaller packaging and may make it cheaper to ship the luggage cases to supplier stores. Furthermore, the first folding system 170 described herein may make it relatively easy for a user to fold and unfold the bottom side 108 of the luggage 100 by, for example, zipping or unzipping a zipper 176.

Although FIGS. 2A through 3B illustrate a luggage case 100 with the first folding system 170 on the bottom side 108 of a luggage case 100, a folding system may be located on other parts of a luggage case 100 in addition to or in place of a folding system 170 on the bottom side 108. For example, a first folding system may be located on the upper side 106 of the luggage 100, the left side 112 of the luggage 100, the right side 110 of the luggage 100, the rear side 104 of the luggage 100, the front side 102 of the luggage 100, and so forth. Furthermore, as explained below, the first folding system 170 may be included in a corner where two sides of a luggage case 100 meet, such as the corner or intersection between the bottom side 108 and the rear side 104 of the luggage 100. Also, any given side of a luggage case may include more than one first folding system 170, such as a luggage case that include one folding system in the middle of the bottom side 108, one folding system near the corner intersection where the bottom side 108 is coupled to the front side 102 of the luggage, and one folding system near the corner intersection where the bottom side 108 is coupled to the rear side 104 of the luggage. Having multiple first folding systems on a single side of a luggage case may in some embodiments allow the luggage case to be folded such that it is more flat.

Figure 4:
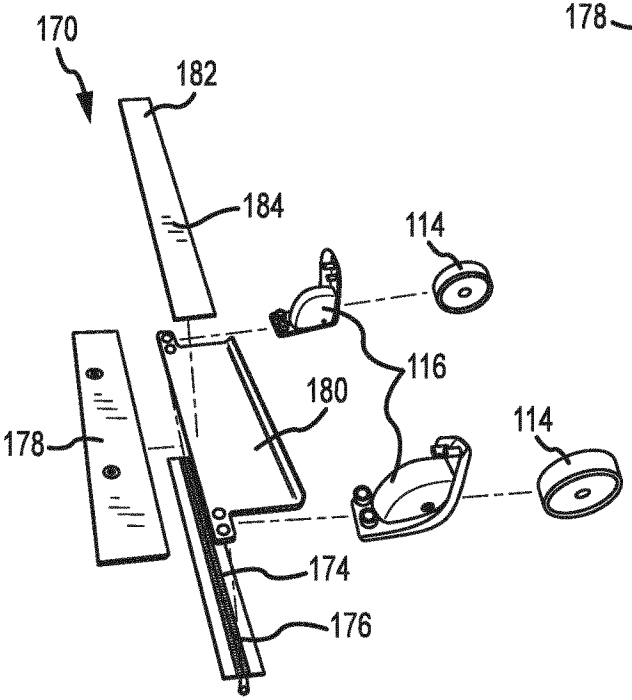
FIG. 4 shows an exploded perspective view of the structural components of an embodiment of a first folding system of the luggage case shown in FIG. 1A.

FIG. 4 shows an exploded perspective view of the structural components of an embodiment of the first folding system 170. The first folding system 170 may include a first panel 178 and a second panel 180 joined by a hinge 182. The first folding system 170 may also include the securing mechanism 174, such as a zipper 176. Also shown in FIG. 4 are two wheel housings 116 and two wheels 114, which may or may not form a part of the first folding system 170.

The first and second panels 178, 180 may be rigid polypropylene boards or sheets. The panels 178, 180 may also or alternatively be formed using acrylonitrile butadiene styrene (ABS), ethylene-vinyl acetate (EVA), any type of plastic, fabric, wood, metal, and/or any other type of suitable material. In some embodiments the first and second panels 178, 180 may be extruded, and the extrusion may have a rectangular cross-section. In embodiments with extruded first and/or second panels 178, 180, the cross-section of the extrusion may also be honeycomb, square, circular, or any other shape. Also, the length of the extrusion may run from the front side 102 of the luggage case 100 to the rear side 104, from the right side 110 of the luggage case 100 to the left side 112, from the bottom side 108 to the upper side 106, or in any other direction. In some embodiments, the first and/or second panels 178, 180 may include multiple layers of extrusion. Also, the first and second panels 178, 180 may not be formed with the same materials. For example, the first panel 178 may be extruded polypropylene, and the second panel 180 may be non-extruded metal.

The first and second panels 178, 180 may in some embodiments be lined with fabric, such as nylon, on either the outer surface of the panels 178, 180 (i.e., on the outside of the luggage case 100), on the inner surface of the panels 178, 180 (i.e., on the inside of the luggage case 100), or both. In embodiments with one or both of the surfaces of the first and/or second panels 178, 180 lined by fabric, the fabric may at least partially conceal the hinge 182, the securing mechanism 174 (such as a zipper 176) or any other part of the folding system 170, which may improve the aesthetic appeal of a luggage case 100 implementing a folding system 170. In some embodiments, however, neither the outer nor the inner surface of the first or second panel 178, 180 may be lined with fabric—such as in hard sided luggage cases.

In first folding systems 170 implemented on the bottom side 108 of a luggage case 100, either the first or the second panel 178, 180, both, or neither, may be coupled to one or more wheels 114 of the luggage case 100 (if any) through a wheel housing 116 or other connection mechanism. In the embodiment shown in FIG. 4, the second panel 180 is coupled to two wheels 114 through two rear wheel housings 116 located near the corner intersection between the rear side 104 and the bottom side 108 of the luggage case 100. In other embodiments, however, both the first and second panel 178, 180 may be coupled to one or more wheels 114 via a one or more wheel housings 116, which wheel housings 116 may in some instances be foldable, as described in more detail below. In still yet other embodiments, such as a non-wheeled duffel bag or case, or a handbag, neither the first nor the second panel 178, 180 may be coupled to any wheels 114. Also, folding systems located on the left, right, front, rear, or upper sides 104, 104, 106, 110, 112 of the luggage 100 may or may not be coupled to any wheels 114 or wheel housings 116. In these or other embodiments, however, either the first or the second panel 178, 180 may be coupled to some other structural element, such as a handle, lock, and so forth. For example, in some embodiments, both the upper side 106 and the lower side 108 of a luggage case 100 may include a first folding system 170, and one panel of the upper side's 106 first folding system 170 may be coupled to a telescoping or carry handle, while one panel of the bottom side's 108 first folding system 170 may be coupled to a set of wheels 114. In still other embodiments, however, the first and second panel 178, 180 may not be coupled to any of the structural elements described above.

The hinge 182 may couple the first panel 178 to the second panel 180, and may be made of, for example, flexible polypropylene. The hinge 182 may also or alternatively be made of other types of flexible material, such as rubber, nylon or other fabric, plastic, and so forth, including combinations of different kinds of materials. In some embodiments, such as a living hinge or other embodiments described herein, the hinge 182 may be made of the same material as the first and second panels 178, 180 of the first folding system 170 and/or may be integral to one or both of the first and second panels 178, 180.

Figure 5B:
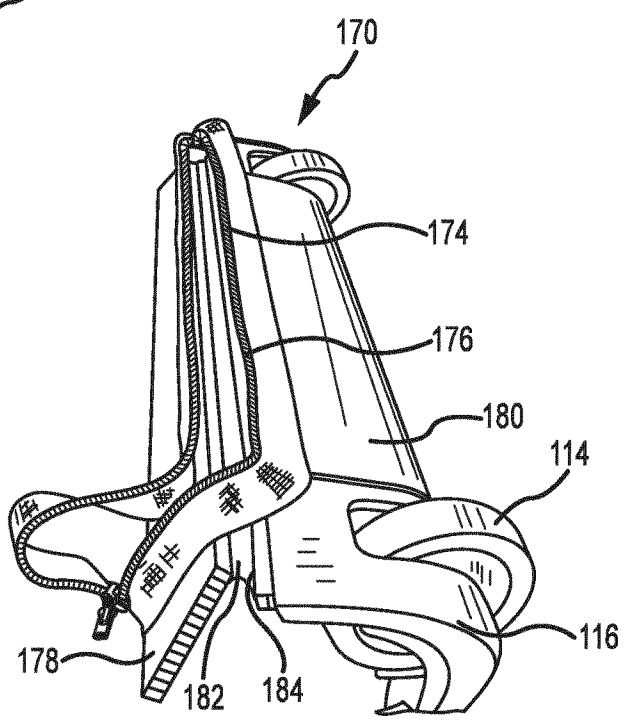
FIG. 5B shows a bottom perspective view of the assembled structural components shown in FIG. 5A with the first folding system folded.
Figure 5A:
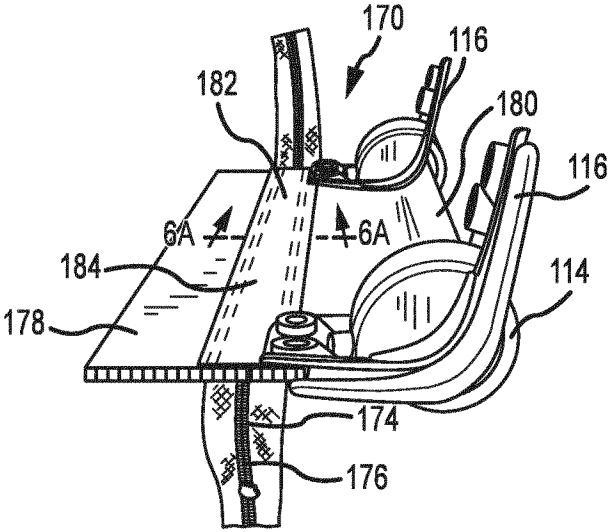
FIG. 5A shows a top perspective view of the structural components shown in FIG. 4 assembled with the first folding system locked in a not folded configuration.

The hinge 182 may couple one surface or face of the first panel 178 to one surface or face of the second panel 180. Referring to FIGS. 5A and 5B, the hinge 182 may be sewn to the inner surface (i.e. on the inside of the luggage case 100) of the first panel 178, and also sewn to the inner surface of the second panel 180, thus allowing the inner surfaces of the first and second panels 178, 180 to be brought into an approximately coplanar configuration with respect to one another when the hinge 182 is flat and not bent. In other embodiments, the hinge 182 may be glued or welded to each of the first and second panels 178, 180. Generally, the hinge 182 may be coupled to each of the first and second panels 178, 180 in any manner. The hinge 182 may be coupled to the first and second panels 178, 180 near the inner edges of the first and second panels 178, 180.

The hinge 182 may in some embodiments run approximately the width of the luggage case 100 (i.e. the distance from the right side 110 of the luggage case 100 to the left side 112 of the luggage case 100). In other embodiments, the hinge 182 may only run a portion of the width of the luggage case 100 (such as half of the width of the luggage case 100). In still other embodiments, the hinge 182 may include several small segments with, for example, a first portion of the hinge 182 near the left side 112 of the luggage case 100, a second portion of the hinge 182 near the right side 110 of the luggage case 100, and a third portion of the hinge 182 between the first and second portions. Generally, the hinge 182 may include any number of portions, and the portions may be any size.

With reference to the exploded view of FIG. 4, the hinge 182 may be coupled to the first and second panels 178, 180 at the inner surfaces of the first and second panels 178, 180 (i.e. on the inside of the luggage case 100), with the securing mechanism 174 selectively coupling the first and second panels 178, 180 together at the outer surfaces of the first and second panels 178, 180 (i.e. on the outside of the luggage case 100). In other embodiments, the hinge 182 may couple the outer surfaces, and the securing mechanism 174 may couple the inner surfaces. The hinge 182 may be internal or external to the luggage case 100. The first panel 178 may fold in towards the middle of the enclosed space or may fold out away from the middle of the enclosed space depending, respectively, on whether the hinge 182 couples the inner or outer surfaces of the first and second panels 178, 180.

In some embodiments, the hinge 182 may not be a separate component from the first and second panels 178, 180. In such embodiments, the hinge 182 may be a living hinge (not shown) that couples the first and second panels 178, 180 with the first panel 178, the living hinge, and the second panel 180 forming a single piece of material. In these embodiments, the hinge may have a smaller thickness than the first and second panels 178, 180, thus creating a point of weakness or a point of relative flexibility, which may allow the first and/or second panels 178, 180 to pivot relative to one another via the living hinge.

Still with reference to FIG. 4, at least a portion of the hinge 182 may be flexible and have a relatively low rigidity so that the hinge 182 can be folded or bent between open and closed (i.e. not folded and folded) configurations. The hinge 182 as a whole may in some embodiments, however, be strong enough that the connection between the first and second panels 178, 180 at the hinge 182 supports at least as much weight and other forces as the first and second panels 178, 180 do independently.

FIG. 4 also shows a securing mechanism 174 that may selectively couple a surface of the first panel 178 and a surface of the second panel 180 together, with the surfaces being opposite the surfaces coupled by the hinge 182. For example, if the hinge 182 couples the inner surfaces of the first and second panels 178, 180 together (i.e. on the inside of the luggage case 100) as in FIGS. 4 through 5B, the securing mechanism 174 may selectively couple the outer surfaces of the first and second panels 178, 180 together (i.e. on the outside of the luggage case 100). Similarly, if the hinge 182 couples the outer surfaces of the first and second panels 178, 180 together, the securing mechanism 174 may selectively couple the inner surfaces of the first and second panels 178, 180 together.

As illustrated in FIG. 4, the securing mechanism 174 may be a zipper 176, with one side of a zipper track coupled to the first panel 178, and a second side of the zipper track coupled to the second panel 180. Generally, the zipper tracks may be coupled to the first and second panels 178, 180 in any manner, such as by sewing, gluing, welding, buttons, and so forth. Alternatively or in addition to a zipper 176, the securing mechanism 174 may take any form, such as snaps, hook and loop fasteners, laces, buttons, and so forth. Also, the securing mechanism 174 may be constructed from any type of material, such as metal, plastic, wood, fabric, and so forth. For example, the zipper securing mechanism 174 shown in FIG. 2 may be metal in some embodiments, but in other embodiments may be plastic, or may include both plastic and metal components. In some examples, the securing mechanism 174 may be a locking mechanism 512 associated with foldable wheel housings 510, as described with reference to FIGS. 31 through 32B. In these examples, the securing mechanism 174 may not extend along the width of the luggage case 100 (as a zipper 176 might) but instead may be located at one or both of the left and right sides 110, 112 of the luggage case 100. In still other examples, the securing mechanism 174 may be a biased pin and hole or any suitable mechanism for securing the first and second panels 178, 180 in an open and/or closed configuration.

The securing mechanism 174 may in some embodiments run approximately the width of the luggage case 100 (i.e. the distance from the right side 110 of the luggage case 100 to the left side 112 of the luggage case 100). In other embodiments, the securing mechanism 174 may only run a portion of the width of the luggage case 100 (such as half of the width of the luggage case 100), or may run longer than the width of the case 100 (e.g., it may extend up the right and/or left sides 110, 112 of the luggage case 100). In still other embodiments, the securing mechanism 174 may include several small segments with, for example, a first portion of the securing mechanism 174 near the left side 112 of the luggage case 100, a second portion of the securing mechanism 174 near the right side 110 of the luggage case 100, and a third portion of the securing mechanism 174 between the first and second portions. Generally, the securing mechanism 174 may include any number of portions, and the portions may be any size. Also, generally speaking, the hinge 182 and the securing mechanism 174 may have different lengths and/or have a different number of portions of different sizes.

The securing mechanism 174 may function together with the hinge 182 to selectively lock the first and second panels 178, 180 into a not folded configuration. Using the example of a zipper type securing mechanism 174 for illustration, when the zipper 176 is zipped, the first and second panels 178, 180 may be locked together such that they cannot fold or bend relative to one another. The zipper 176 or other securing mechanism 174, together with the hinge 182, may selectively lock the first and second panels 178, 180 together by selectively bringing the first and second panels 178, 180 into a substantially coplanar orientation, with the first and second panels 178, 180 approximately adjacent to one another. In some embodiments, the zipper 176 or other securing mechanism 174 and the hinge 182 may bring the inner surface of the first panel 178 and the inner surface of the second panel 180 into a substantially coplanar orientation, and may also bring the outer surface of the first panel 178 and the outer surface of the second panel 180 into a substantially coplanar orientation. The zipper 176 or other securing mechanism 174 and hinge 182 may also bring an inner side wall of the first panel 178 so that it is substantially parallel with an inner side wall of the second panel 180, with the inner side wall of the first panel 178 being substantially adjacent the inner side wall of the second panel 180. The inner side wall of the first panel 178 may be spaced, for example, approximately 0 to 10 mm from the inner side wall of the second panel 180 when the securing mechanism 174 locks the first and second panels 178, 180 in a not folded configuration in some embodiments.

When the first and second panels 178, 180 are locked into a not folded configuration, the first and second panels 178, 180, together with the hinge 182 and the securing mechanism 174, may create a relatively rigid plane in, for example, the bottom side 108 of a luggage case 100, with the relatively rigid plane capable of supporting the contents of the luggage case 100. The combination of the zipper 176 and hinge 182 coupling the first and second panels 178, 180 together creates a stiff structure that resists bending of the first panel 178 relative to the second panel 180. The combination may resist bending of the first panel 178 relative to the second panel 180 because such bending, when the panels are locked into a not folded configuration, would put the zipper in lateral tension, in which direction it's strong.

The securing mechanism 174 may also function together with the hinge 182 to selectively unlock the first and second panels 178, 180 such that the first panel 178 is foldable with respect to the second panel 180. Again using the example of a zipper type securing mechanism 174, when the zipper 176 is unzipped, the first and second panels 178, 180 may not be locked together along at least one surface, but rather may be able to fold, bend, or otherwise be moved relative to one another. In some embodiments, although the hinge 182 may couple the inner surface of the first panel 178 to the inner surface of the second panel 180, the unzipped zipper 176 may not couple the outer surface of the first panel 178 with the outer surface of the second panel 180, and thus may not restrict the first and second panels 178, 180 from folding or bending relative to one another along the hinge 182 on the inner surfaces. This may allow the first and second panels 178, 180 to, for example, be folded such that they are not coplanar and so that the inner side wall of the first panel 178 is not adjacent or parallel to the inner side wall of the second panel 180.

When the first and second panels 178, 180 are not secured together by the securing mechanism 174, the first panel 178 may be folded relative to the second panel 180 along the hinge 182, thus allowing, for example, at least a portion of the luggage case 100 incorporating the folding system 170 to be folded.

Referring to FIG. 5A, the first panel 178 may be a substantially flat piece of extruded polypropylene, and the second panel 180 may be a piece of extruded polypropylene that is substantially flat except that it slightly curves on one side. Two wheel housings 116 may be coupled to the second panel 180. A wheel 114 may be coupled to each of the wheel housings 116 via an axle (not visible in FIG. 5A). The first and second panels 178, 180 may be coupled via a flexible, polypropylene hinge 182 that is sewn along the inner sides of the first and second panels 178, 180. The first and second panels 178, 180 may also be selectively coupled via a zipper securing mechanism 174 (most of which is not visible) on the outer or bottom side of the first and second panels 178, 180. In FIG. 5A, the zipper 176 is zipped, the first and second panels 178, 180 are locked in a not folded configuration, and the first and second panels 178, 180 are substantially coplanar with one another along both their inner and outer surfaces. Furthermore, the inner sidewalls of the first and second panels 178, 180 are substantially parallel to and adjacent one another. In the locked configuration, the components of the first folding system 170 may provide sufficient support for the bottom side 108 of a luggage case 100 during use of the luggage case 100.

With reference to FIG. 5B, the first and second panels 178, 180 of the first folding system 170 shown are still coupled to one another via the hinge 182 along the inner side of the first and second panels 178, 180. But, because the zipper securing mechanism 174 is unsecured (e.g., the zipper 176 is unzipped), the first and second panels 178, 180 may be pivoted along the hinge 182 with respect to one another. The first and second panels 178, 180 may be pivoted to be approximately perpendicular or normal with respect to one another while they still remain coupled to one another via the hinge 182. In the unlocked or foldable configuration, the first folding system 170 may allow for the bottom side 108 of a luggage case 100 to be folded.

With reference to FIGS. 5A through 6B, the hinge 182 may be coupled to the first and second panels 178, 180 along the length of the hinge 182 (which may or may not extend the length of the first and second panels 178, 180, as explained above) by, for example, stitching. The hinge 182 may also be coupled to the first and second panels 178, 180 by another suitable means, such as by gluing, sonic or thermal welding, and so forth. When the hinge 182 is coupled to the first and second panels 178, 180 by stitching, one or more respective lines of stitching 186 may couple the hinge 182 to the inner surfaces of the respective first and second panels 178, 180. With reference to FIG. 6A, in some cases, the stitching may extend all the way through the first or second panel 178, 180. In general, one, two, or more respective lines of stitching 186 may be used to couple the hinge 182 to the respective first and second panels 178, 180.

Also, the securing mechanism 174 may be coupled to the first and second panels 178, 180. For example, in the case of a zipper 176 as the securing mechanism 174, one side of the zipper tape may be secured to the bottom sheet of the first section of the hinge 182 along the length of the hinge 182 with one, two, or more lines of stitching 186, and the other side of the zipper tape may be secured to the bottom sheet of the second section of the hinge 182 along the length of the hinge 182 with one, two, or more lines of stitching 186. As with the hinge 182, when stitching is used, the stitching 186 may extend all the way through the respective first and second panels 178, 180. The zipper 176 may also be coupled to the hinge 182 by another suitable means, such as gluing, sonic welding, and so forth.

In some examples, the same stitching line or lines may be used to couple both the hinge 182 and the securing mechanism 174 such as a zipper 176 to the first and second panels 178, 180 (not shown). In other cases, and with reference to FIGS. 6A and 6B, the stitching lines used to couple the hinge 182 to the first and second panels 178, 180 may not couple the zipper 176 to the first and second panels 178, 180, and vice versa.

Also, with reference to FIGS. 5A and 5B, in some cases, the wheel housings 116 may be coupled to the second panel 180 by, for example, fasteners. In other cases, the wheel housings 116 may be coupled to the first panel 178, and/or, in some cases, coupled to the hinge 182. As described herein, the wheel housings 116 may define the hinge 182 in some examples.

Figure 6A:
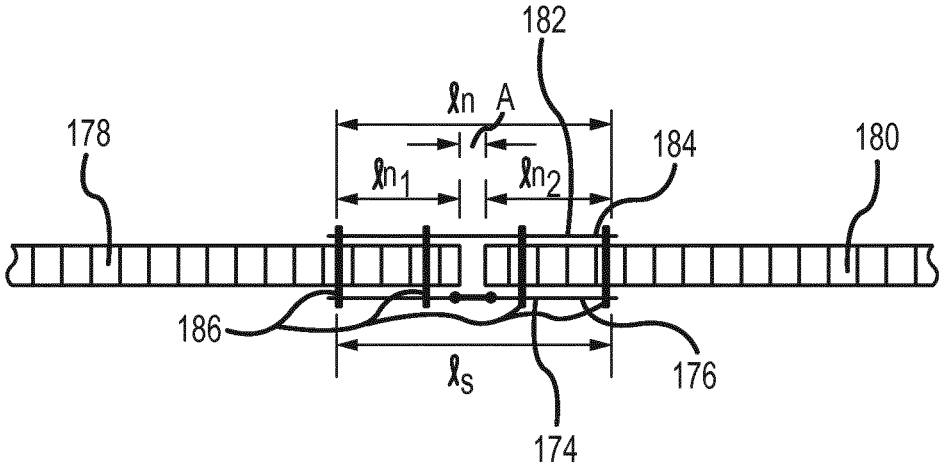
FIG. 6A shows a cross-section view of the assembled structural components shown in FIG. 5A, viewed along line 6A-6A in FIG. 5A.

FIG. 6A shows a cross-section view of the first folding system 170 of FIG. 5A, viewed along line 6-6 in FIG. 5A, with the first and second panels 178, 180 locked into a not folded configuration. The first folding system 170 may, in some embodiments, allow some flexibility in movement between the first and second panels 178, 180 even when the folding system 170 is locked by the securing mechanism 174. For example, the first and second panels 178, 180 may vary by negative ten to ten degrees from their approximately coplanar orientation when locked by the securing mechanism 174. In other embodiments, the first and second panels 178, 180 may be allowed to move between negative five and five degrees relative to each other, and in other embodiments they may not be allowed to move at all relative to each other. The flexibility may, for example, vary depending on a distance between the sidewall of the first panel 178 and the sidewall of the second panel 180 when locked together via the hinge 182 and securing mechanism 174. The flexibility may also, for example, vary depending on the rigidity of the hinge 182 and/or the securing mechanism 174, or also may vary based on other factors. The distance A between the sidewalls of the first and second panels 178, 180 may be anywhere from approximately 0 mm up to 10 mm or more, with greater distances generally allowing more flexibility and more variability from the coplanar orientation of the first and second panels 178, 180.

FIG. 6A also illustrates several lengths that may be used for the hinge 182 and the securing mechanism 174 in some embodiments. For illustrative purposes, the strap 184 (hinge 182) and zipper tracks (securing mechanism 174), both of which are sewn to the first and second panels 178, 180, will be discussed, although other types of hinges 182 and/or securing mechanisms 174 may be used. Also, the hinge 182 and/or the securing mechanism 174 may be coupled to the first and second panels 178, 180 in ways other than by sewing, etc.

With reference to FIG. 6A, a length $I_n$ represents the distance between the point at which the hinge 182 is sewn to the inner surface of the first panel 178 and the point at which the hinge 182 is sewn to the inner surface of the second panel 180. A length $I_{n1}$ represents the distance between the point at which the hinge 182 is sewn to the inner surface of the first panel 178 and the inner side wall of the first panel 178, and a length $I_{n2}$ represents the distance between the point at which the hinge 182 is sewn to the inner surface of the second panel 180 and the inner side wall of the second panel 180. A length $I_s$ represents the distance between the point at which a first zipper track is sewn to the outer surface of the first panel 178 and the point at which a second zipper track is sewn to the outer surface of the second panel 180 at the point. A length A represents the distance between the inner sidewall of the first panel 178 and the inner sidewall of the second panel 180, which may be measured along the hinge 182 in some embodiments (i.e. the distance between the sidewall proximate the inner surfaces of the first and second panels 178, 180), may be measured along the securing mechanism 174 (i.e. the distance between the sidewalls proximate the outer surfaces of the first and second panels 178, 180), or may be measured along some point between the inner and outer surfaces of the first and second panels 178, 180.

The length $I_s$ may in some embodiments be slightly shorter than the length $I_n$ in order to reduce the flexibility or play between the first and second panels 178, 180. In other embodiments, however the length $I_s$ may alternatively be slightly longer than the length $I_n$. Also, in some embodiments, the length $I_{n1}$ may be substantially similar to the length $I_{n2}$. In other embodiments, the lengths may be substantially different, which may create different forces on the first and second panels 178, 180. In general, the lengths and distances may be any value. In one example embodiment, the distance $I_n$ may be approximately 30 mm, the distance A approximately 5 mm, the distance $I_{n1}$ approximately 12.5 mm, the distance $I_{n2}$ approximately 12.5 mm, and the distance $I_s$ approximately 28.5 mm.

Figure 6B:
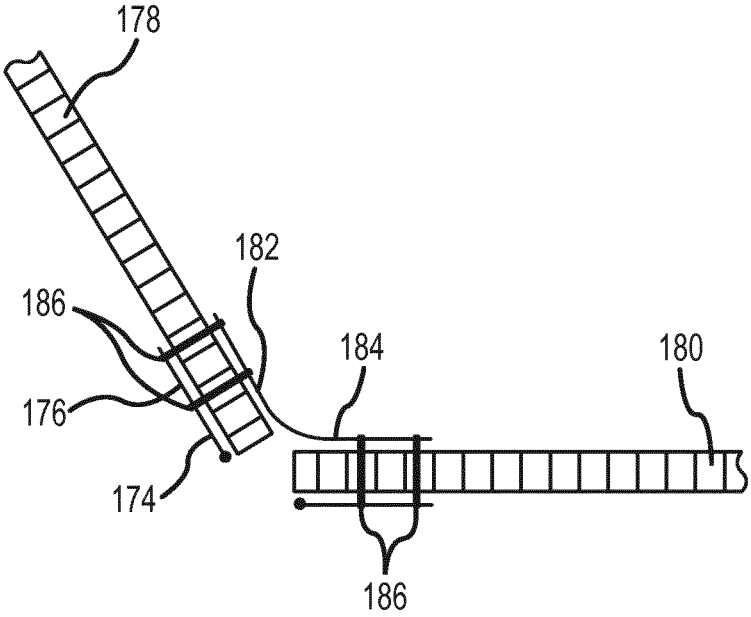
FIG. 6B shows a cross-section view of the assembled structural components that is similar to the cross-section view shown in FIG. 6A, except the first folding system is positioned in a folded configuration.

With reference to FIG. 6B, a cross-section view, similar to that of FIG. 6A, is shown, except that the folding system 170 is positioned in a folded configuration, with the first and second panels 178, 180 having been pivoted along the hinge strap 184 relative to one another. When the securing mechanism 174 is unsecured (e.g., with the zipper 176 unzipped), the first and second panels 178, 180 may be moved such that neither their inner nor their outer surfaces are in a coplanar orientation, and such that the inner side walls of the first and second panels 178, 180 are not parallel to or adjacent one another. With the securing mechanism 174 unsecured, the first and second panels 178, 180 may be moved 45 degrees, 90 degrees, or in some embodiments, 180 degrees or any other number of degrees relative to one another. Such movement may allow a side of a luggage case 100 incorporating the first folding system 170 to be folded.

Many variations on the first folding system 170 shown and described in the embodiments of FIGS. 1 through 6B are possible. For example, in folding systems 170 implemented on or near the corner intersections of a luggage case 100, such as the corner intersection where the bottom side 108 of a luggage case 100 is coupled to the rear side 104 of the luggage case 100, or the corner intersection where the bottom side 108 of a luggage case 100 is coupled to the front side 102 of the luggage case 100, the first and second panels 178, 180 may be located on different sides of the luggage 100. For example, the first panel 178 of the first folding system 170 may form the bottom side 108 of the luggage 100, and the second panel 180 of the folding system 170 may form the rear side 104 of the luggage 100. Furthermore in these embodiments, the lengths $I_n$, $I_s$, of the hinge 182 and the securing mechanism 174, respectively, may be modified so that instead of locking the first and second panels 178, 180 into a substantially coplanar configuration with respect to one another, the first and second panels 178, 180 may be locked in a substantially perpendicular or normal configuration relative to one another. As described above, in some examples, the securing mechanism 174 may not extend along the width of the luggage case 100, but may instead be positioned on one or both of the wheel housings 116. In these examples, the hinge 182 may be on one or both sides of the first and second panels 178, 180 (i.e., may be internal and/or external to the luggage case 100).

In general, by varying the lengths $I_n$, $I_s$, of the hinge 182 and the securing mechanism 174, respectively, as well as the lengths $I_{n1}$, $I_{n2}$, the first folding system 170 may be modified to lock the first and second panels 178, 180 into any desired configuration relative to one another. One example of a first folding system 170 implemented in the corner intersection between the bottom side 108 and the rear side 104 of a luggage case 100 is shown and described below in connection with FIGS. 21A through 21C. A few other embodiments of first folding system 170 in luggage cases 100 are shown and described below with reference to FIGS. 22 and 23. Many other embodiments of first folding systems 170 are also possible, including first folding systems 170 implemented in articles other than luggage cases 100. For example, plastic storage bins, camping and other outdoor gear, foldable tables or chairs, and any other type of article may include one or more first folding systems 170 as described herein.

Also, more than one first folding system 170 may be included in a luggage case 100. For example, a luggage case 100 may include three first folding systems 170 on the bottom side 108 of the luggage 100 and three first folding systems 170 on the upper side 106 of the luggage 100: one first folding system 170 in the middle of the bottom side 108, one first folding system 170 at the corner intersection between the bottom side 108 and the rear side 104, one first folding system 170 at the corner intersection between the bottom side 108 and the front side 102, one first folding system 170 in the middle of the upper side 106, one first folding system 170 at the corner intersection between the upper side 106 and the rear side 104, and one first folding system 170 at the corner intersection between the upper side 106 and the front side 102. Many other configurations of first folding systems 170 in a luggage case 100 or other case, container, etc. are also possible.

Figure 7:
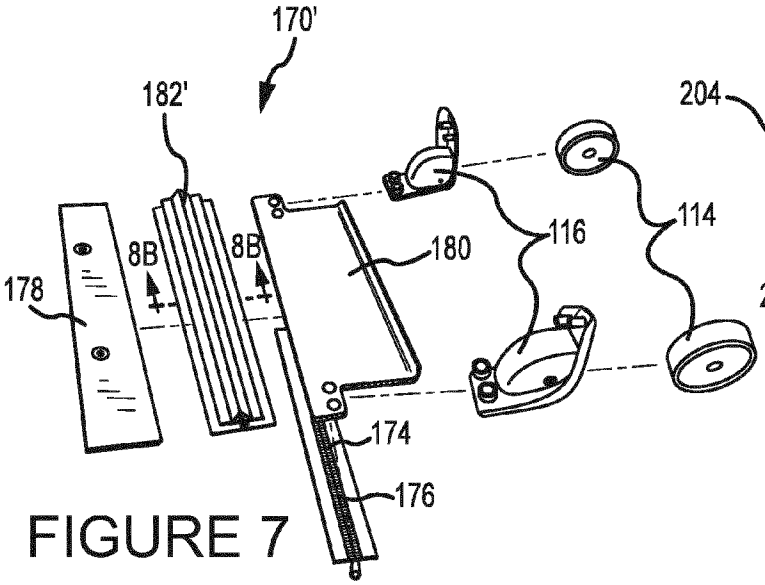
FIG. 7 shows an exploded perspective view of the structural components of a second embodiment of the first folding system of the luggage case shown in FIG. 1A.

FIG. 7 shows an exploded perspective view of the structural components of an embodiment of a first folding system 170' implemented on the bottom side 108 of a luggage case 100, such as that shown in FIG. 1A. The folding system 170' shown in FIG. 7 may be similar to the folding system 170 shown in FIG. 4 and described above in that the folding system 170' in FIG. 7 may include a first panel 178, a second panel 180, a hinge 182', and a securing mechanism 174. The hinge 182' of the folding system 170' shown in FIG. 7, however, may be different than the hinge 182 of the folding system 170 shown in FIG. 4, as described below in connection with FIGS. 8A and 8B. In general, a folding system may use a hinge similar to the hinge 182 shown in FIG. 4, the hinge 182' shown in FIG. 7, the hinge 182" shown in FIG. 11, or any other type of hinge. Also shown in the exploded perspective view in FIG. 7 are two wheel housings 116 and two wheels 114, which may or may not form a part of the first folding system 170'.

Figure 8A:
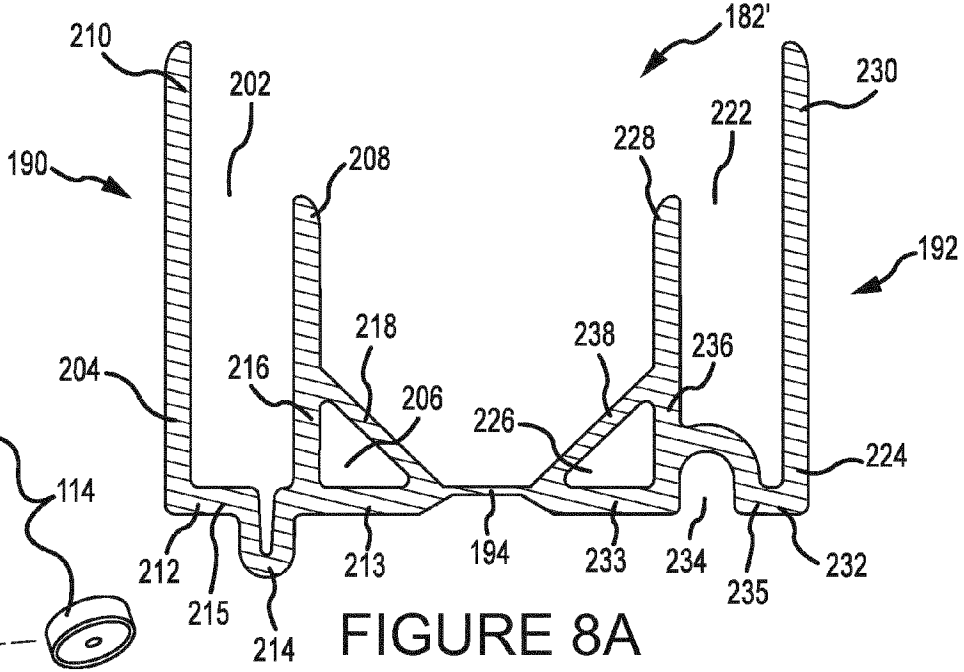
FIG. 8A shows a cross-section view of the hinge of the first folding system shown in FIG. 7, with the hinge in a folded configuration.

With reference to FIG. 8A, the hinge 182' may include a first section 190 and a second section 192, with the first section 190 of the hinge 182' configured to engage with the first panel 178 of the first folding system 170' and the second section 192 of the hinge 182' configured to engage with the second panel 180 of the first folding system 170'. The hinge 182' may also include a bridge 194 that couples the first section 190 of the hinge 182' to the second section 192 of the hinge 182'. In some embodiments, the cross-section of the hinge 182' may be extruded along the length of the hinge 182'. In other embodiments, the cross-section may simply be replicated at multiple areas along the length of the first and second panels 178, 180 of the first folding system 170'.

With continued reference to FIG. 8A, the first section 190 of the hinge 182' may include a receiving portion 202, an interlocking portion 204, and a supporting portion 206. The receiving portion 202 may include a top sheet 208 and a bottom sheet 210, with the top sheet 208 configured to engage at least a portion of the inner surface of the first panel 178 of the first folding system 170', and the bottom sheet 210 configured to engage at least a portion of the outer surface of the first panel 178. In some embodiments, the bottom sheet 210 may engage more of the outer surface of the first panel 178 than the top sheet 208 engages of the inner surface of the first panel 178; in other words, in some embodiments, the bottom sheet 210 may be wider than the top sheet 208. In general, the top and bottom sheets 208, 210 of the first section 190 of the hinge 182' may be coupled to the first panel 178 of the first folding system 170' in any manner, such as by sewing, gluing, welding, frictional forces, and so forth. In other embodiments, however, the hinge 182', including the top and bottom sheets 208, 210 of the first section 190, may be integrally formed with the first panel 178 and/or the second panel 180 of the first folding system 170'.

The interlocking portion 204 of the first section 190 of the hinge 182' may include a sidewall 212 coupling the top and bottom sheets 208, 210. The sidewall 212 may include a protruding flange 214. The protruding flange 214 may be configured to interlock with an opening 234 in the interconnecting portion 224 of the second section 192 of the hinge 182'. The protruding flange 214 may generally take a U-shaped form. The protruding flange 214, however, may take any other form, such as a V-shape, a W-shape, an M-shape, and so forth. A portion of the sidewall 212 of the interlocking portion 204 of the first section 190 of the hinge 182' may not protrude, but may be generally perpendicular to both the top sheet 208 and the bottom sheet 210. As shown in FIG. 8A, the thickness of the non-protruding sidewall 212 and/or the thickness of the protruding portion 214 may be similar to the thickness of the top sheet 208 and/or the bottom sheet 210 of the hinge 182', although in other embodiments, these thicknesses may vary. Also, in some embodiments (not shown), the interlocking portion 204 may not include a protruding flange 214, but may, for example, include only a non-protruding sidewall 212 perpendicular to the top and bottom sheets 208, 210.

The supporting portion 206 of the first section 190 of the hinge 182' may be coupled to the upper or inner surface of the top sheet 208, and may include a triangle-type structure in some embodiments. In other embodiments, the supporting structure 206 may include a squarer or circular-type structure or any other supporting structure. In still other embodiments, the supporting structure 206 may include a flat, strap-type structure. The supporting portion 206 of the first section 190 of the hinge 182' may, in conjunction with a supporting portion 226 of the second section 192 of the hinge 182', provide reinforcement of the hinge 182'. The triangle-type supporting portion 206, however, may include a side portion 213 that is parallel and co-planar with at least a portion of the interlocking portion 204 (e.g. the sidewall portion 215 that does not protrude). The triangle-type supporting portion 206 may also include a base 216 along the top sheet 208 of the first section 190 of the hinge 182, and in some embodiments, the base 216 may be the top sheet 208. The triangle-type supporting portion 206 may also include a hypotenuse 218 that couples the side portion 213 and the base 216 of the triangle-type supporting portion 206.

In general, the receiving portion 202, the supporting portion 206, and the interlocking portion 204 of the first section 190 of the hinge 182' (along with the corresponding portions of the second section 192 of the hinge 182') may be made of any type of material or multiple types of materials. For example, the receiving portion 202, 222, the supporting portion 206, 226, and the interlocking portion 204, 224 may be extruded as a single piece of plastic, or, as another example, the receiving portion 202, 222 and the interlocking portion 204, 224 may be made from plastic, with the supporting portion 206, 226 made from metal.

At least a portion of the second section 192 of the hinge 182' may generally complement the first section 190 of the hinge 182'. For example, referring to FIG. 8A, the second section 192 of the hinge 182' also includes an interlocking portion 224 that is configured to receive the protrusion(s) of the first section 190. The interlocking portion 224 of the second section 192 may be joined to a receiving portion 222 of the second section 192. The receiving portion 222 of the second section 192 of the hinge 182' may include top and bottom sheets 228, 230 that may be configured to engage the second panel 180 of the first folding system 170'. The interlocking portion 224 of the second section 192 of the hinge 182 may include a sidewall 232 coupling the top and bottom sheets 228, 230. The sidewall 232 may include a receptacle 234 for engaging the protruding flange 214 of the first section 190 of the hinge 182'. The receptacle 234 may generally be shaped to receive the protruding flange 214 (if any) of the first section 190 of the hinge 182'. Also, as with the interlocking portion 204 of the first section 190 of the hinge 182', the interlocking portion 224 of the second section 192 of the hinge 182' may include a portion of the sidewall that does not protrude and is not recessed within the sidewall 232, but is instead generally perpendicular to both the top sheet 228 and bottom sheet 230 of the second section 192 of the hinge 182'. The supporting portion 226 of the second section 192 of the hinge 182' may be similar to the supporting portion 206 of the first section 190 of the hinge 182'. As with the first section 190 of the hinge 182', the second section 192 of the hinge 182' may be made of any suitable type of material, and its various components may have any thickness, including some portions that have the same thickness and other that have different thicknesses in some embodiments.

The bridge 194 of the hinge 182' may couple the first section 190 and the second section 192 of the hinge 182'. The bridge 194 may be flexible and have a relatively low rigidity so that the hinge 182' can be folded or bent between open and closed (i.e. not folded and folded) configurations. The first section 190 of the hinge 182', the bridge 194, and the second section 192 of the hinge 182' may be formed from a single piece of material. In other embodiments, the hinge 182' may include two or more distinct components (including, in some embodiments, components made of different types of materials) that are coupled to one another in order to form the hinge 182'. In embodiments where the first section 190 of the hinge 182', the bridge 194, and the second section 192 of the hinge 182' are a single piece of material, the thickness of the bridge 194 may be less than the thickness of any of the parts of the first and second sections 190, 192 of the hinge 182' in order to allow the bridge 194 to bend or flex.

Figure 8B:
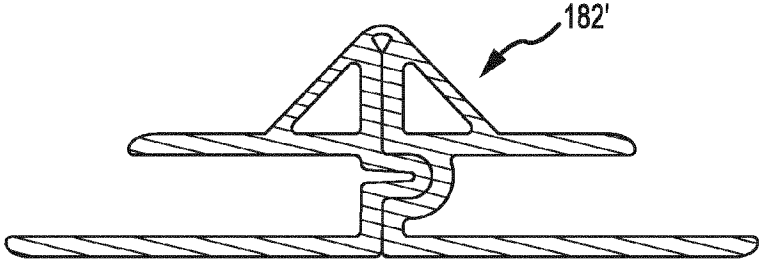
FIG. 8B shows a cross-section view of the hinge of FIG. 7, with the hinge in an unfolded configuration.

Turning to FIG. 8B, the protruding flange 214 of the first section 190 of the hinge 182' may be received into the receptacle 234 of the second section 192 of the hinge 182', and the non-protruding portion of the sidewall 215 of the first section 190 of the hinge 182' may abut the non-protruding portion of the sidewall 235 of the second section 192 of the hinge 182'. Also, the side portions 213, 233 of the supporting portions 206, 226 of the first and second sections 190, 192 of the hinge 182' may abut or approximately abut one another when the hinge 182' is in the not folded configuration. Abutting the side portions 213, 233 of the respective supporting portions 206, 226 of the first and second sections 190, 192 of the hinge 182' may strengthen the hinge 182' in some embodiments.

Also, when the hinge 182' is in the not folded configuration, the top sheet 208 of the first section 190 of the hinge 182' may be brought into a substantially co-planar configuration with respect to the top sheet 228 of the second section 192 of the hinge 182', and the bottom sheet 210 of the first section 190 of the hinge 182' may be brought into a substantially co-planar orientation with respect to the bottom sheet 230 of the second section 192 of the hinge 182'. In this manner, the hinge 182', when in the not folded configuration may bias the inner and outer surfaces of the first and second panels 178, 180 of the first folding system 170' to be in a substantially co-planar orientation with respect to each other, and may bias the first and second panels 178, 180 of the first folding system 170' such that the sidewalls of the first and second panels 178, 180 are substantially parallel to and adjacent one another.

Figure 9:
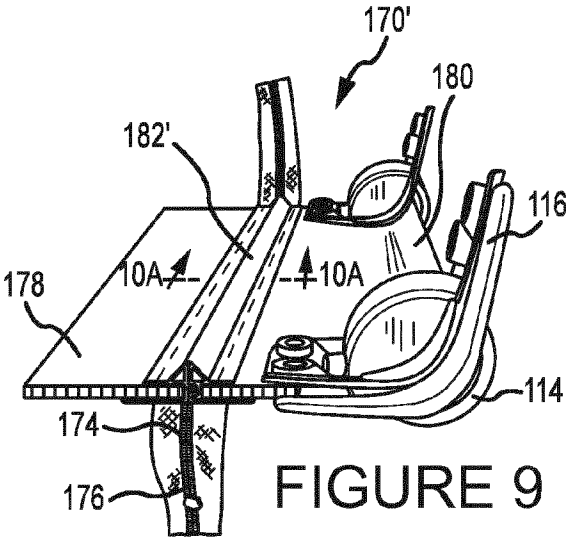
FIG. 9 shows a top perspective view of the structural components shown in FIG. 7 with the first folding system locked in a not folded configuration.

FIG. 9 shows a top perspective view of the structural components shown in FIG. 7 assembled with the first folding system 170' locked in a not folded configuration. Generally, the structural components shown in FIG. 9 are similar to the structural components shown in FIG. 5A, except that the hinge is different. FIG. 9 shows that the first and second panels 178, 180 are coupled via the hinge 182' described above in connection with FIGS. 7 through 8B. In FIG. 9, the first and second panels 178, 180 are also selectively coupled via a zipper securing mechanism 174 (most of which is not visible) on the outer or bottom side of the first and second panels 178, 180.

In general, the operation of the first folding system 170' illustrated in FIG. 9 is similar to the first folding system 170 illustrated in 5A and 5B. In FIG. 9, the zipper 176 is zipped, and so the first and second panels 178, 180 are locked in a not folded configuration and they are substantially coplanar with one another. Furthermore, the inner sidewalls of the first and second panels 178, 180 are substantially parallel to and adjacent one another, with the distance between the inner sidewalls of the first and second panels 178, 180 generally a function of the thickness of the sidewalls and protruding portion of the sidewalls of the hinge 182'. In the locked not folded configuration, the first folding system 170' may provide sufficient support for the bottom side 108 of a luggage case 100 during use of the luggage case 100. Although not shown in the figures, the first folding system 170' of FIG. 9 may be folded unlocked and folded along the hinge 182', similar to how the first folding system 170 of FIG. 5A is unlocked and the bottom side 108 of the luggage case 100 folded in FIG. 5B.

Figure 10A:
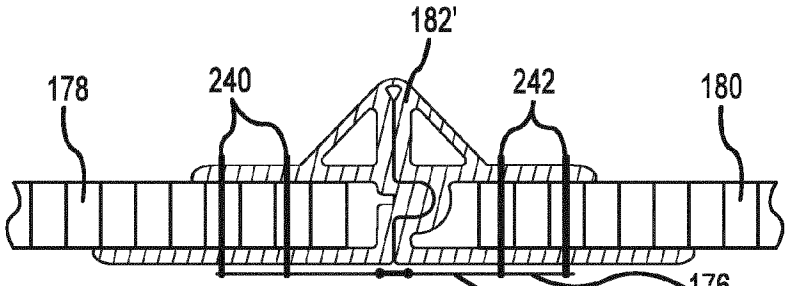
FIG. 10A shows a cross-section view of the assembled structural components shown in FIG. 9, viewed along line 10A-10A in FIG. 9.
Figure 10B:
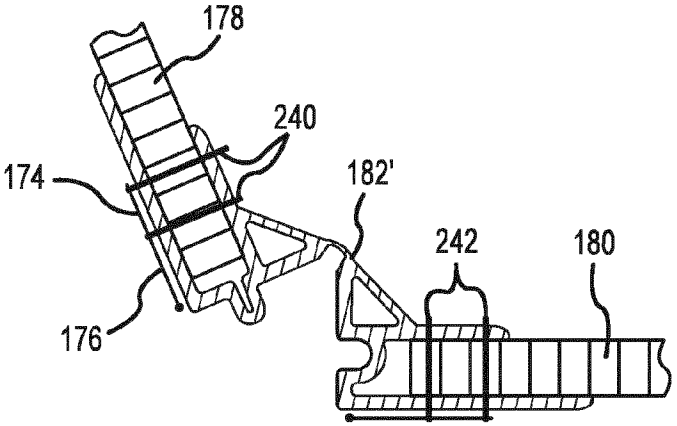
FIG. 10B shows a cross-section view of the assembled structural components that is similar to the cross-section view shown in FIG. 10 A, except the first folding system is positioned in a folded configuration.
Figure 14B:
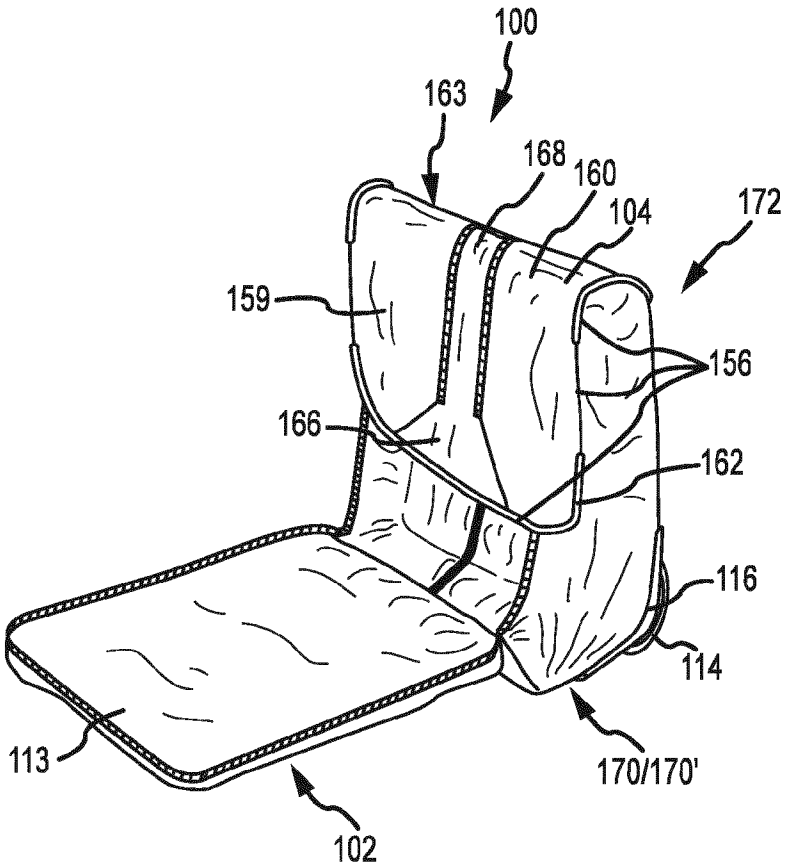
FIG. 14B shows a front perspective view of the luggage case shown in FIG. 1A, with an upper portion of the rear side of the luggage case folded over a lower portion of the rear side.
Figure 14A:
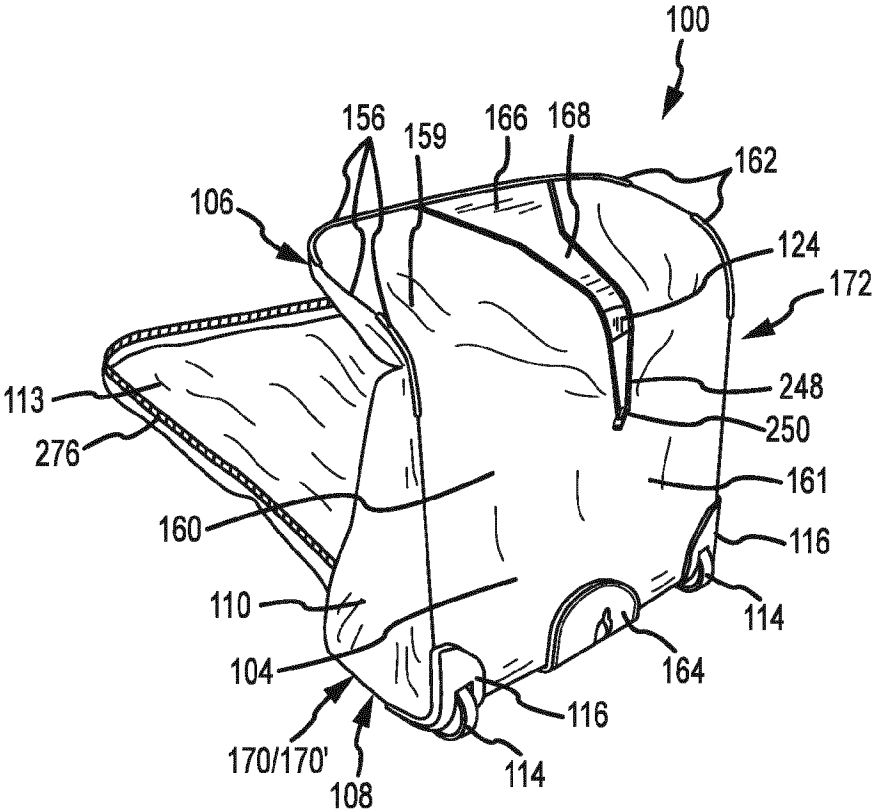
FIG. 14A shows a rear perspective view of a foldable luggage case with a first folding system and a second folding system, with the telescoping handle at a low position, and the rear side of the luggage case partially folded.

With reference to FIGS. 9 through 10B, the hinge 182' may be coupled to the first and second panels 178, 180 along the length of the hinge 182' (which may or may not extend the length of the first and second panels 178, 180, as explained above) by, for example, stitching. The hinge 182' may also be coupled to the first and second panels 178, 180 by another suitable means, such as by gluing, sonic or thermal welding, and so forth. When the hinge 182' is coupled to the first and second panels 178, 180 by stitching, one or more respective lines of stitching 240, 242 may couple the hinge 182' to the respective first and second panels 178, 180. In general, one, two, or more respective lines of stitching 240, 242 may be used to couple the hinge 182' to the respective first and second panels 178, 180.

Also, the securing mechanism 174 may be coupled to the hinge 182' along the length of the first and second panels 178, 180, or may alternatively be coupled directly to at least a portion of the first and second panels 178, 180. For example, in cases where the hinge 182' does not extend the full length of the first and second panels 178, 180, the securing mechanism 174 may be coupled to the hinge 182' along the length of the hinge 182' and may be coupled to the first and second panels 178, 180 along the length of those panels where the hinge 182' does not extend. In still other cases, the securing mechanism 174 may be coupled to the first and second panels 178, 180 along the entire length of the first and second panels 178, 180.

For example, in the case of a zipper 176 as the securing mechanism 174, one side of the zipper tape may be secured to the bottom sheet 210 of the first section 190 of the hinge 182' along the length of the hinge 182', and the other side of the zipper tape may be secured to the bottom sheet 230 of the second section 192 of the hinge 182' along the length of the hinge 182'. The zipper 176 may be coupled to the hinge 182' by stitching, gluing, sonic welding, and so forth. In examples where the zipper 176 is coupled to the hinge 182' by one or more lines of stitching, and with reference to FIGS. 10A and 10B, the one or more lines of stitching may be the same as the one or more lines of stitching 240, 242 coupling the hinge 182' to the first and second panels 178, 180.

Also, in some cases, the wheel housings 116 may be coupled to the second panel 180 by, for example, fasteners. In other cases, the wheel housings 116 may be coupled to the first panel 178, and may, in some cases, be coupled to the hinge 182'.

Referring to FIG. 10A, a portion of the first panel 178 of the first folding system 170' may be received into the receiving portion 202 of the first section 190 of the hinge 182', and a portion of the second panel 180 may be received into the receiving portion 222 of the second section 192 of the hinge 182'. A securing mechanism 174, such as a zipper 176, may be coupled to the first and second panels 178, 180 through the bottom sheets 208, 210, 228, 230 of the first and second sections 190, 192 of the hinge 182'. With reference to FIG. 10B, the first and second panels 178, 180 of the first folding system 170' may be pivoted relative to one another along the bridge portion 194 of the hinge 182' when the securing mechanism 174 is positioned in its unsecured configuration.

Figure 11:
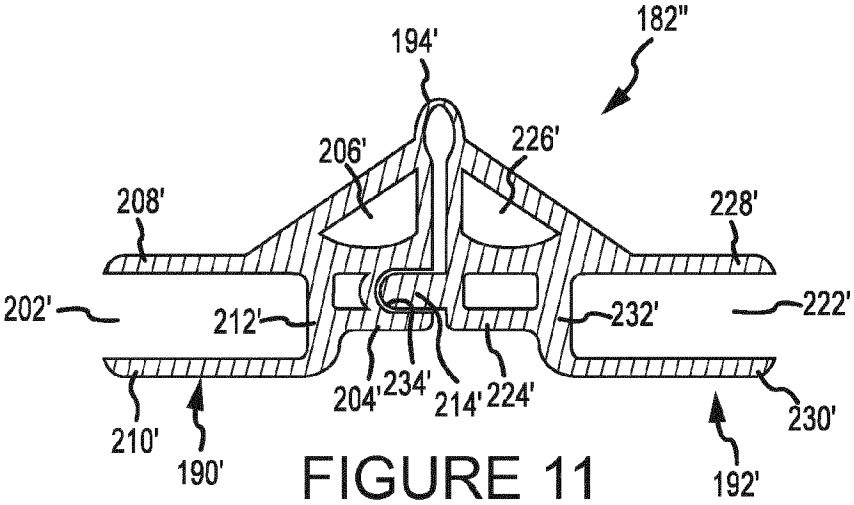
FIG. 11 shows a cross-section view of a third embodiment of a hinge for a first folding system, with the hinge in a not folded configuration.

FIG. 11 shows a cross-section view of another embodiment of a hinge 182" for a first folding system. Similar to the embodiments of a hinge 182' for a first folding system 170' shown in FIGS. 7 through 10B, the hinge 182" shown in FIG. 11 may include a first section 190', a second section 192', and a bridge 194'. The first section 190' and second section 192' of the third embodiment of the hinge 182" may include respective receiving portions 202', 222' with respective top and bottom sheets 208', 210', 228', 230'. The first and second sections 190', 192' of the third embodiment of the hinge 182" may also include respective supporting portions 206', 226', similar to the triangle shaped supporting portions 206, 226 of the second embodiment of the hinge 182'. The hinge 182" shown in FIG. 11 may, however, be different than the hinge 182' shown in FIGS. 7 through 10B in that the interlocking portions 204' 224' of the first and second sections 190', 192' of the hinge 182" as the bridge portion 194' of the hinge 182" shown in FIG. 11 may be different. The interlocking portions 204', 224' of the first and second sections 190', 192' of the hinge 182" shown in FIG. 11 may each, for example, include a sidewall 212', 232' connecting the top and bottom sheets 208', 210', 228', 230' of the receiving portion 202', 222', and may include a different type of protruding flange 214' and receptacle 234'. Also, the bridge portion 194' of the hinge 182" shown in FIG. 11 may be different in that it may extend up above the supporting portions 206', 226' of the first and second sections 190', 192' of the hinge 182" when the hinge 182" is in a not folded configuration.

Several embodiments of hinges 182, 182', 182" for use in a first folding system 170, 170' have been described, including the strap-type hinge 182 of FIGS. 4 through 6B, the hinge 182' shown in FIGS. 7 through 10B, and the hinge 182" shown in FIG. 11. In general, the hinges 182', 182" of FIGS. 7 through 11 may be stronger and provide more support than the hinge 182 of FIGS. 4 through 6B. The hinge 182 of FIGS. 4 through 6B may, however, be cheaper to manufacture and easier to implement. Accordingly, any of these types of hinges 182, 182', 182" may be used in a first folding system 170, 170'. Furthermore, other embodiments of hinges may be used for a first folding system 170, 170' other than those shown and described above.

Referring to FIG. 12, the luggage case 100 may include a second folding system 172. The second folding system 172 may include one or more rigid or semi-rigid panels 158 in at least a lower portion 161 of the rear side 104 of the luggage case 100 (and/or one or more rigid or semi-rigid panels 158 in the upper portion 159 of the rear side 104 of the luggage case 100), one or more portions of flexible fabric 246 in at least a middle or upper portion 159 of the rear side 104 of the luggage case 100, and piping 156 along the edges of at least a portion of the rear side 104 of the luggage case 100. Some examples of a second folding system 172 may also include a jacket 160 or other covering for the multi-stage telescoping handle 124.

In some embodiments, the rear side 104 of the luggage case 100 may be folded by positioning the telescoping handle 124 to a middle position that is less than the height of the luggage case 100 (as shown in FIG. 12), unsecuring the jacket securing mechanism 248 (e.g., unzipping a zipper 250), positioning the telescoping handle 124 further to a retracted position, and folding an upper portion 159 of the rear side 104 of the luggage case 100 (which may be made of flexible fabric 246) towards the front and bottom sides 102, 108 of the luggage 100 such that the point of rotation of the upper portion 159 that is being folding is above the top of the telescoping handle 124 when in a retracted position. In other examples, the upper portion 159 of the rear side 104 of the luggage case 100 may be folded in the other direction, specifically towards the rear bottom side of the luggage case 100 along the rear panel 104.

The lower portion 161 of the rear side 104 of the luggage case 100 may include a rigid or semi-rigid panel 158 (such as a polypropylene board), to which the lowest stage of a multi-stage telescoping handle 124 is coupled. The upper portion 159 of the rear side 104 of the luggage case 100 may include a flexible fabric 246 such as nylon. The flexible fabric 246 may extend down over the rigid or semi-rigid panel 158 of the lower portion 161. The rear side 104 of the luggage case 100 may also include a jacket 160 enclosing at least a portion of the multi-stage telescoping handle 124. In some embodiments, the jacket 160 may extend from the bottom of the rear side 104 all the way up to the top. The jacket 160 may include a zippered slit 168 and may define in combination with the main body of the luggage case 100 a handle opening 166. Also, the upper, left, and right edges of the rear side 104 of the luggage case 100 may be framed with piping 156 in order to frame the flexible fabric 246 of the upper portion 159 and to couple the upper and lower portions 159, 161 of the rear side 104 of the luggage case 100. The piping 156 may, however, be weakened, include some type of joint 252, or a portion of the piping 156 may be removed at some portions along the perimeter of the rear side 104 of the luggage case 100 in order to allow the upper portion 159 of the luggage case 100 to fold.

In other embodiments (not shown), the upper portion 159 of the rear side 104 may include a rigid or semi-rigid panel, which may be kept in place by being secured to the fabric 246 and/or to the piping 156 or by being secured (e.g., glued) within an interior pocket of the luggage case 100. Having a rigid or semi-rigid panel in the upper portion 159 of the rear side 104 may provide further support for the rear side 104 of the luggage case 100. Also, additional rigid or semi-rigid panels may be used, each panel effectively defining a section of the rear side 104 of the luggage case 100, each section being foldable. In embodiments with two or more rigid or semi-rigid panels, a gap or space may be present between each of the panels in order to allow the luggage case 100 to fold. The upper portion 159 of the luggage case 100 may fold forwards or backwards.

Also, although FIG. 12 illustrates a luggage case 100 with the second folding system 172 found on a rear side 104 of the luggage case 100, similar second folding systems may be included on one or more other sides of the luggage case 100 (e.g., front, left, right, etc.) with appropriate modifications. For example, the front side 102 of a luggage case 100 may include a second folding system 172 in that the front side 102 may include a lower portion with a rigid or semi-rigid panel, an upper portion with flexible fabric, and piping around the perimeter of the front side 102 of the luggage case 100.

Turning to FIG. 13A, the lower portion 161 of the rear side 104 of the luggage case 100 may include a rigid or semi-rigid panel 158 to which a portion of a multi-stage telescoping handle 124 may be coupled. The bottom of each tube of the telescoping handle 124 (e.g., the bottom of lowest stage's receiving tubes 148, 150) may be coupled to the rigid or semi-rigid panel 158 by one or more respective brackets 152, 154. The brackets 152, 154 may secure the respective tubes of the telescoping handle 124 to the rigid or semi-rigid panel 158 in any suitable manner, such as by one or more fasteners, glue, welding, etc. In some embodiments, the brackets 152, 154 may also be coupled to the kick plate 164 on the other side of the polypropylene board (by, e.g., fasteners, etc.), thereby wedging the polypropylene board between the brackets 152, 154 and the kick plate 164. Also, in addition to or in place of the brackets 152, 154 being coupled to the rigid or semi-rigid panel 158 that forms part of the lower portion 161 of the rear side 104 of the luggage case 100, the brackets 152, 154 may in some embodiments be coupled to the bottom side 108 of the luggage case 100 by any suitable means.

Additional brackets or other securing mechanisms may be used to further secure the multi-stage telescoping handle 124 to the luggage case 100. For example, with continued reference to FIG. 13A, in addition to the bracket 152, 154 coupling the bottom of each tube of the multi-stage telescoping handle 124 to the rigid or semi-rigid panel 158, the multi-stage telescoping handle 124 may be coupled to the rigid or semi-rigid panel 158 near the top of the panel 158. However, because there is no kick plate 164 or other structure on the other side of the rigid or semi-rigid panel 158 at this location, a mounting plate 254 may be used. For example, a connector 256 may connect two receiving tubes of the telescoping handle 124 and such connector 256 may be secured to the mounting plate 254 by any suitable means. In some embodiments, such as when a bolt or other fastener couples the connector 256 to the mounting plate 254, the bolt or other fastener may also serve to couple the connector 256 to the rigid or semi-rigid panel 158, thereby wedging the mounting plate 254 between the connector 256 and the rigid or semi-rigid panel 158. In some embodiments, a padded cover 258 may cover the connector 256 and any fasteners that may couple the connector 256 to the mounting plate 254 and/or to the rigid or semi-rigid panel 158. The padded cover 258 may be releasable by hook-and-loop fasteners, and may help prevent a user from injuring his or her hands when using the luggage case 100. The mounting plate 254 in the lower portion of the rear side 104 of the luggage place may further be coupled to the rigid or semi-rigid panel 158 by any suitable means in other locations instead of or in addition to the coupling at the connector 256.

With reference to FIG. 13B, in addition to having a padded cover 258 covering the connector 256 in order to prevent injury to a user, the rigid or semi-rigid panel 158 forming part of the lower portion 159 of the rear side 104 of the luggage case 100 may be cut-away near the connector 256 and/or near receiving tubes 148, 150 for the lowest stage of the multi-stage telescoping handle 124 in order to allow a user to collapse the multi-stage telescoping handle 124 into a fully retracted position without hitting his or her hand up against the rigid or semi-rigid panel 158.

While not necessarily part of a second folding system 172, two wheel housings 116 may in some embodiments help couple the rear side 104 of the luggage case 100 to the bottom side 108 of the luggage case 100 (which may in some embodiments include a first folding system 170, 170' in the middle of the bottom side 108 or at the corner intersection between the bottom and rear sides 104, 108 of the luggage case 100). The wheel housings 116 may be foldable (as described below in connection with FIGS. 19A through 21C) or may not be foldable, and may be for fixed-direction wheels, spinner wheels, etc.

Figure 16:
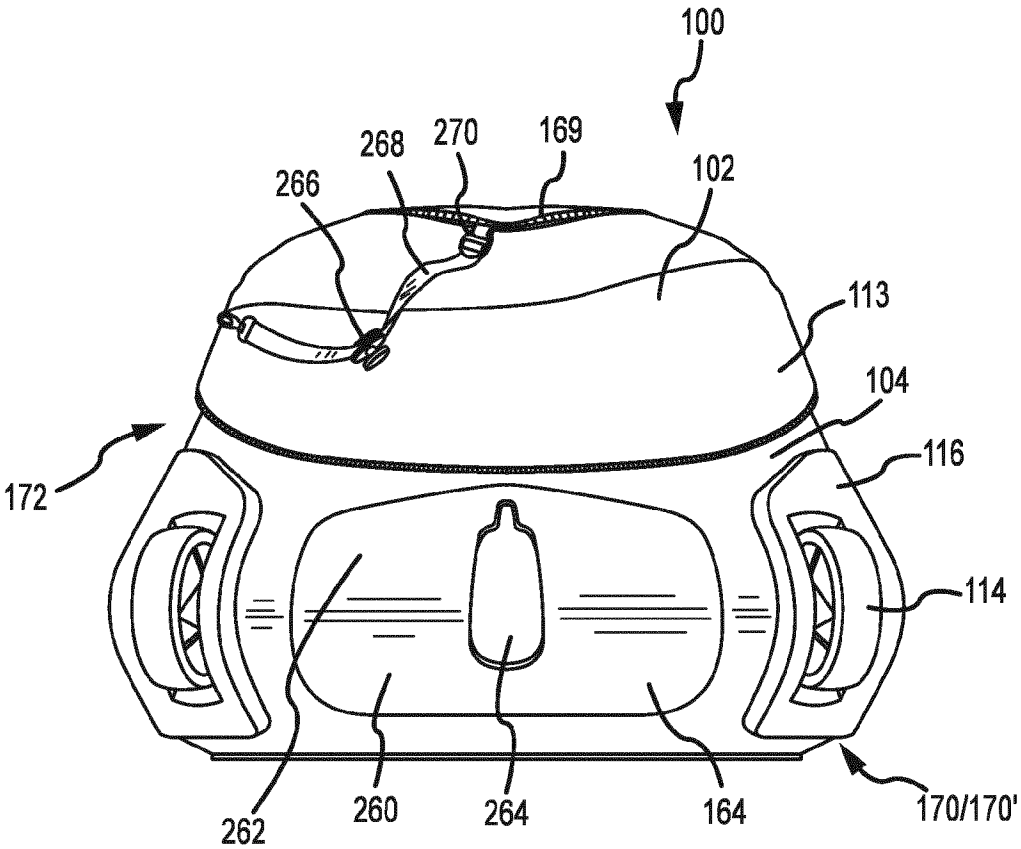
FIG. 16 shows a bottom perspective view of the luggage case shown in FIG. 1A, with the front flap folded over the folded rear side of the luggage case.
Figure 15:
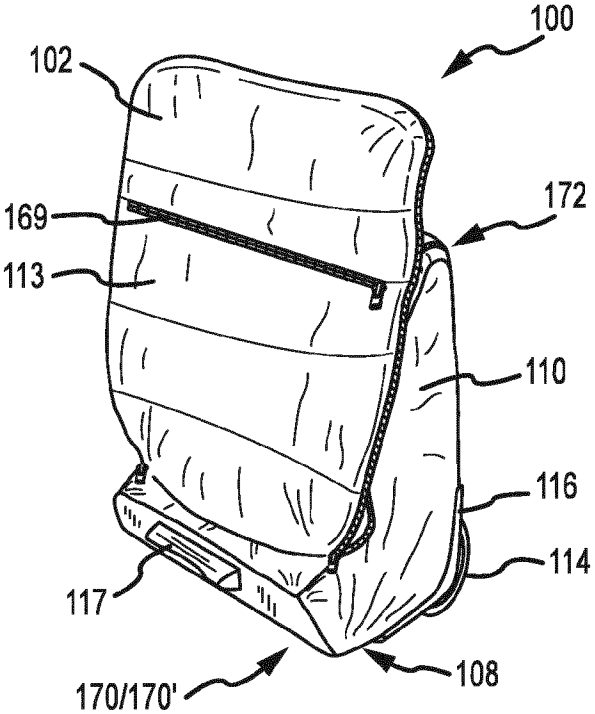
FIG. 15 shows a front perspective view of the luggage case shown in FIG. 1A, with the first folding system folded and the front flap lifted up.

Referring to FIG. 16, the kick plate 164 may include a linear portion 260 extending along the bottom side 108 of the luggage case 100 and a linear portion 262 extending along the rear side 104 of the luggage case 100. The kick plate 164 may also include a channel 264 that extends from the bottom side 108 towards the top side along the rear side 104 of the luggage case 100. The channel 264 may narrow as it extends up the rear side 104 of the luggage case 100 and may be configured to receive a disk-type connector 266 on a strap 268. The strap 268 may be stored in the front pocket 169 of the luggage case 100 when not in use, and may be coupled to the front pocket 169 and/or the front side 102 of the luggage case 100. The length of the strap 268 (and consequently the distance from the front pocket 169 of the disk-shaped connector 266) may be variable by an adjustment mechanism 270. When it is desired to lock the luggage case 100 in a double folded configuration, the strap 268 with the connector 266 may be removed from the front pocket 169, and the disk-shaped connector 266 may be slid through the channel 264 on the kick plate 164. In other examples, a securing strap may be located elsewhere, as described for example with reference to FIG. 18A.

Figure 17B:
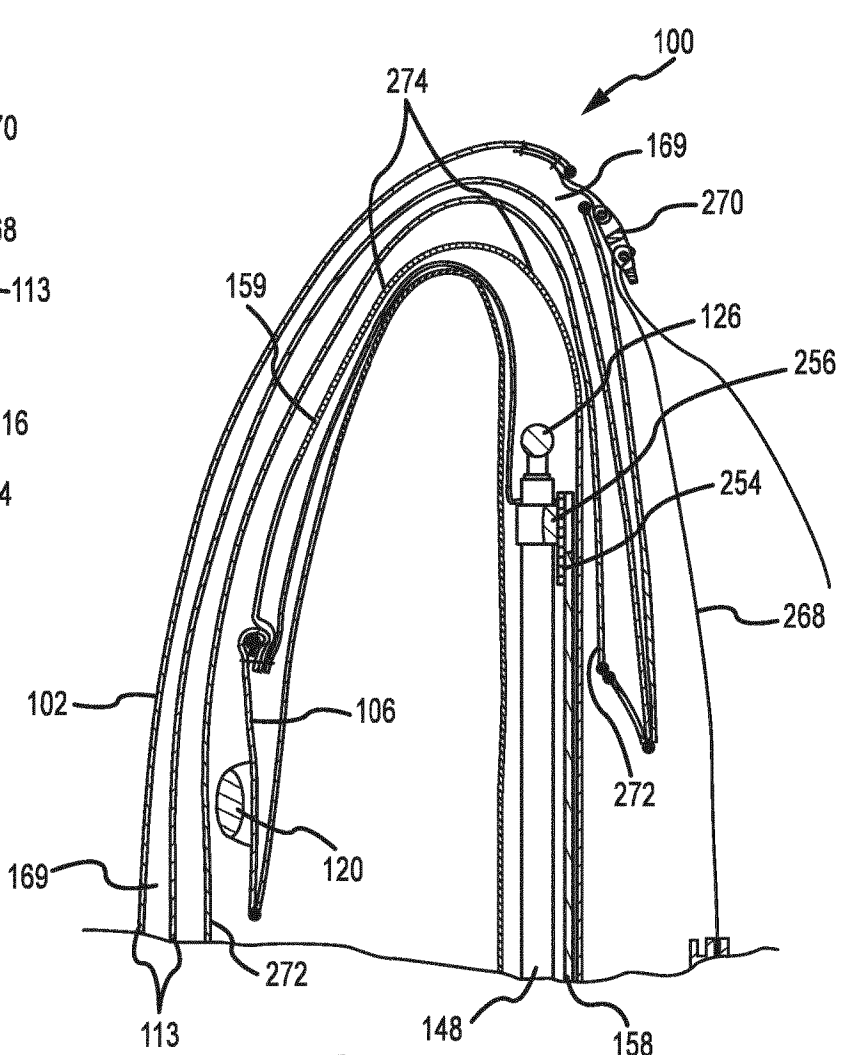
FIG. 17B shows a partial cross-section schematic view of the luggage case of FIG. 17A, viewed along line 17B-17B in FIG. 17A.
Figure 17A:
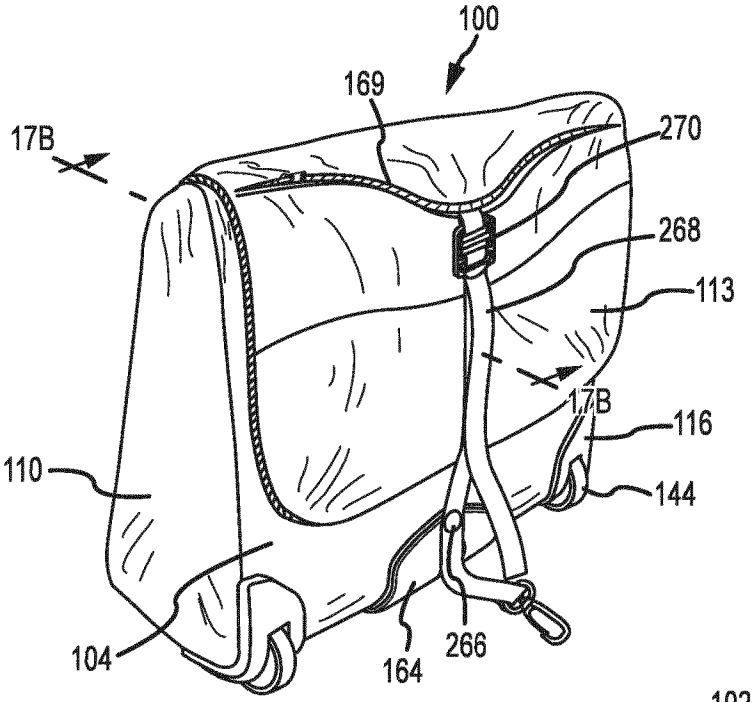
FIG. 17A shows a rear perspective view of the luggage case of FIG. 1A in a final folded configuration.

With reference to FIGS. 17A and 17B, when the rear side 104 of the luggage case 100 is folded, the axis of rotation for the folding the rear side 104 may be just above the top of the retracted multi-stage telescoping handle 124. The front flap of the luggage case 100 is folded over the folded rear side 104 of the luggage 100, with the axis of rotation just above the axis of rotation for the rear side 104 of the luggage 100. The upper side 106 of the luggage case 100 (including the carry handle 120 on the upper side 106) and the upper portion 159 of the rear side 104 of the luggage case 100 may thus be concealed within the folded luggage case 100, and the front flap 113 of the luggage case 100 is wrapped around the folded rear side 104 such that the interior lining 272 of the front flap 113 contacts the outer surface 274 of the both the upper portion 159 of the rear side 104 and some of the lower portion 161 of the rear side 104.

With reference to FIGS. 14A through 17B, the operation of a foldable luggage case 100 with both a first folding system 170, 170' and a second folding system 172 will be described. The first folding system 170, 170' may allow the luggage case 100 to be foldable along its depth and the second folding system 172 may allow the luggage case 100 to be folded along its height. In operation, the front flap 113 may be decoupled from the main body of the bag 100 (by, for example, unzipping the zipper 276). Also, the jacket 160 may be unsecured (by, for example, unzipping its zipper 250) and the multi-stage telescoping tow handle 124 may be brought to a retracted position. In this retracted position, the grip portion of the telescoping tow handle advantageously serves as a fold line along which the bag 100 may be folded. Next, the upper portion 159 of the rear side 104 may be folded over the rigid or semi-rigid panel 158 and the retracted multi-stage telescoping tow handle 124 towards the front and bottom sides 102, 108 of the luggage 100. Next, the front flap 113 may be lifted up and wrapped around the folded rear side 104 of the luggage case 100, with the axis of rotation for the folding of the front flap 113 similar to the axis of rotation for the folding of the rear side 104 (e.g., just above the retracted multi-stage telescoping handle 124). Next, the connector 266 on the strap 268 may be inserted into the channel 264 on the kick plate 164 to secure the luggage 100 in a final, dual-folded configuration. Of course, these steps may be carried out in a different order, and additional or alternate steps may be carried out when folding the luggage case 100 along both its height and its depth. Also, some steps may be omitted, such as inserting the connector 256 into the channel 264. As mentioned above, the upper portion 159 of the rear side 104 may be folded over towards the rear of the luggage case 100 in some examples, and in these examples the front flap 113 may not be folded separately, but the zipper 276 enclosing the enclosed space of the luggage 100 may be secured thereby causing the front flap 113 to fold towards the rear of the luggage case 100 along with the upper portion.

Figures 18A, 18B, 18C:
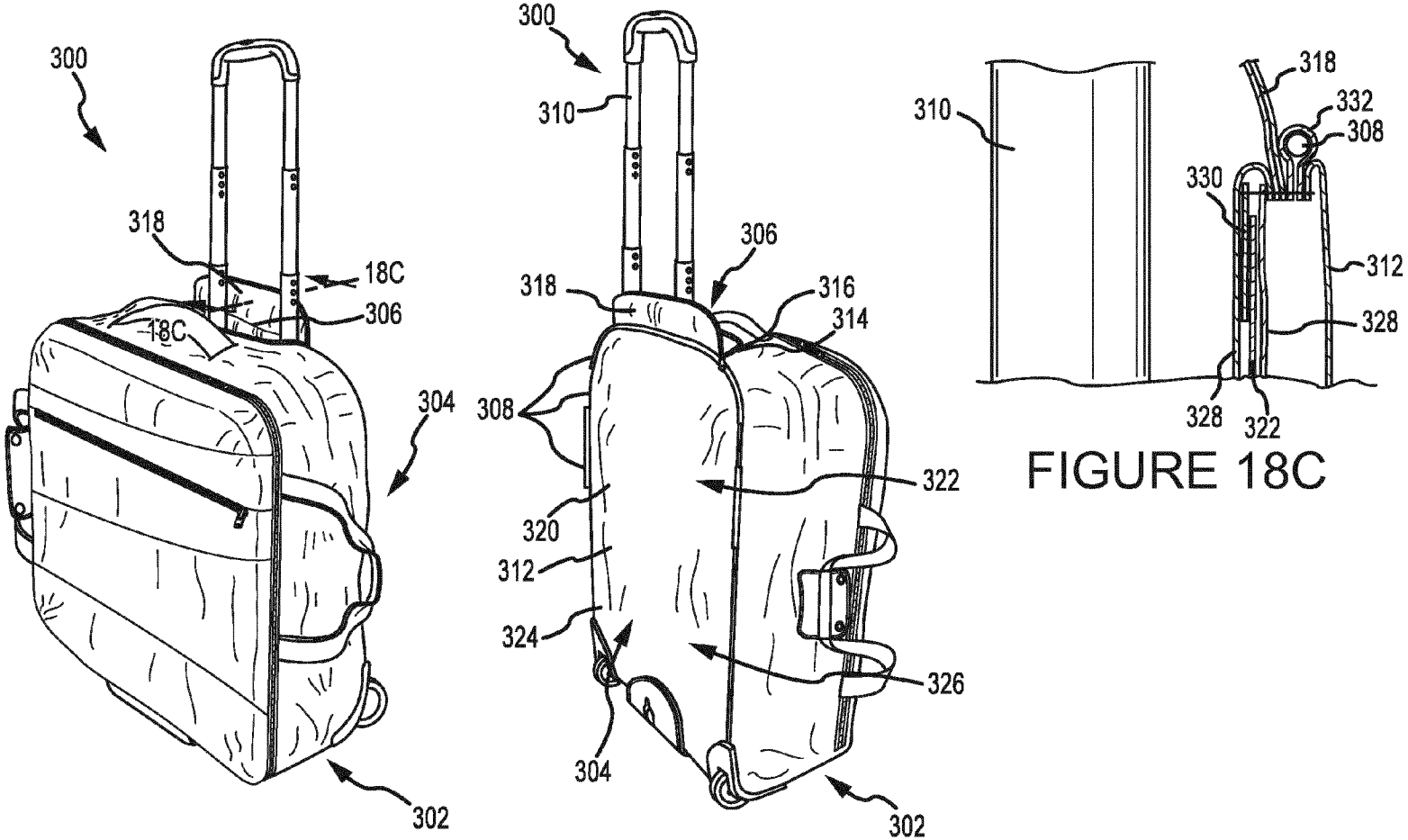
FIG. 18A shows a front perspective view of a foldable luggage case.
FIG. 18B shows a rear perspective view of the luggage case shown in FIG. 18A.
FIG. 18C shows a partial cross-section schematic view of the luggage case of FIG. 18A, viewed along line 18C-18C.

With reference now to FIGS. 18A through 18C, an embodiment of a foldable luggage case 300 with both a first folding system 302 and a second folding system 304 will be described. The foldable luggage case 300 shown in FIGS. 18A through 18C may be similar to the foldable luggage case 100 shown in, for example, FIGS. 14A through 17B and/or the foldable luggage case 100 shown in FIGS. 1A through 3B, except that the foldable luggage case 300 shown in FIGS. 18A through 18C may have a different handle opening 306 and/or a different example of second folding system 304. The foldable luggage case 300 may include a zippered U-shape handle opening 306, instead of a zippered jacket type handle opening 166 as illustrated in FIG. 1B, for example. In this embodiment, a section of piping 308 may be positioned rearward of the multi-stage telescoping handle 310 (as opposed to being positioned between the multi-stage telescoping handle and the main compartment of the luggage). Such placement of the piping 308 may reinforce the frame of the foldable luggage case 300, particularly when the multi-stage telescoping handle 310 is used to pull the luggage case 300 along a surface. The piping 308 may be, for example, steel wire, or any other suitable material or combination of materials.

Also, a portion of the piping 308 may form a part of the U-shaped handle opening 306, for example the straight part along the rear side 312 of the luggage case 300. In other embodiments, piping 308 may be including around the curved portion of the U-shaped handle opening 306 in addition to or in place of piping 308 being included on the straight part of the handle opening 306. Also, in some embodiments, the handle opening 306 may be a different shape, such as a rectangular shape, an oval shape, a triangular shape, and so forth. Also, the handle opening 306 may, in place of or in addition to zippers 314, include other securing mechanisms 316, such as snaps, hook-and-loop fasteners, and so forth. In still other embodiments, the handle opening 306 may not include a top flap 318, but instead may always be open. Many other styles of handle openings 306 may also be used.

In some examples, a fabric-covered foam bumper (not shown in FIG. 18A) may be positioned proximate to the zippered U-shape handle opening 306, and may abut against the telescoping handle 310 when the handle portion of the telescoping handle 310 is posited proximate the U-shaped handle opening 306. The bumper may be positioned between the upper portion 320 of the rear side 312 (which may include a semi-rigid or rigid panel 322) and the handle opening 306 on the interior of the handle opening 306. As such, the bumper may protect a user's hand from contacting the rear wall (which may include a semi-rigid or rigid panel) when the user inserts a hand into the handle opening 306 to retrieve the telescoping handle 310 from its stored position.

Also, a securing strap may be coupled to the luggage case 300 near the U-shaped handle opening 306 and may optionally be stored in a pocket disposed therein. For example, the securing strap may include two portions, with one end of each portion secured proximate to the handle opening 306, and the other free end of each portion coupled to a buckle portion. When the two portions of the securing strap are wrapped around the luggage case 300 in a folded configuration and the two buckle portions are interlocked together, the securing strap may advantageously maintain the folded luggage 300 in a compact configuration for convenient storage.

With reference now to FIG. 18C, a cross section of the handle opening 306 of the foldable luggage case 300 shown in FIG. 18A is shown, viewed along line 18C-18C of FIG. 18A. The second folding system 304 of the foldable luggage case 300 shown in FIG. 18C may include an upper portion 320 comprising a rigid or semi-rigid panel 322 (such as a polypropylene board). In other words, in the second folding system 304 of the foldable luggage case 300, both the upper portion 320 and the lower 324 portion of the rear side 312 may include a rigid or semi-rigid panel 322, 326. In some embodiments, the upper rigid or semi-rigid panel 322 may be coupled to the luggage case 300 through, for example, a pocket sewn in the lining 328 of the rear side 312 of the luggage case 300. In other embodiments, the rigid or semi-rigid panels 322, 326 may not be coupled to the luggage 300 via a pocket and/or via lining. Also, a strip of fabric 330 may be included in order to, for example, cushion the pressure of the multi-stage telescoping handle 310 against the rigid or semi-rigid panel 322 when the multi-stage telescoping handle 310 is used to pull the luggage case 300 along a surface. Also shown in FIG. 18C is the section of piping 308 referred to previously. The piping 308 may be coupled to the bag via a portion of fabric 332 (such as nylon) being wrapped around the piping 308 and sewn or otherwise coupled to the rear side 312 of the luggage case 300.

In general, embodiments of a foldable luggage case may include the zippered U-shaped handle opening shown in FIGS. 18A and 18B, but not include a rigid or semi-rigid panel in the upper portion of the rear side of the bag, or a foldable luggage case may include a rigid or semi-rigid panel in the upper portion of the rear side of the bag and not include a zippered U-shaped handle opening. Also, embodiments of a foldable luggage case may include one or more, or none, of the other features described herein.

Although the figures described above show certain embodiments for foldable luggage cases that are foldable along two axes, other embodiments of foldable luggage that foldable along a single axis or along two or more axes are also possible. For example, in another embodiment of a luggage case foldable along two axes, the rear side of the luggage case may be folded over the front flap of the luggage case; in other words, in contrast to the embodiment shown in FIGS. 14A through 18C, the front flap of the luggage case may be folded first, followed by the folding of the rear side. In another embodiment, the front flap of the luggage case may remain secured (e.g. not unzipped) and the entire luggage case may be folded over. In still other embodiments, one or more of the sides of the luggage case may be folded in any direction. In general, a luggage case may be folded any number of times along any axis or axes using (including along a corner intersection, as described below), for example, the first folding system and second folding system described above (although, as mentioned above, those folding systems are not necessarily limited to the side of luggage in the context of which they are described herein).

Figure 19A:
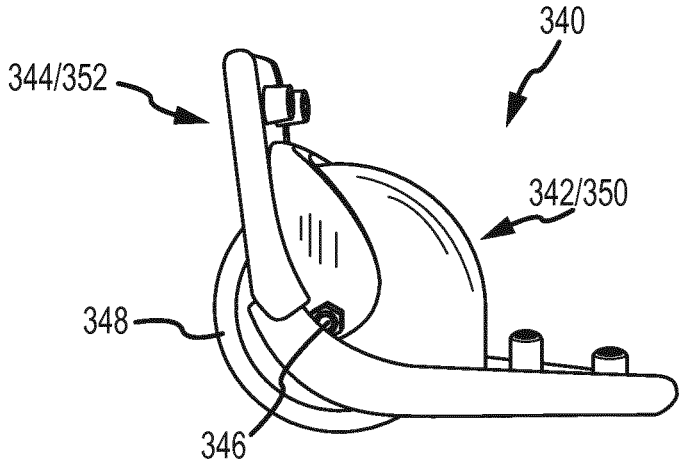
FIG. 19A shows a side elevation view of a foldable wheel housing in a not folded configuration.

With reference now to FIG. 19A, a wheel housing 340 may include a first piece 342 and a second piece 344 pivotally joined together. At least one of the first and second pieces 342, 344 may support an axle 346 that in turn supports a wheel 348 for the wheel housing 340. The first piece 342 may have a first surface that conforms to a first surface portion of a luggage case 300 and the second piece 344 may have a second surface that conforms to a second surface portion of the luggage case 300. In some but not all embodiments, the first piece 342 may include a shell 350 and the second piece 344 may include a sheath 352, with the shell 350 and the sheath 352 pivotally coupled together through the axle 346. In other embodiments, the first piece 342 may include a sheath 352 and the second piece 344 may include a shell 350. In still other embodiments, the first and second pieces 342, 344 may be shaped differently than a shell 350 and/or a sheath 352.

Figure 19B:
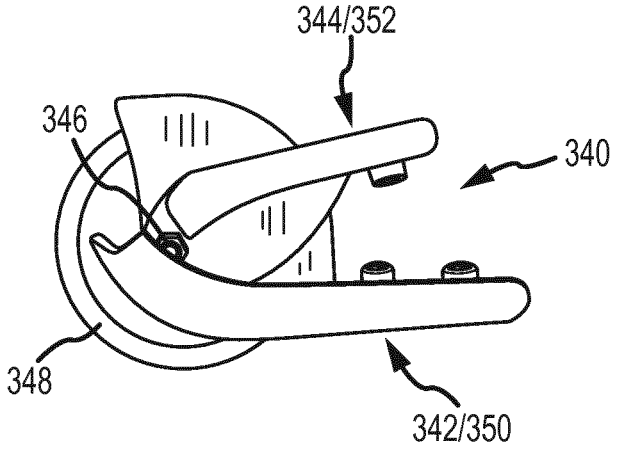
FIG. 19B shows a side view of the foldable wheel housing shown in FIG. 19A in a folded configuration.

In those embodiments with a shell 350 and a sheath 352, and with reference to FIGS. 19A and 19B, the shell 350, the sheath 352, and a wheel 348 may all be coupled together via an axle 346. The sheath 352 may be been pivoted relative to the shell 350 and the wheel 348 about a pivot axis defined by the axle 346. The foldable wheel housing 340 may be used in, for example, luggage cases with a folding system located in the corner intersection between two sides of the luggage case, such as between the rear side and the bottom side, or any other two sides. The foldable wheel housing(s) 340 may define the hinge along which the luggage case folds in some examples, and may include a securing mechanism to retain the luggage case in an unfolded and/or folded configuration.

Figure 20A:
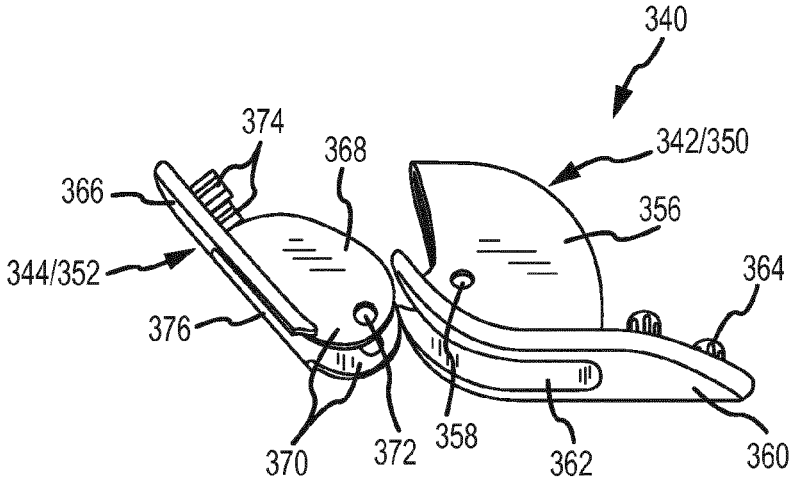
FIG. 20A shows an exploded perspective view of the foldable wheel housing shown in FIG. 19A, without the wheel.
Figure 20B:
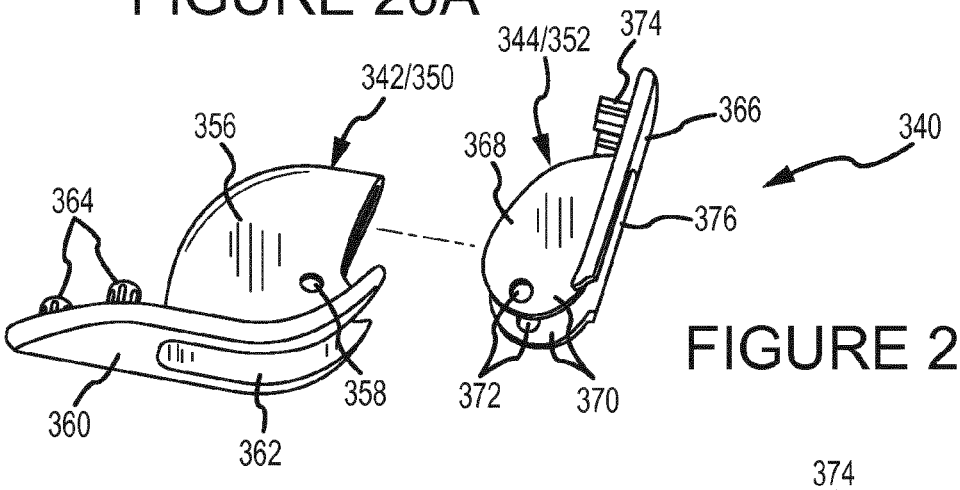
FIG. 20B shows another exploded perspective view of the foldable wheel housing shown in FIG. 19A, without the wheel.
Figure 20C:
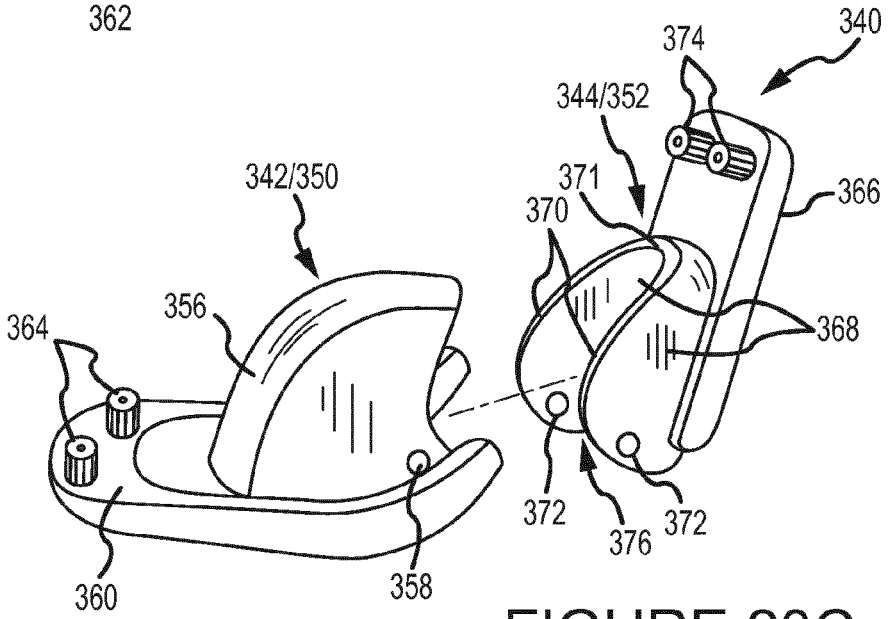
FIG. 20C shows yet another exploded perspective view of the foldable wheel housing shown in FIG. 19A, without the wheel.

With reference to FIGS. 20A through 20C, one example of first and second pieces 342, 344 of a wheel housing 340 will now be described. The shell 350 of the wheel housing 360 may include a hollow disk portion 356 (e.g., approximately a quarter section of a full hollow disk) that has a U-shaped cross-section. The hollow disk portion 356 may be configured to at least partially enclose a wheel 348 in that it may include a large enough hollow middle section for a wheel 348 to be received therein and rotate along the axis. The hollow disk portion 356 may provide a barrier between the wheel 348 and the inside of a luggage case while still allowing the wheel 348 to contact surfaces such as the ground or stairs when the luggage is pushed or pulled. The hollow disk portion 356 of the foldable wheel housing 340 may allow the wheel 348 to be exposed to a range of approximately 270 degrees (as measured from the axle of the foldable wheel housing assembly 340) so that the wheel 348 can contact both horizontal surfaces (such as the ground when the luggage case is in an upright position) and vertical surfaces (such as stairs when the luggage case is in an upright position). The foldable wheel housing 340 may, however, provide a barrier between the wheel 348 and the inside of a luggage case over a range of approximately 90 degrees (as measured from the axle of the foldable wheel housing assembly 340). The barrier provided by the hollow disk portion 356 of the foldable wheel housing 340 may prevent dirt, and other outside objects or materials from entering into the interior of a luggage case, for example, and may also prevent inside objects or materials from falling out of the luggage case. The hollow disk portion 356 may, however, include an opening 358 on each side configured for the axle 346 to be placed therethrough so that the shell 350 may be coupled to the sheath 352 and the wheel 348 via the axle 346.

In addition to the hollow disk portion 356, the shell 350 of the foldable wheel housing 340 may also include a linear or elongated portion coupled to the hollow disk portion 356, with the linear or elongated portion 360 configured to couple the shell 350 to a structure, such as a luggage case. The linear or elongated portion 360 may thus conform to a surface portion of the luggage case to which it is coupled. The linear or elongated portion 360 of the shell 350 may include a U-shaped cavity 362 in the generally planar linear portion 360 (which may be similar to and adjoin with the U-shaped cross-section of the hollow disk portion 356). The linear or elongated portion 360 may also include at least one boss for operative securement of the hollow disk portion 356 to the luggage case.

Around the outer edges of the U-shaped cavity 362, the linear or elongated portion 360 of the shell 350 may be coupled to the hollow disk portion 356 of the shell 350. Near or beyond the apex of the U-shaped cavity 362, the linear or elongated portion 360 may include one or more receiving elements 364, such as bosses, configured to receive a fastener such as a screw. The receiving elements 364 may facilitate coupling the linear or elongated portion 360 of the shell 350 to a structure, such as a luggage case. The linear or elongated portion 360 of the shell 350 may include two receiving elements 364. The linear or elongated portion 360 may also include a curved portion, which may be near the base of the U-shaped cavity 362. In other embodiments, however, the linear or elongated portion 360 may be relatively flat near the base of the U-shaped cavity 362, or in still other embodiments, may include a portion that is perpendicular to the U-shaped cavity 362.

The linear or elongated portion 360, and in some embodiments a part of the hollow disk portion 356, may include a lip, with the lip configured to receive a panel or other insert, such as a side of a luggage case. In some embodiments, both sides of the shell 350 may include a lip, whereas in other embodiments, the shell 350 may only include a lip on one side, such as an outer side. In still other embodiments, the shell 350 may not include any lips. Also, the openings 358 for the axle 346 in the hollow disk portion 356 may include a lip configured to help support the axle 346.

Still with reference to FIGS. 20A through 20C, the sheath 352 of the foldable wheel housing 340 may include a linear or elongated portion 366, and a protruding portion 368. In other examples, the sheath 352 may not include one of the linear/elongated portion 366 or the protruding portion 368. The protruding portion 368 may include two arms 370 and an arcuate connector 371 coupling the two arms 370. In some embodiments, however, the protruding portion 368 may not include the arcuate connector 371, and/or may only include one arm 370 or more than two arms 370. The arms 370 and the arcuate connector 371 may protrude perpendicularly from the linear or elongated portion 366 of the sheath 352. Each arm 370 may include an opening 372 through which the axle 346 may be placed. The arms 370 and the arcuate connector 371 of the sheath 352 may be configured to operably rotate around the hollow disk portion 356 of the shell 350 through, for example, a radius of 90 degrees in order to fold the foldable wheel housing 340. In other embodiments, the sheath 352 and shell 350 may be configured to rotate relative to one another over a larger or a smaller range. In some embodiments, the two arms 370 and the arcuate connector 371 of the sheath 352 may form a hollow disk structure, similar to the hollow disk structure 356 of the shell 350, which may operably rotate around the shell 350.

Similar to the linear or elongated portion 360 of the shell 350, the linear or elongated portion 366 of the sheath 352 may be configured to couple the sheath 352 to a structure, such as a luggage case. The linear or elongated portion 366 of the sheath 352 may include one or more receiving elements 374, such as bosses, configured to receive a fastener, such as a screw, and may facilitate coupling of the linear or elongated portion 366 of the sheath 352 to a structure such as a luggage case. The sheath 352 may include two receiving elements 374. The linear or elongated portion 366 of the sheath 352 may also include a U-shaped cavity 376 in the generally planar linear section (which may be similar to, but larger in diameter than, the U-shaped cross-section of the hollow disk portion 356).

Around the outer edges of the U-shaped cavity 376, the linear or elongated portion 366 of the sheath 352 may be coupled to the protruding portion 368. At the apex of the U-shaped cavity 376, the linear or elongated portion 366 may include one or more receiving elements 374, such as bosses, configured to receive a fastener such as a screw. The receiving elements 374 may facilitate coupling the linear or elongated portion 366 of the sheath 352 to a structure, such as a luggage case. The linear or elongated portion 366, and in some embodiments a part of the protruding portion 368, may include a lip, with the lip configured to receive a panel or other insert, such as a side of a luggage case. In some embodiments, both sides of the sheath 352 may include lip, whereas in other embodiments, the sheath 352 may only include a lip on one side, such as an outer side. In still other embodiments, the sheath 352 may not include any lips. Also, the openings 372 for the axle 346 in the arms 370 may include a lip configured to help support the axle 346.

Referring back to FIGS. 19A and 19B, any type of wheel 348 and/or axle 346 may be used in the foldable wheel housing 340. For example, the wheel 348 and/or the axle 346 may be made of any type of material or combination of materials such as a rubber, plastic, metal, or any other type of material. The axle 346 may couple the shell 350, the sheath 352, and the wheel 348 all together, and may allow the wheel 348 to rotate within the foldable wheel housing 340 assembly and may also allow the sheath 352 portion to rotate relative to the hollow disk portion 356. The axle 346 may be axially aligned with a wheel housing pivot axis about which the first and second pieces 342, 344 move relative to one another. Moreover, the axle 346 of the wheel housing 340 may further define a luggage case pivot axis along which the rear side and the bottom side of the luggage case move relative to one another to collapse the luggage case.

With reference to FIGS. 19A through 20C, the foldable wheel housing 340 may further include one or more locking mechanisms to lock the shell 350 and the sheath 352 in one or more orientations relative to one another. For example, the shell portion 350 may include a biased pin, and the sheath 352 may include an opening for the biased pin to be placed through, the biased pin and the opening configured to lock the shell 350 and the sheath 352 into a not folded configuration. Alternatively, or in addition to that, the shell 350 and sheath 352 may include a mechanism to lock the shell 350 and the sheath 352 into a folded configuration. Generally, the foldable wheel housing 340 may include zero, one, or multiple locking mechanisms configured to prevent the shell 350 and the sheath 352 from rotating relative to one another when locked in one or more configurations. Also, generally, the locking mechanism may be any type of locking mechanism, including the biased pin and opening, a détente system, retaining clip(s), and so forth. In some embodiments of the foldable wheel housing 340, however, no locking mechanism may be included. If the folding wheel housings 340 do not include a locking mechanism, a first folding system implemented on the same corner intersection as the foldable wheel housings 340 may act similar to selectively lock two sides or panels of a luggage case (to which the shell 350 and sheath 352 of a foldable wheel housing 340 are attached) into a folded or not folded configuration. The locking of the first folding system may consequently lock the shell 350 and sheath 352 of the foldable wheel housing 340 relative to one another. In other examples, where the wheel housings 340 do include a locking mechanism, a securing mechanism 174, such as a zipper 176, may not be needed. Instead, the locking mechanisms of the foldable wheel housings 340 may act to secure the two sides or panels of the luggage case into a folded or not folded configuration.

Also with reference to FIGS. 19A through 20C, many variations on the foldable wheel housing 340 shown and described are possible. For example, although the cross-section of the hollow disk portion 356 of the shell 350 and the cross-section of the protruding portion 368 of the sheath 352 may be generally U-shaped with a curved apex, the respective portions 356, 368 may generally be triangle shaped, or square shaped, or any other shape. In this manner, the shell 350 and the sheath 352 may be configured to rotate relative to one another (when not locked, if the foldable wheel housing 340 includes a lock), and allow the wheel 348 to rotate relative to both the shell 350 and the sheath 352. In general, as described above, the first and second pieces 342, 344 of the wheel housing 340 that are pivotally joined together may be of many different shapes and configurations and are not limited to the specific example of a hollow disk portion 356, a sheath 352, etc.

Still with reference to FIGS. 19A through 20C, in some embodiments of a foldable wheel housing 340, the linear or elongated portion 360 of the shell 350 and the linear or elongated portion 366 of the sheath 352 may, when in a not folded configuration, define an angle of greater than 90 degrees. Such an angle may prevent the wheel housing 340 from extending beyond the rear side of the luggage case in order to maximize the amount of available space in the luggage case for a given set of external dimensions.

Figure 21A:
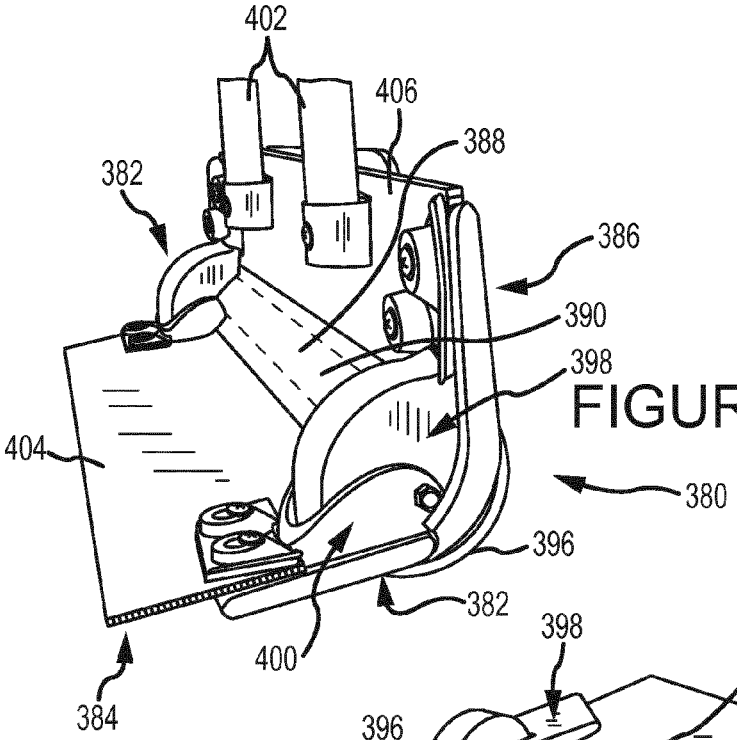
FIG. 21A shows a top perspective view of one embodiment of the structural components of a luggage case with a folding system and foldable wheel housings, with the folding system locked in a not folded configuration and the foldable wheel housings not folded.
Figure 22:
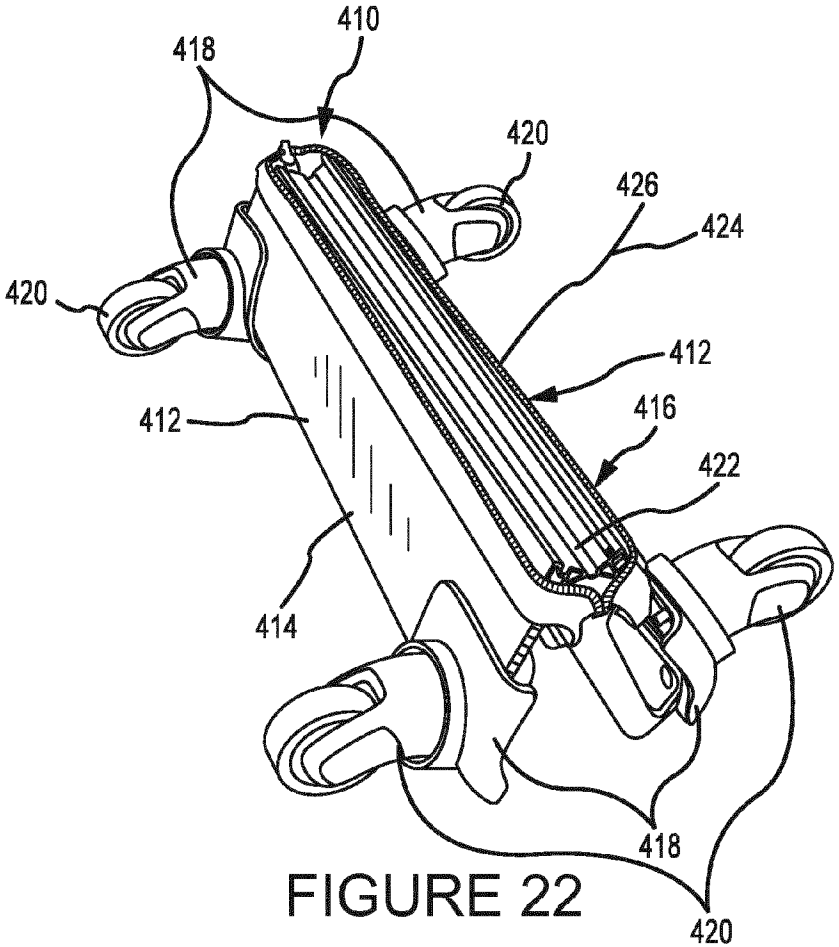
FIG. 22 shows a bottom perspective view of some of the structural components of a luggage case with a first folding system, with the first folding system folded.

FIG. 21A shows a top perspective view of one embodiment of some of the structural components of a luggage case with a first folding system 380 and two foldable wheel housings 382, with the folding system 380 locked in a not folded or first configuration and the foldable wheel housings 382 not folded. As mentioned above, the use of one or more foldable wheel housings 382 may allow for the first folding system 380 to be moved from the middle of the bottom side of a luggage case (as shown in FIGS. 5A and 5B, for example) to the corner intersection between the bottom side and the rear side, for example, of the luggage case (as shown in FIG. 21A) because the foldable wheel housing 382 allows the bottom side of the luggage case to pivot relative to the rear side, as opposed to one portion of the bottom side pivoting relative to another portion of the bottom side. Moving the folding system 380 to the corner intersection between the bottom side and the rear side of the luggage case may advantageously in some embodiments allow the luggage case to be folded more flat than if a folding system were implemented in the middle of the bottom side of the luggage case.

As shown in FIG. 21A, the luggage case includes a bottom side 384 (illustrated as an extruded polypropylene board, although it may be any type of material or materials), a rear side 386 (also illustrated as an extruded polypropylene board, although it also may be any type of material or materials), a hinge 388 (illustrated as a polypropylene strap 390) coupled between the bottom and rear sides 384, 386, a securing mechanism 392 (e.g., a zipper 394, although not visible in FIG. 21A), two foldable wheel housings 382, two wheels 396 (only one of which is visible in FIG. 21A), and portions of the lowest stage of telescoping handle receiving tubes.

The sheath 400 of each of the two wheel housings 382 may be coupled to the bottom side 384 of the luggage case, and the shell 398 of each of the two wheel housings 382 may be coupled to the rear side 386 of the luggage case. The sheath 400 and the shell 398 of each of the wheel housings 382 may be coupled to the bottom side 384 and the rear side 386 of the luggage case by one or more receiving elements. In some embodiments, however, one or more sheaths 400 may be coupled to the bottom side 384 of a luggage case and one or more shells 398 may be coupled to the rear side 386 of the luggage. In general, any combination may be used.

Still with reference to FIG. 21A, the hinge 388 may be sewn to the inner surface of the bottom side 384 (i.e., the first panel 404 of the corner intersection folding system 380) of the luggage, and may also be sewn to the inner surface of the rear side 386 (i.e. the second panel 406 of the corner intersection folding system 380) of the luggage. Portions of a telescoping handle 402 (such as the receiving tubes of the last or bottom stage of the telescoping handle 402) may be coupled to a rigid panel of the rear side 386 of the luggage case by brackets.

Figure 21B:
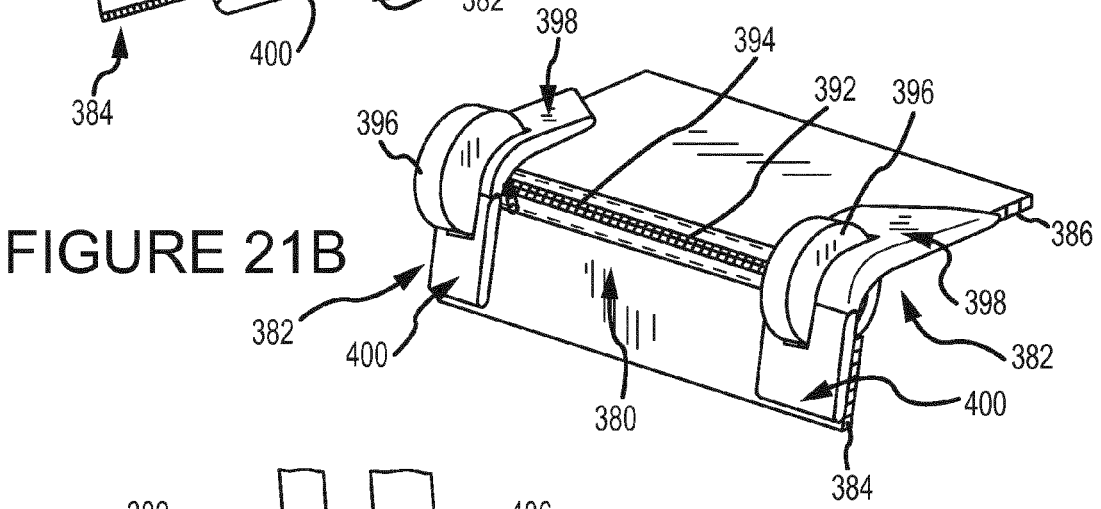
FIG. 21B shows a bottom perspective view of the structural components of the luggage case shown in FIG. 21A.

FIG. 21B shows a bottom perspective view of the structural components of the luggage case shown in FIG. 21A. A securing mechanism 392, such as a zipper 394 may be coupled to the outer sides of both the bottom and rear sides 384, 386 of the luggage case. The securing mechanism 392, in conjunction with the hinge 388 of the first folding system 380, may lock the bottom and rear sides 384, 386 of the luggage case into a not folded configuration with respect to one another, and may consequently lock the shell and the sheath portions 398, 400 of the foldable wheel housings 382 into a not folded configuration with respect to one another.

Figure 21C:
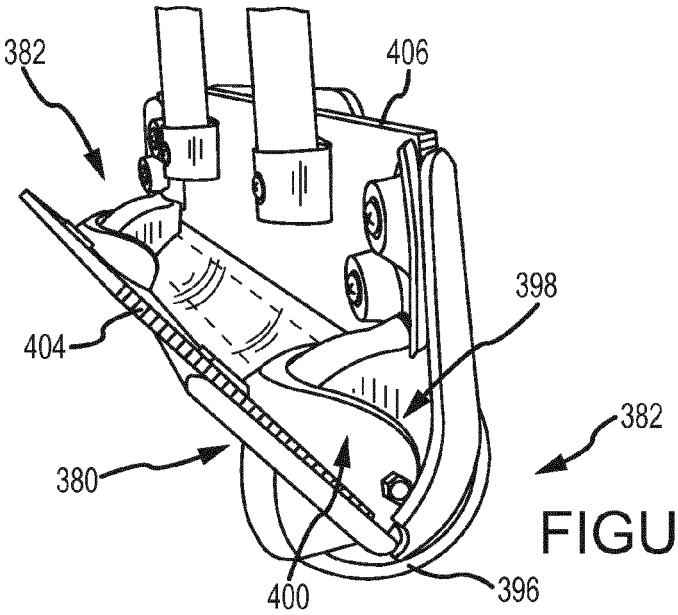
FIG. 21C shows a top perspective view of the structural components of the luggage case shown in FIG. 21A with the folding system in a folded configuration and the foldable wheel housings folded.

FIG. 21C shows a top perspective view of the structural components of the luggage case shown in FIGS. 21A and 21B with the folding system 380 in a folded or second configuration and the foldable wheel housings 382 folded. The first and second panels 404, 406 of the folding system 380 are still coupled to one another via the hinge 388 along the inner side of the first and second panels 404, 406. Because the zipper securing mechanism 392 is unsecured (e.g., the zipper 394 is unzipped), however, the first and second panels 404, 406 may pivot along the hinge 388 with respect to one another.

In general, the operation of the corner intersection folding system 380 illustrated in FIGS. 21A through 21C is similar to the first folding system 170 illustrated in 5A and 5B. Specifically, when the zipper 394 is zipped, the first and second panels 404, 406 are locked in a not folded configuration and they are substantially perpendicular relative to one another. In the locked not folded configuration, the corner folding system 380 may provide sufficient support for the luggage case during use of the luggage case in that it may, in particular, prevent the luggage case from collapsing or being folded during use. In the unlocked or foldable configuration, the corner folding system 380 may allow for all or almost all of the bottom side 384 of a luggage case to be folded up towards the rear side 386 of the luggage when the luggage is not in use.

The foldable wheel housings 382 described above and the corner intersection folding system 380 may be used in place of or in addition to the first folding system 170, 170' of the foldable luggage described above in some embodiments. Doing so may allow a luggage case to be folded almost completely flat when not in use. In other embodiments, as described above, no foldable wheel housings are used, and the folding system may be implemented in the middle of the bottom side of the luggage case rather than in the corner intersection between the bottom side and the rear side of the luggage case.

The embodiments of foldable luggage described here may apply to many different types of luggage cases and even other types of storage or other containers. For exampled, FIG. 22 shows a bottom perspective view of some of the structural components of one embodiment of a spinner-type luggage case with a first folding system 410 in the middle of the bottom side 412 of the luggage case. In this embodiment, the first panel 414 of the bottom side 412 of the luggage case may be a piece of extruded polypropylene that curves on the front side of the panel 414, and the second panel 416 of the bottom side 412 of the luggage case may be a piece of extruded polypropylene that curves on the rear side of the panel 416. Two wheel housings 418 may be coupled to the first panel 414, and two wheel housings 418 may be coupled to the second panel 416. A spinner wheel 420 may be coupled to each of the wheel housings 418. The first and second panels 414, 416 may be coupled in the middle of the bottom side 412 of the luggage via a hinge 422 similar to the ones shown in FIGS. 7 through 10B. The hinge 422 may be positioned on the inner side of the first and second panels 414, 416. The first and second panels 414, 416 may also be selectively coupled via a zipper securing mechanism 424 on the outer or bottom side of the first and second panels 414, 416. When the zipper 426 is unzipped, the first and second panels 414, 416 are not locked. When unlocked, the first and second panels 414, 416 may be pivoted relative to each other between an unfolded configuration and one or more folded configurations. With reference still to FIG. 22 the first and second panels 414, 416 are shown at an approximately perpendicular or normal configuration with respect to one another. In the folded configuration, the first and second panels 414, 416 may remain coupled to one another via the hinge 422.

With reference to FIG. 23 another embodiment of a spinner-type luggage case may include a corner intersection type folding system 430. In this embodiment, the first panel 432 of the corner intersection folding system 430 may be the bottom side of the luggage case, and the second panel 434 may be a portion of the rear side of the luggage case, both of which may be extruded polypropylene. The first panel 432 may include two curved portions in connection with four wheel housings 436 and four wheels 438, with one wheel housing 436 and spinner wheel 438 located on each of the four corners of the first panel 432. The second panel 434 may be substantially flat for at least a portion of it.

Because the wheel housings 436 may be relatively low-profile, a second folding system 430 may be implemented in the corner intersection between the bottom side and the rear side of the luggage without using foldable wheel housings. In other embodiments, however, foldable wheel housings may be used even for low-profile wheel housings. The first and second panels may be coupled at the corner intersection between the bottom side of the luggage and the rear side of the luggage via a hinge on the inner side of the first and second panels. Alternatively, the first and second panels may be coupled slightly above the corner intersection along the rear side of the luggage case. The first and second panels may also be selectively coupled via a zipper securing mechanism on the outer or bottom side of the first and second panels. When the zipper is unzipped the first and second panels are not locked. When unlocked, the first and second panels may be pivoted relative to each other between an unfolded configuration and one or more folded configurations. With reference still to FIG. 23, the first and second panels 432, 434 are shown as approximately parallel planes, although they still remain coupled to one another via the hinge.

Figure 24:
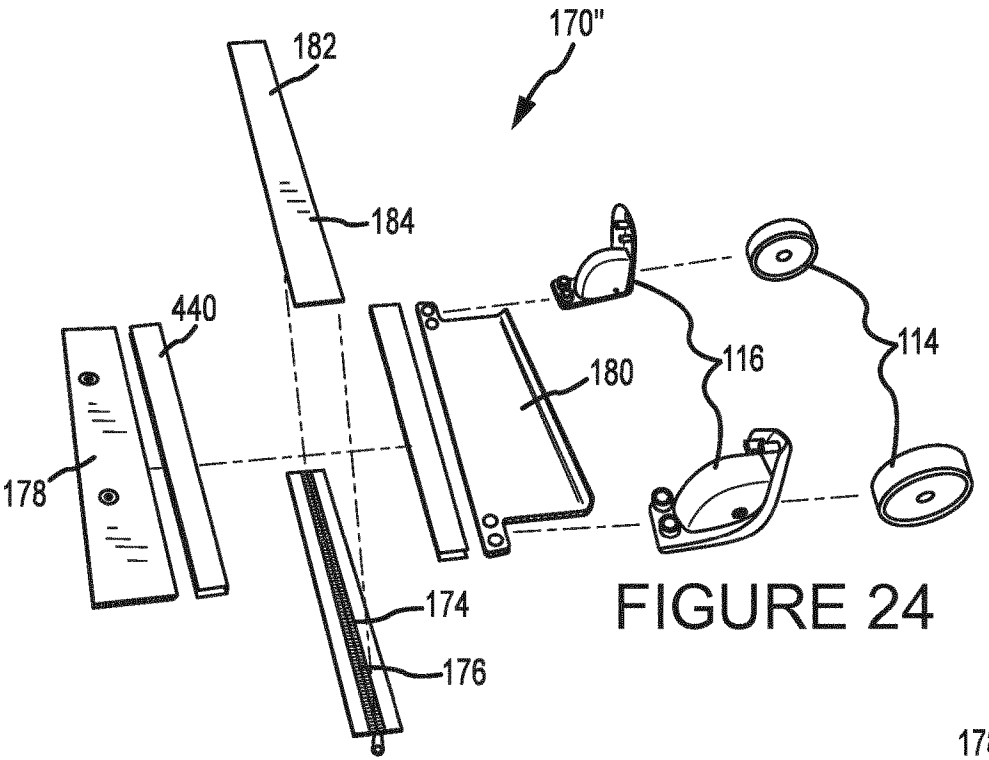
FIG. 24 shows an exploded perspective view of the structural components of an embodiment of a first folding system of the luggage case shown in FIG. 1A.
Figure 25:
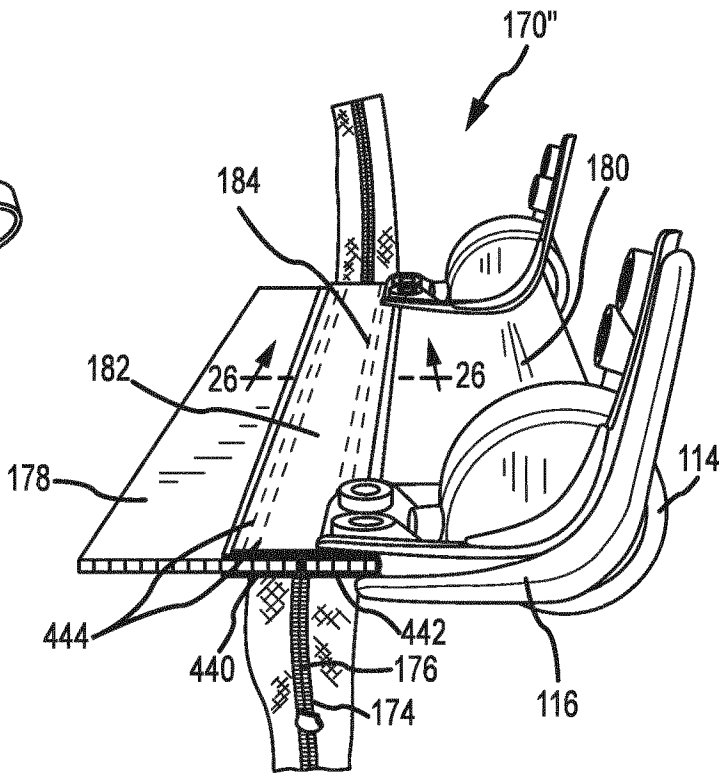
FIG. 25 shows a top perspective view of the structural components shown in FIG. 24 assembled with the first folding system locked in a not folded configuration.
Figure 26:
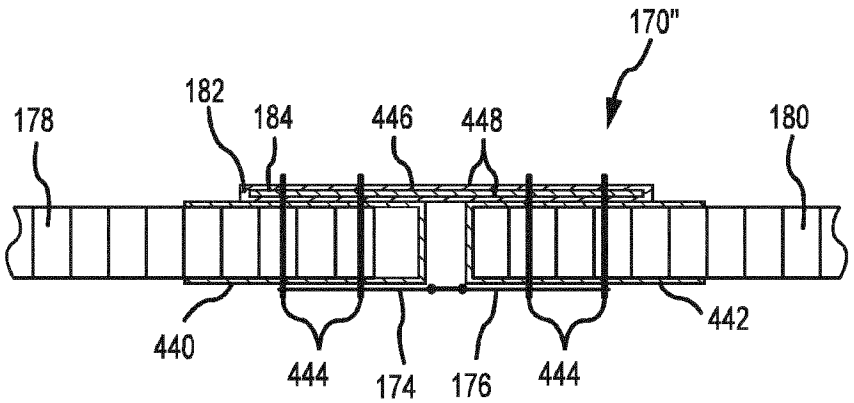
FIG. 26 shows a cross-section view of the assembled structural components shown in FIG. 25, viewed along line 26-26 in FIG. 25.

With reference to FIGS. 24-26, a first folding system 170" may be similar to the first folding system 170 described above in connection with FIG. 4, except that it may additionally include end caps 440, 442 for covering at least one edge of the first and second panels 178, 180 (e.g., the edge along where the panels 178, 180 are joined by the hinge 182 and the securing mechanism 174). The end caps 440, 442 have a U-shaped or C-shaped cross section, and may be polypropylene or another suitable material and, in some examples, may be formed by bending a flat piece of material into that shape. The caps 440, 442 may also be injection molded, machined, or thermoformed. The caps 440, 442 serve to protect the cut edges of the first and second panels 178, 180 and keep them from becoming damaged through use, accident, or the like. The caps 440, 442 may also serve to reinforce the first and second panels 178, 180 proximate the hinge 182 in order to provide a sturdier bottom side of the luggage case. The caps 440, 442 may also serve to provide a more finished look from the bottom of the first folding system 170" (i.e., the part that a user sees on the external side of the bag), as opposed to having rough edges showing.

The end caps 440, 442 may facilitate stitching the hinge 182 and/or the securing mechanism 174 (such as a zipper 176) to the first panel 178 and/or the second panel 180 because stitching materials to the panel(s) may be relatively difficult during manufacturing. This may be relatively difficult because, for example, of the thickness or hardness of the first and/or second panel 178, 180, or alternatively because the angle at which stitching is inserted may be awkward if all of the components are stitched together at once. After the zipper 176 and hinge 182 are coupled to each of the end caps 440, 442, the first and second panels 178, 180 may be coupled to their respective end cap 440, 442 by, for example gluing. In this manner, the zipper 176 and/or the hinge 182 need not be directly coupled to the first and second panels 178, 180, but may instead be indirectly be coupled to the first and second panels 178, 180 through a respective end cap 440, 442.

In other examples, however, and as explained below, a first end cap 440 and a second end cap 442 may be stitched to the respective first and second panels 178, 180. In these examples, the end caps 440, 442 may serve to protect the cut edges or to provide a more finished look.

With reference to the cross-section view in FIG. 26, the zipper 176 may be coupled to each of the end caps 440, 442 by, for example, stitching. The hinge 182 may also be coupled to each of the end caps 440, 442 by, for example, stitching. The zipper 176 and hinge 182 may be coupled to the first and second panels 178, 180 by, for example, stitching, and the stitching coupling the zipper 176 and hinge 182 to the first and second panels 178, 180 may be the same stitching coupling the zipper 176 and hinge 182 to the end caps 440, 442 in some cases. In other cases (not shown), the zipper 176 may be coupled to each end cap 440, 442 by one or more stitch lines, the hinge 182 may be coupled to each end cap 440, 442 by one or more stitch lines, and each end cap 440, 442 may be coupled to the respective first or second panel 178, 180 by a different means, such as gluing, sonic welding, or even one or more different stitch lines.

In still other examples, the zipper 176 and hinge 182 may be coupled to each of the end caps 440, 442 in another suitable manner such as by gluing or sonic welding, and/or the end caps 440, 442 may be coupled to the first and second panels 178, 180 in another suitable manner such as by gluing or sonic welding.

Also with reference to FIG. 26, the hinge 182 of the first folding system 170" may include a polypropylene strip 446 covered by fabric 448, such as nylon. The polypropylene strip 446 may reinforce the hinge 182, while still allowing the hinge 182 to bend so that the first and second panels 178, 180 can be folded relative to one another. The fabric 448 may encase the polypropylene strip 446. In other examples, however, the hinge 182 may include only fabric 448, or may include only a polypropylene strip 446 or other suitably strong yet resilient material. The hinge 182 in this example, as with others, may be a continuous piece of material, or may be made up of separate pieces of material (two or more) that are discretely attached to the structure to facilitate a hinge function. The hinge strip 182 may be rectangular, may have non-parallel sides, and may have a constant thickness. It may have a thinner dimension along the hinge-line and thicker dimensions elsewhere, such as a groove formed along the hinge line. This living hinge type structure provides sufficient flexibility, and yet torsional rigidity, to resist twisting. It provides a somewhat resilient structure to somewhat bias the hinge structure 182 and associated components from a folded to an unfolded position. The hinge structure 182 allows the bottom to remain folded when in the folded position, but does not materially resist unfolding.

With reference to FIGS. 25 through 26, the hinge 182 may be coupled to the first and second panels 178, 180 through the first and second end caps 440, 442 along the length of the hinge 182 (which may or may not extend the length of the first and second panels 178, 180, as explained above) by, for example, stitching. When the hinge 182 is coupled to the first and second panels 178, 180 through the end caps 440, 442 by stitching, one or more respective lines of stitching 444 may couple the hinge 182 to the respective first and second panels 178, 180. With reference to FIG. 26, in some cases, the stitching 444 may extend all the way through the first or second panel 178, 180 (not shown in FIG. 26). In general, one, two, or more respective lines of stitching 444 may be used to couple the hinge 182 to the respective first and second panels 178, 180.

Also, the securing mechanism 174 may be coupled to the first and second panels 178, 180 through the first and second end caps 440, 442. For example, in the case of a zipper 176 as the securing mechanism 174, one side of the zipper tape may be secured to the first section of the hinge 182 through the first end cap 440 along at least a portion of the length of the hinge 182 with one, two, or more lines of stitching 444, and the other side of the zipper tape may be secured to the second section of the hinge 182 through the second end cap 442 along at least a portion of the length of the hinge 182 with one, two, or more lines of stitching 444. The zipper 176 may also be coupled to the hinge 182 by another suitable means, such as gluing, sonic welding, and so forth.

In some examples, the same stitching line or lines 444 may be used to couple both the hinge 182 and the securing mechanism 174 such as a zipper 176 to the first and second panels 178, 180 through the first and second end caps 440, 442 (not shown). In other cases, and with reference to FIG. 26, the stitching lines 444 used to couple the hinge 182 to the first and second panels 178, 180 through the end caps 440, 442 may not couple the zipper 176 to the first and second panels 178, 180 through the end caps 440, 442, and vice versa.

Also, with reference to FIG. 25, in some cases, the wheel housings 116 may be coupled to the second sheet 180 by, for example, fasteners. In other cases, the wheel housings 116 may be coupled to the first sheet 178, and/or, in some cases, coupled to the hinge 182. For example, with reference to FIG. 25, the hinge 182 and second end cap 442 may be sandwiched between the wheel housing 116 and the second panel 180.

Figure 27:
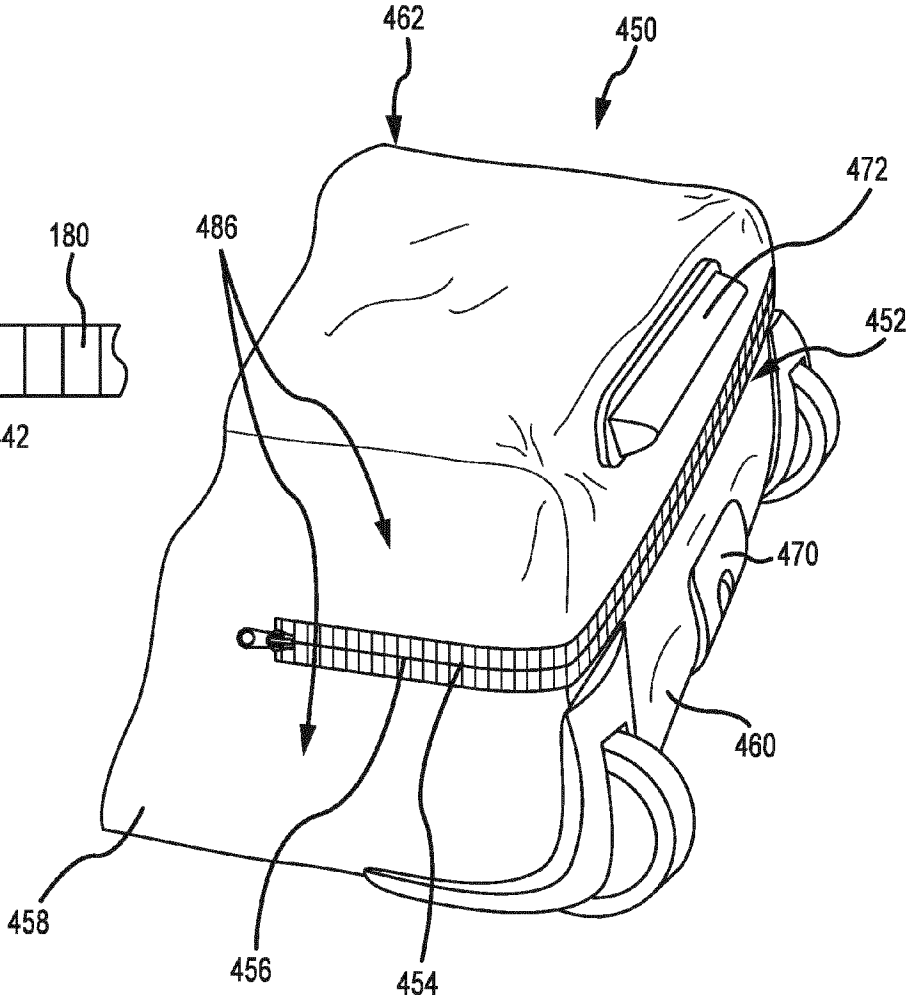
FIG. 27 shows a bottom perspective view of a portion of a luggage case with a first folding system, with the bottom side of the luggage not folded.

With reference to FIG. 27, a luggage case 450 may include a first folding system 452 with at least some components that extend up at least a portion of the right and/or left sides of the luggage case 450. For example, the zipper 456 or other securing mechanism 454 may extend from several inches above the bottom of the left side 458, across the bottom side 460, and up to several inches above the bottom of the right side 460 of the luggage case 450. Having a first folding system 452 extend up at least a portion of the right and/or left sides 458, 462 of the luggage case 450 may alleviate at least some of the stress caused at the opposing ends of the folding systems that terminate at the lateral edges of the bottom side of the luggage case (i.e. the luggage case 100 and first folding system 170 shown in FIG. 2A).

In operation, the first folding system 452 with at least some components that extend up at least a portion of the right and/or left sides 458, 462 of a luggage case 450 may be similar to the first folding system 170 described above in connection with FIG. 2A. For example, the bottom side 460 of the luggage case 450 may be positioned in an unfolded configuration when the securing mechanism 454 (e.g., the zipper 456) of the first folding system 452 locks the first folding system 452 into a non-folded position. In this configuration, the luggage case 450 may be used for transporting personal or business articles. When a user desires to store the luggage case 450, he or she may unsecure the securing mechanism 454 (e.g., unzip the zipper 456), which may allow the bottom side 460 of the luggage case 450 shown in FIG. 27 to be moved into a folded configuration. In other words, unsecuring the securing mechanism 454 (e.g., unzipping the zipper 456) unlocks the first folding system 452 and allows its components to rotate relative to one another, as explained in more detail below.

Figure 28:
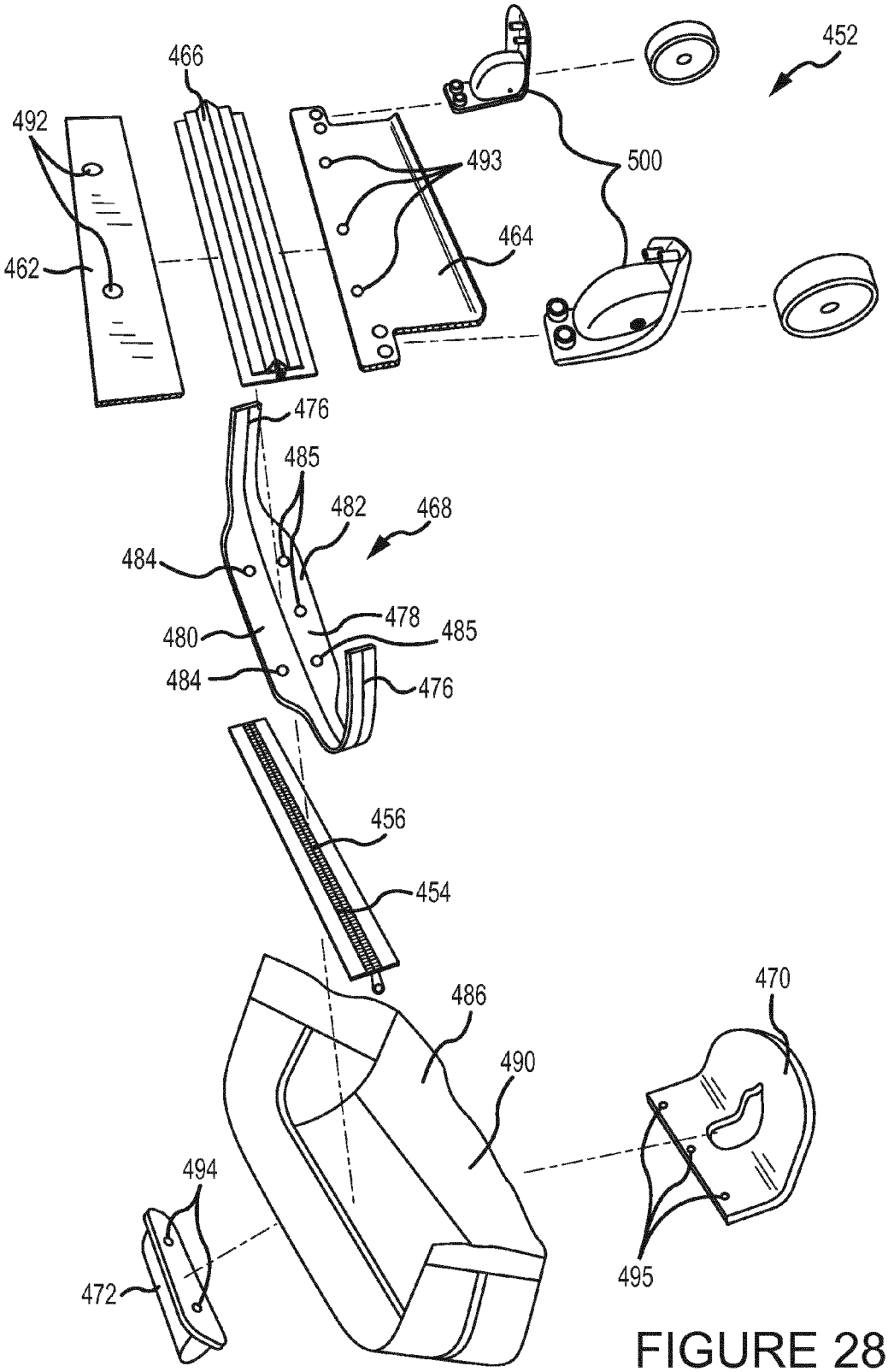
FIG. 28 shows an exploded perspective view of the structural components of an embodiment of the first folding system of the luggage case in FIG. 27.
Figure 30:
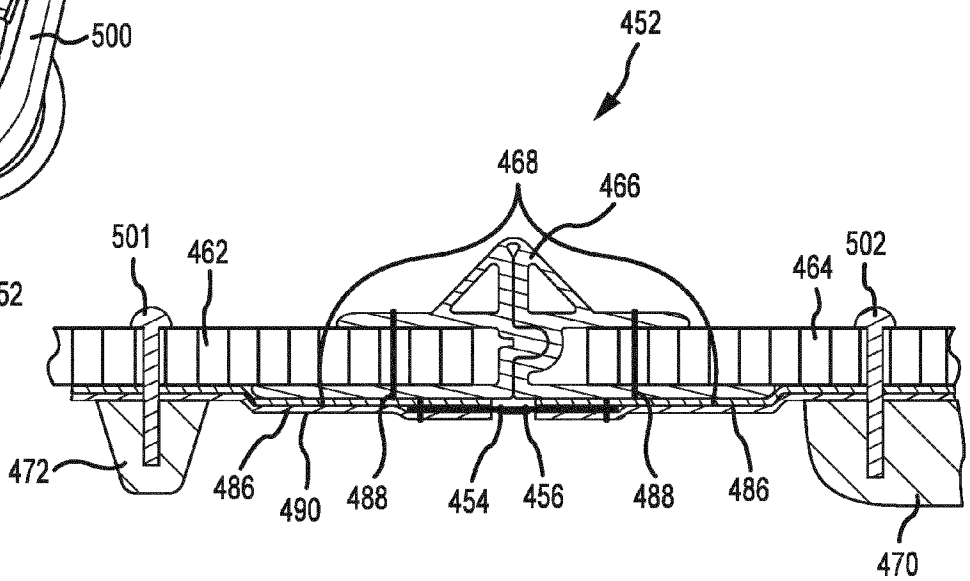
FIG. 30 shows a cross-section view of the assembled structural components shown in FIG. 29, viewed along line 30-30 in FIG. 29.
Figure 29:
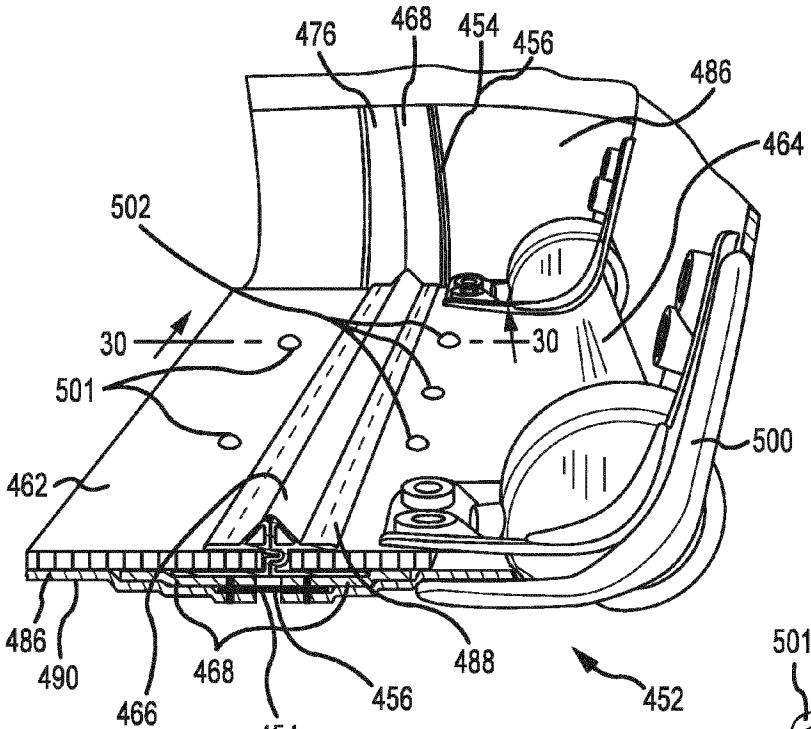
FIG. 29 shows a top perspective view of the structural components shown in FIG. 28 assembled with the first folding system locked in a not folded configuration.

With reference now to FIGS. 28 through 30, a first folding system 452 with at least some components that extend up at least a portion of the right and left sides 458, 462 of a foldable luggage case 450 is described. The first folding system 452 may include first and second panels 462, 464, a hinge 466, one or more profiled anchor members 468 (which may be made from polypropylene strips), and a securing mechanism 454 such as a zipper 456. In some examples, the first folding system 452 may also include a kick plate 470 and a support foot 472, which are coupled to the bottom side 460 of the luggage case 450. At least a portion of the fabric 486 proximate the first folding system 452 may be relatively flexible, such as the fabric 486 on the left and right sides 458, 462 of a luggage case 450 incorporating the first folding system 452.

The first and second panels 462,464, the hinge 466, and the securing mechanism 454 (such as a zipper 456) may generally be similar to the first folding system 170' described in connection with FIG. 7, except that the zipper 456 may be longer to extend up at least a portion of the left and right sides 458, 462 of a foldable luggage case 450. The profiled anchor member(s) 468 may have a generally U-shape, with the sides 476 of the U-shape corresponding to the portions of the planes of the left and right sides 458, 462 of the luggage case 450 and the base 478 of the U-shape corresponding to the plane of the bottom side 460 of the luggage case 450. The U-shaped profiled anchor member(s) 468 may include be divided into a front half 480 and a back half 482, corresponding with the first and second panels 462, 464, respectively, of the first folding system 450. The sides of the U-shaped profiled anchor member(s) 468 may be relatively narrow, and the base 478 may be somewhat wider and include several receiving holes 484 to receive fasteners, as described in more detail below. The somewhat wider base 478 may narrow to approximately the width of the relatively narrow sides 476 before the profiled anchor member(s) 468 bends up the left and right sidewalls of the luggage case 450. The sides 476 or ends of the profiled anchor members 468 may provide structure to the lower sidewalls of the luggage case 450 in some examples. For example, in some cases, the edges of the profiled anchor member(s) 468 form the line of engagement between two portions of fabric 486 on the foldable luggage 450, and the zipper 456 or other securing mechanism 454 is attached along the side edges of the profiled anchor member(s) 468.

With reference to FIGS. 29 and 30, the hinge 466 may be coupled to the first and second panels 462, 464 along the length of the hinge 466 (which may or may not extend the length of the first and second panels 462, 464, as explained above) by, for example, stitching. For example, first and second panels 462, 464 may be received in the respective receiving portions of the hinge 466 and secured therein. The hinge 466 may also be coupled to the first and second panels 462, 464 by another suitable means, such as by gluing, sonic or thermal welding, and so forth. When the hinge 466 is coupled to the first and second panels 462, 464 by stitching, one or more respective lines of stitching 488 may couple the hinge 466 to the first and second panels 462, 464. See FIG. 30. In general, one, two, or more respective lines of stitching 488 may be used to couple the hinge 466 to the respective first and second panels 462, 464.

Also, the securing mechanism 454 may be coupled to the profiled anchor member(s) 468 and the outer material 490 of the bag 450. For example, with reference to FIG. 30, the securing mechanism 454 may be sandwiched between the profiled anchor member(s) 468 and the outer material 490 of the bag 450. The profiled anchor member(s) 468, the securing mechanism 454, and the outer material 490 of the bag 450 may be coupled along the length of the securing mechanism 454 and/or along the length of the profiled anchor member(s) 468 by, for example one, two, or more stitch lines 488. In other examples, however, the profiled anchor member(s) 468, the securing mechanism 454, and the outer material 490 of the bag 450 may not all be coupled together along the entire length of the securing mechanism 454 and/or along the length of the profiled anchor member (s) 468, but rather, only two of these components may be coupled along the entire length, or two may be coupled along a certain length, with a different two coupled along another length, and so forth.

For example, in the case of a zipper 456 as the securing mechanism 454, one side of the zipper tape may be sandwiched between the front half 480 of the profiled anchor member(s) 468 and the outer material 490 of the bag 450, while the other side of the zipper tape may be sandwiched between the rear half 482 of the profiled anchor member(s) 468 and the outer material 490 of the bag 450, both along at least a portion of the length of the zipper 456 (up to the entire length). In addition to coupling by stitching, the zipper 456 may also or alternatively be coupled to the hinge 466 by gluing, sonic welding, and so forth.

The front half 480 of the base 478 of the U-shaped profiled anchor member(s) 468 may include two receiving holes 484, which may correspond to two receiving holes 492 in the first panel 462 and two receiving holes 494 in the foot 472. Also, the rear half 482 of the base 478 of the U-shaped profiled anchor member(s) 468 may include three receiving holes 485, which may correspond to three receiving holes 493 in the second panel 464 and three receiving holes 495 in the kick plate 470.

With reference to FIGS. 29 and 30, the first folding system 450 may be assembled by aligning the assembly of the first panel 462, the second panel 464, and the hinge 466 with the assembly of the profiled anchor member(s) 468, the zipper 456, and the fabric 486, and also with the foot 472 and kick plate 470 of the luggage case 450. More specifically, the two holes 492 in the first panel 462 may be aligned with the two holes 484 in the front half 480 of the profiled anchor member(s) 468 and fabric 486 and also with the two holes 494 in the foot 472, while the three holes 493 in the second panel 464 are aligned with the three holes 485 in the rear half 482 of the profiled anchor member(s) 468 and fabric 486 and also with the three holes 495 in the kick plate 470. Fasteners 501, 502 such as bolts, screws or other threaded fasteners, or other types of fasteners, may be positioned through each of the respective two and three holes. In this manner, the zipper 456 may not need to be stitched to the first and second panels 462, 464, but instead may be indirectly coupled to the first and second panels 462, 464 through the polypropylene strip(s) 468 and fasteners. In other words, with reference to FIGS. 28 to 30, the first folding system 450 may be manufactured by first assembling some of the components (e.g., the first panel 462, the second panel 464, and the hinge 466) together into a first composite, and then assembling the remaining components (the profiled anchor member(s) 468, the zipper 456 or other securing mechanism 454, and the outer material 490 of the bag 450) together into a second composite, and the securing the first composite to the second composite, thus eliminating the need to couple all of the components together in a single coupling step.

Also, in some cases, the wheel housings 500 may be coupled to the second sheet 464 by, for example, fasteners. In other cases, the wheel housings 500 may be coupled to the first sheet 464, and may, in some cases, be coupled to the hinge 466. In still other cases, the wheel housings 500 may be integrated into the kick plate 470, and/or wheel housings 450 or another kick plate may replace the foot 472 (such as in a spinner type luggage case).

In some examples, only a single profiled anchor member 468 may be used, in which case the single profiled anchor member may be cut along its U-shape in order to form the front half 480 and the rear half 482 of the profiled anchor member 468. In other examples, two separate profiled anchor members 468 may be used, with the one member forming the front half 480 and the other member forming the rear half 482 of the polypropylene strips 468. In some examples, the end(s) 476 of the profiled anchor member(s) 468 may be fixed to the securing mechanism 454 and/or to the fabric 486 that forms the sidewall(s) of the luggage case 450. In other examples, however, one or more of the profiled anchor members 468 may not be fixed to the securing mechanism 454 and/or to the fabric 486 that forms the sidewalls of the luggage case 450. Whether or not the ends 476 of the profiled anchor member(s) 468 are fixed to the securing mechanism 454 and/or to the fabric 486 that forms the sidewalls may cause the profiled anchor member 468 to bend or not bend in certain directions. For example, if the ends 476 are secured to the sidewall fabric 486, the profiled anchor members 468 may bend with the fabric 486 as the bag 450 is folded. As another example, however, if the ends 476 are not secured to the fabric 486, the profiled anchor members 468 may not bend, even though the sidewall fabric 486 does bend or collapse.

In operation, the first folding system 450 shown in FIGS. 28 through 30 may be somewhat similar to the first folding system(s) 170 described above, such as that shown in FIG. 5. The securing mechanism 454 may be unsecured (e.g., unzipping the zipper 456) around the bottom portion of the left side 458, across the bottom side 460, and up the bottom portion of the right side 462. The first panel 462 may be folded relative to the second panel 464 via the hinge 466, similar to the first folding system(s) 170 described above, and the sides 476 of the U-shaped polypropylene strip(s) 468 may bow or collapse in towards the center of the bag 450 and also towards the rear of the bag 450. This may happen if, for example, the fabric 486 near the sides 476 of the U-shaped polypropylene strip(s) 468 is relatively flexible, and the polypropylene strip(s) 468 is/are also relatively flexible. Such collapsing allows the U-shaped anchor plates 468 that extend vertically from the bottom wall to adequately allow the folding of the portions of the bottom side 460, and provide structure and shape when in the folded position.

In cases where the U-shaped polypropylene strip(s) 468 are not secured to the securing mechanism 454 along at least a portion of the left and right sides 476 of the U-shape, however, the front half 480 and the rear half 482 of the polypropylene strip(s) 468 may move relative to one another as the first panel 462 is folded relative to the second panel 464, by for example, crossing one another or bending in different directions. In still other cases, the U-shaped polypropylene strip(s) 468 may be secured to the securing mechanism 454 along the length of the polypropylene strip(s) 468 and the folding or bending of the first and second panel 462, 464 relative to one another may cause the polypropylene strip(s) 468 to also bend in order to fold the foldable luggage case 450.

Figure 31:
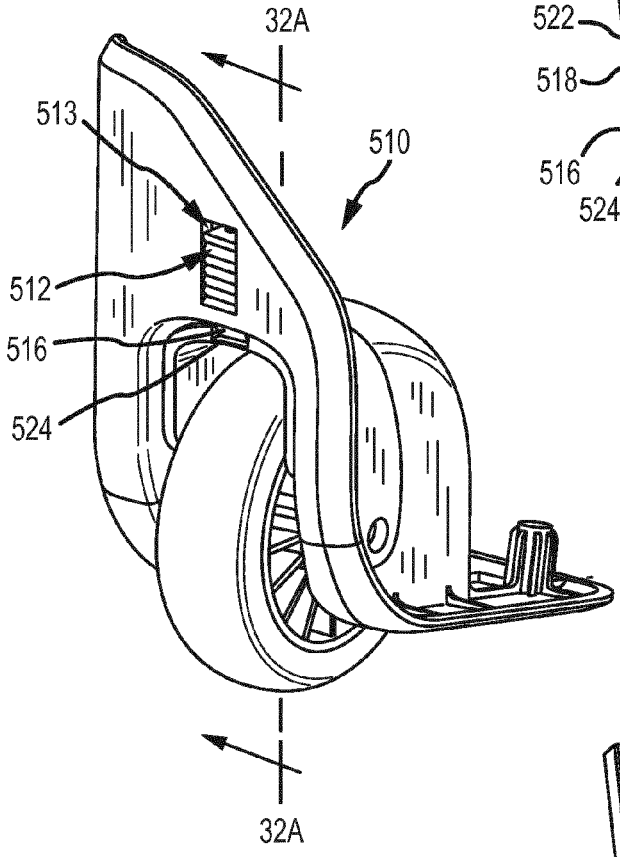
FIG. 31 shows a rear perspective view of a foldable wheel housing with a locking mechanism, with the foldable wheel housing locked in a not folded configuration.
Figure 32A:
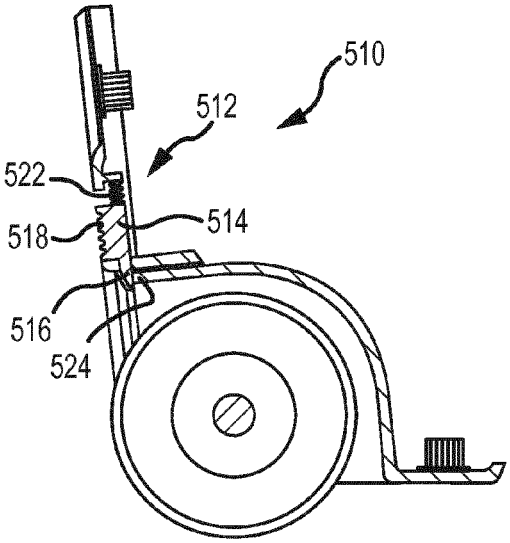
FIG. 32A shows a cross-section view of the foldable wheel housing shown in FIG. 31, viewed along line 32A-32A in FIG. 31.
Figure 32B:
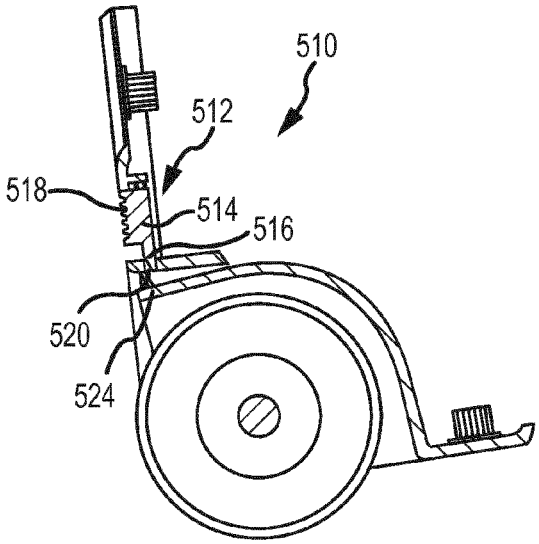
FIG. 32B shows a cross-section view of the foldable wheel housing shown in FIG. 31, except with the foldable wheel housing not locked and in a partially folded configuration.

With reference now to FIG. 31 and FIGS. 32A and 32B, as mentioned above, a foldable wheel housing 510 may include a locking mechanism 512. One example of a locking mechanism 512 may take the form of a spring-loaded detent 514 which selectively locks and unlocks the foldable wheel housing 512 into a not folded configuration. The detent 514 may include a protrusion 516 and a grip portion 518 that is accessible to a user through, for example, an opening 513 in one portion of the foldable wheel housing 510 (e.g., the sheath portion).

The spring 522 may bias the protrusion 516 of the detent 514 through an opening 520 in one portion or piece of the foldable wheel housing 510 (e.g., the sheath portion) into or against a blocking member 524 in the other portion or piece of the foldable wheel housing 510 (e.g., the hollow disk portion). The blocking portion 524 may be the edge of the hollow disk portion, a projection therefrom, a recess therein, etc. The force of the spring 522 may be overcome when a user biases the detent 514 in a direction opposite the spring 522 biasing direction by pulling or otherwise actuating the grip portion 518. When the force of the spring 522 is overcome, the protrusion 516 of the detent 514 may clear the blocking member 524, which may allow the two portions or pieces of the foldable wheel housing 510 to fold or rotate relative to one another, which, as described above, may allow a luggage case incorporating the foldable wheel housing 510 to fold. When the foldable wheel housing 510 is subsequently rotated back towards its locked position (e.g., when the luggage case is unfolded), the blocking member 524 of one portion or piece of the foldable wheel housing 510 may slide past the protrusion 516 of the detent 514, which may again lock the foldable wheel housing 510 into a locked position. Other locking mechanisms may also be used on or in connection with the foldable wheel housing in some examples.

In some examples, the locking mechanism 512 of one or more foldable wheel housings 510 may be used as the securing mechanism of the first or second folding system of a luggage case, in place of, for example, a zipper. Also, although FIGS. 31 through 32B illustrate the detent 514 on a sheath of the foldable wheel housing 510 and the blocking member 524 on a shell of the foldable wheel housing 510, in other examples, the detent 514 may be located on the shell of the foldable wheel housing 510 and the blocking member 524 may be located on the sheath, or the locking mechanism 512 may be located on other portions or pieces of the wheel housing 510. Moreover, when incorporated into a luggage case's folding system, the locking mechanism 512 may be located on any side. For example, in a folding system between the rear and bottom sides of the luggage case, the detent 514 and blocking member 524 may be along the rear side or the bottom side of the luggage case.

Figure 33:
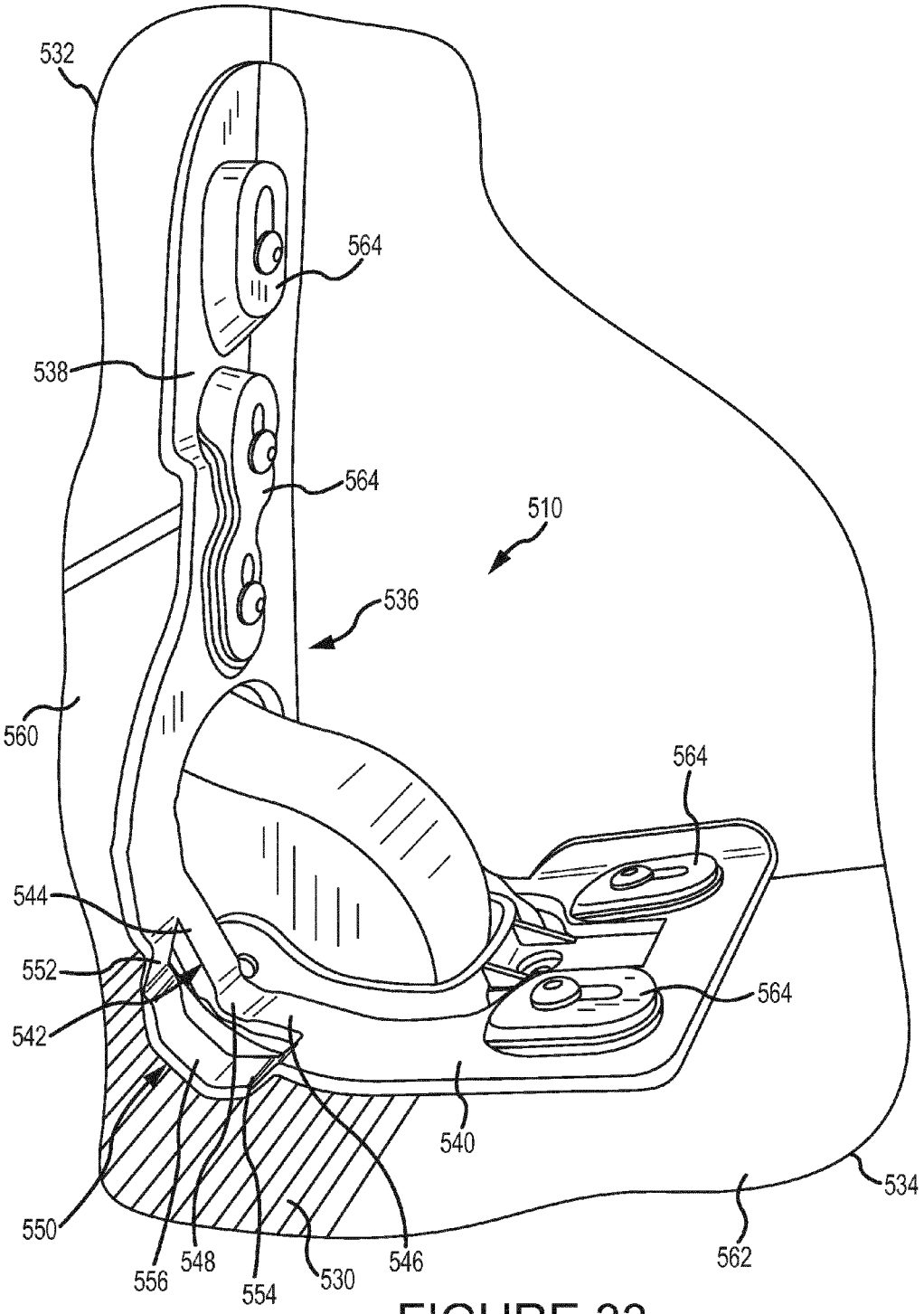
FIG. 33 shows a perspective view of a brace for use with a foldable wheel housing in a luggage case.
Figure 34A:
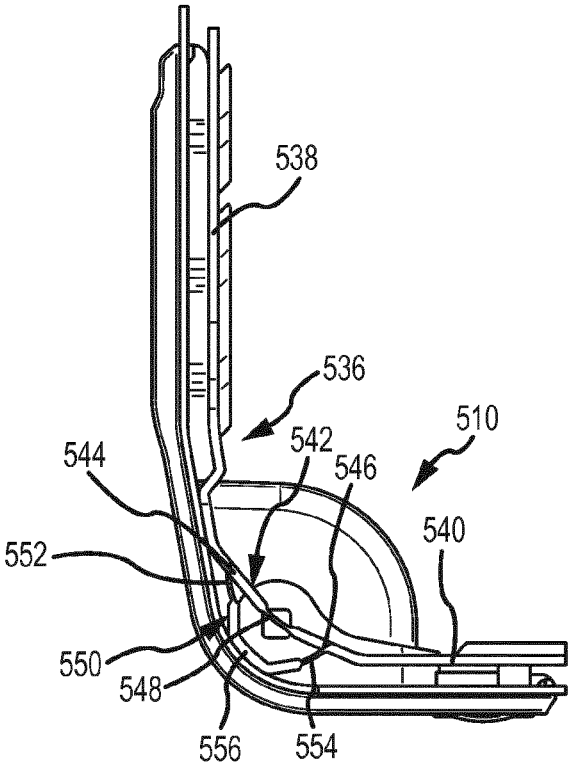
FIGS. 34A and 34B show cross-section views of the brace and foldable wheel housing shown in FIG. 33 viewed along line 34A-34A in FIG. 33 in respective unfolded and folded configurations.
Figure 34B:
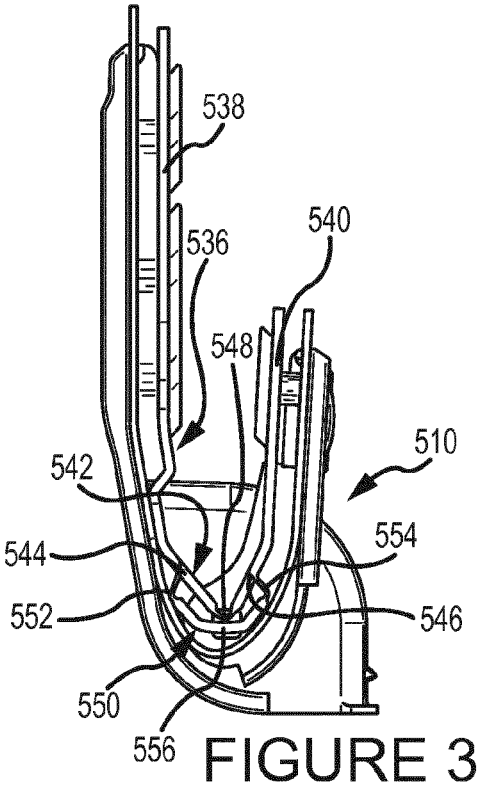

With reference now to FIGS. 33 through 34B, when the hinge 530 of a folding system is, for example, along the intersection between the rear and bottom sides 532, 534 of the luggage and is defined by two foldable wheel housings 510 as described above, a folding brace 536 may couple the rear and bottom sides 532, 534 of the luggage proximate each foldable wheel housing 510 within the enclosed volume of the luggage case. Each brace 536 may include two linear or elongated portions 538, 540, each linear or elongated portion 538, 540 coupled to a respective side portion or panel 532, 534 of the luggage case. Each brace 536 may also include two connector arms coupled between the two linear or elongated portions 538, 540, with one connector arm disposed on each side of the wheel housing 510.

A first of the connector arms may include two joint members 542, 550. The first joint member 542 may be proximate the wheel housing shell and may include a first end portion 544 joined to one of the linear portions 538 of the brace 536 and a second end portion 546 that is distal the first end portion 544 and that is joined to the other linear portion 540 of the brace 536. In some examples, the first and second end portions 544, 546 may be substantially integrally formed with the linear portions 538, 540. Between the first and second end portions 544, 546, the first joint member 542 may include a single foldable joint 548. The foldable joint 548 may be formed by a weakened area of the joint member 542 which has a smaller thickness than the remainder of the joint member 542.

The second joint member 550 of the first connector arm may generally be proximate to and laterally offset from the first joint member 542 and may similarly include two end portions 552, 554 joined to respective linear portions 538, 540 of the brace 536. Further, each end portion 552, 554 of the second joint member 550 may be formed as a foldable joint, thus resulting in the second joint member 550 acting as a double articulated joint. Like the first joint member 542, the foldable joint regions 552, 554 of the second joint member 550 may be formed by weakening these areas of the second joint member 550. In between the two end portions 552, 554 of the second member 550 may be an inner strength member 556. With reference FIG. 34B, the second joint member 550 may bias a hinge 530 and/or a panel 532 of the luggage case away from another panel 534 of the luggage in order to avoid a gap forming between the foldable wheel housing 510 and one or more of the panels 532, 534.

The second connector arm may include only a single joint member, similar to the first joint member 542 of the first connector arm with two end portions coupled to the two linear portions and a single foldable joint. The second connector arm may be positioned adjacent to the wheel housing on a side of the wheel housing that is distal from the side of the wheel housing proximate to the first connector arm.

In operation, with reference to FIGS. 34A and 34B, each brace 536 may, similar to and in connection with its respective foldable wheel housing 510, serve to rotatably couple two portions of a luggage case together. Referring back to FIG. 33 and with reference still to FIGS. 34A and 34B, the wheel housing 510 and brace 536 may pivotally couple two support portions 532, 534 of a luggage case, for example a rear side support portion and a bottom side support portion 534. In some examples, both support portions 532, 534 may be defined by a single sheet of material, such as polypropylene sheet. In these examples, a hinge 530 may also be defined by the single sheet of material. The hinge 530 may be positioned between the support portions 532, 534 of the single sheet of material. Each support portion 532, 534 may be coupled to one of the wheel housings 510 and the wheel housing's respective brace 536. At least a portion of the hinge 530 of the single sheet of material may be scored or otherwise weakened to promote flexibility and bending of the hinge 530. Also, in theses examples, reinforcement boards 560, 562 may be coupled to the single sheet of material, and the reinforcement boards 560, 562 may be proximate the wheel housing 510. In other examples, the wheel housing 510 and brace 536 may couple together two support portions 532, 534 made of distinct sheets or portions of material. For example, a first rigid board may define the rear side of a luggage case and form one of the support portions 532, 534 of the luggage case, and a second rigid board may define the bottom side of the luggage case and form the other of the support portions 532, 534 of the luggage case. A first piece of the wheel housing 510 may be joined to the first rigid board, and a second piece of the wheel housing 510 may be joined to the second rigid board. In these examples, a separate piece of material may or may not be coupled between the first and second rigid boards to form a hinge. The piece of material may be polypropylene, and at least a portion of the polypropylene may be scored to promote flexibility and bending of the hinge. In other embodiments, no rigid or semi-rigid hinge portion may be positioned between the two rigid boards, and instead the outer fabric of the luggage case may act as a hinge.

The wheel housing 510 and/or the brace 536 may be coupled to the two support portions (e.g., a single sheet of material, two distinct rigid boards, etc.) in several different manners. For example, the wheel housing 510 and/or the brace 536 may include one or more bosses or other receiving or connection elements 564 for operative securement to the two support portions 532, 534 via a screw or rivet. As another example, the wheel housing 510 and/or brace 536 may be glued, stitched, or thermally welded to the portions 532, 534 of the luggage case, and so forth. In those examples with a single sheet of material and reinforcement boards 560, 562, the two pieces of the wheel housing 510 and/or the brace 536 may also be secured to one or more of the reinforcement boards 560, 562. In general, and with reference to FIGS. 34A and 34, the wheel housing 510 and the brace 536 may be pivotally secured to the luggage case in many different manners, and the manner of coupling the wheel housing 510 to the luggage case need not be the same as the manner of coupling the brace 536 to the luggage case.

The apparatuses and associated methods in accordance with the present disclosure have been described with reference to particular embodiments thereof in order to illustrate the principles of operation. The above description is thus by way of illustration and not by way of limitation. Various modifications and alterations to the described embodiments will be apparent to those skilled in the art in view of the teachings herein. Those skilled in the art may, for example, be able to devise numerous systems, arrangements and methods which, although not explicitly shown or described herein, embody the principles described and are thus within the spirit and scope of this disclosure. Accordingly, it is intended that all such alterations, variations, and modifications of the disclosed embodiments are within the scope of this disclosure as defined by the appended claims.

Where appropriate, common reference numbers and words are used for common structural and method features. However, unique reference numbers and words are sometimes used for similar or the same structural or method elements for descriptive purposes. As such, the use of common or different reference numbers or words for similar or the same structural or method elements is not intended to imply a similarity or difference beyond that described herein.

In methodologies directly or indirectly set forth herein, various steps and operations are described in one possible order of operation, but those skilled in the art will recognize that the steps and operations may be rearranged, replaced, or eliminated without necessarily departing from the spirit and scope of the disclosed embodiments.

All relative and directional references (including: upper, lower, upward, downward, left, right, leftward, rightward, top, bottom, side, above, below, front, middle, back, vertical, horizontal, clockwise, counterclockwise, and so forth) are given by way of example to aid the reader's understanding of the particular embodiments described herein. They should not be read to be requirements or limitations, particularly as to the position, orientation, configuration, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

In some instances, components are described with reference to "ends" having a particular characteristic and/or being connected with another part. However, those skilled in the art will recognize that the disclosed embodiments are not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like.

What is claimed is:

1. A luggage case comprising at least one wheel housing, the luggage case comprising:

a front side, a rear side, a right side, a left side, an upper side, and a bottom side;

a telescoping tow handle associated with the luggage case and including a grip portion;

a folding system comprising at least one wheel housing operable to fold the luggage case, wherein the at least one wheel housing comprises:

first and second pieces pivotally joined together at a wheel housing pivot axis about which the first and second pieces move to collapse or fold the luggage case;

the first piece operatively coupled to the rear side of the luggage case and the second piece operatively coupled to the bottom side of the luggage case such that the first and second pieces extend at an angle of at least 90 degrees relative to each other when in an unfolded position;

the at least one wheel housing comprises at least part of the folding system and the wheel housing pivot axis defines a luggage case pivot axis along which the rear side and the bottom side of the luggage case move relative to each other to collapse the luggage case;

at least one of the first and second pieces supports an axle that supports a wheel, the axle axially aligned with the wheel housing pivot axis;

the first piece includes a first surface that conforms to a first surface portion of the luggage case; and the second piece includes a second surface that conforms to a second surface portion of the luggage case.

2. The luggage case of claim 1, wherein the first piece of the at least one wheel housing comprises a shell with a disk portion configured to receive and cover a portion of the wheel, and the second piece comprises a sheath with a protruding portion operable to pivot around the disk portion of the shell.

3. The luggage case of claim 1, wherein each of the first and second pieces of the at least one wheel housing comprises an elongated portion, and each elongated portion includes at least one boss for operative securement of the respective first and second pieces to the luggage case.

4. The luggage case of claim 1, further comprising a locking mechanism operable to lock the first and second pieces in a first position relative to one another, and the first position is an open position.

5. The luggage case of claim 4, wherein the locking mechanism comprises a detent on the second piece and a blocking member on the first piece.

6. The luggage case of claim 1, wherein the wheel housing defines a luggage case pivot axis offset from a center of a base of the luggage case and along which a rear side and a bottom side of the luggage case move relative to one another to collapse the luggage case.

7. The luggage case of claim 1, wherein the first piece of the wheel housing is operatively coupled to a first support portion of the luggage case, the second piece of the wheel housing is operatively coupled to a second support portion of the luggage case, and the first and second support portions are defined by a single sheet of material that also defines a hinge that is positioned between the first and second portions.

8. The luggage case of claim 7, wherein the single sheet of material is scored within at least a portion of the single sheet of material that defines the hinge.

9. The luggage case of claim 1, wherein the first piece of the wheel housing is operatively coupled to a first support portion of the luggage case, the second piece of the wheel housing is operatively coupled to a second support portion of the luggage case, the first and second support portions are distinct one from the other, and the luggage case further comprises a hinge coupled between the first and second portions.

10. The luggage case of claim 9, wherein the first and second support portions respectively comprise first and second panels, and the hinge extends along at least a portion of respective planes defined by both the first and second panels.

11. The luggage case of claim 1, further comprising a brace with a plurality of connector arms, at least one of the plurality of connector arms including a first joint member defining a single joint and a second joint member defining a double articulating joint, with the first joint member proximate to the first and second pieces of the wheel housing and the second joint member spaced away from the first and second pieces of the wheel housing.

12. The luggage case of claim 11, wherein the single joint pivots about a joint pivot axis that is substantially coaxial with the axle supporting the wheel.

13. The luggage case of claim 1, further comprising:

a second folding system associated with the rear side of the luggage case operable to fold the luggage case along its height, wherein:

the rear side of the foldable luggage case is operable to fold along a fold line defined at least in part by the grip portion of the telescoping tow handle when the telescoping tow handle is retractably received in the luggage case.

* * * * *